US007742365B2

(12) United States Patent
Moteki et al.

(10) Patent No.: US 7,742,365 B2
(45) Date of Patent: Jun. 22, 2010

(54) TIMEPIECE AND PORTABLE DEVICE

(75) Inventors: Masatoshi Moteki, Nagano (JP); Noriaki Ozawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 12/203,570

(22) Filed: Sep. 3, 2008

(65) Prior Publication Data

US 2009/0059736 A1 Mar. 5, 2009

(30) Foreign Application Priority Data

Sep. 5, 2007 (JP) ..... 2007-229825
Jun. 13, 2008 (JP) ..... 2008-154964

(51) Int. Cl.
*G04B 21/00* (2006.01)

(52) U.S. Cl. ..... 368/269

(58) Field of Classification Search ..... 368/269, 368/244, 12, 72, 74, 243, 249
See application file for complete search history.

(56) References Cited

U.S. PATENT DOCUMENTS 2,786,326 A 3/1957 Junghans et al.
6,134,190 A * 10/2000 Kotanagi ..... 368/74
2004/0042348 A1* 3/2004 Rochat ..... 368/72

FOREIGN PATENT DOCUMENTS

| | | | |
|---|---|---|---|
| CH | 290046 | | 7/1953 |
| EP | 0451340 | A1 | 10/1991 |
| JP | 2007-127268 | A | 5/2007 |
| JP | 2008-020211 | A | 1/2008 |
| JP | 2008-020212 | A | 1/2008 |

OTHER PUBLICATIONS

Francois Lecoultre, "A Guide to Complicated Watches", ISBN2-88175-001-X, 3rd Edition, Antoine Simonin, p. 159-p. 179.Printed in Switzerland, 2004.
Gakken Mook Watch Nevi Special Edition "2002 Latest Wrist Watch Full Spec Picture Book, Charms of Functionality, Operationality, Figurative arts, etc." Mar. 1, 2002, p. 117. Gakken Co., Ltd. Japan.
Kenichi Hirano "Time Scene Watch Special" 2005 vol. 5, Jul. 25, 2005, p. 137. Tokuma Shoten, Japan.

* cited by examiner

*Primary Examiner*—Edwin A. Leon
(74) *Attorney, Agent, or Firm*—Global IP Counselors, LLP

(57) ABSTRACT

A timepiece having a movement having a hammer and a hammer drive device that drives the hammer, a case that houses the movement, a sound source that produces sound by vibrating when struck by the hammer, and a striking force transmission member that can move bidirectionally between the hammer and the sound source, and transmits the striking force of the hammer to the sound source.

17 Claims, 29 Drawing Sheets

| ECHO CHAMBER | NO | YES | NO | YES |
|---|---|---|---|---|
| CASE WALL THICKNESS | 0.6mm | 0.6mm | 1.2mm | 1.2mm |
| INSIDE CASE TO WALL DISTANCE | 2.95mm | 2.95mm | 2.3mm | 2.3mm |

TIMEPIECE AND PORTABLE DEVICE

BACKGROUND

1. Field of Invention

The present invention relates to a timepiece and a portable device that have a sound source such as a gong or a bell.

2. Description of Related Art

Sonnerie timepieces that have a C-shaped gong and a hammer for striking the gong are known from the literature. See, for example, "2002 Guide to the latest wristwatches with full specifications," K. K. Gakushu Kenkyusha, published Mar. 1, 2002, page 117. The timepiece in this example has the gong fastened to the base plate and disposed along the outside of the movement. The hammer is attached to the base plate on the inside of the gong so that the hammer can pivot, and is driven at a predetermined time by the drive power of a spring. A spring that returns the hammer that strikes the gong to its original position is also attached to the base plate.

The sonnerie timepiece according to the related art described above strikes the gong directly with a hammer, and a spring that urges the hammer toward the gong when striking the gong and another spring that pulls the hammer away from the gong and back to its original position after striking the gong are disposed to the hammer. However, in a mechanism such as this that has springs urging the hammer in two different directions disposed to the hammer, the hammer may not separate from the gong after striking the gong, and may therefore inhibit vibration of the gong, if the spring force of the spring that urges the hammer to the gong is high. On the other hand, if the force of the spring that pulls the hammer away from the gong is strong, the hammer strikes the gong with less force and the gong may not produce a good sound. It is therefore necessary to appropriately set the strength of these springs.

However, if the springs urging in opposite directions are attached directly to the hammer, adjusting the force of each spring appropriately is difficult.

SUMMARY

A timepiece and a portable device having a sound source that produces sound when the sound source is struck and vibrates according to the present invention enable easily setting the spring force of each spring so that a pleasing sound is produced.

A timepiece according to a preferred aspect of the invention has a movement having a hammer and a hammer drive device that drives the hammer; a case that houses the movement; a sound source that produces sound by vibrating when struck by the hammer; and a striking force transmission member that can move bidirectionally between the hammer and the sound source, and transmits the striking force of the hammer to the sound source.

The sound source of the invention is any device that produces sound by vibrating when struck, including, for example, wind chimes, temple bells, the chimes in traditional Japanese lunar calendar clocks, alarm clock chimes, gongs, and drums.

The sound source in the present invention produces sound when the striking force from a hammer is transferred to a striking force transmission member, and this striking force transmission member strikes the sound source. By using an intervening striking force transmission member, a spring that exerts force toward the sound source can be disposed on the hammer side, and a spring that exerts force toward the hammer can be disposed on the striking force transmission member. More specifically, the springs that push in mutually different directions and are conventionally disposed directly to the hammer can be separately disposed to the hammer and the striking force transmission member. The spring force of the springs working on the hammer and the striking force transmission member can therefore be easily set, and productivity can be improved during manufacture.

Furthermore, because the spring force of each spring can be suitably set, the urging force of the hammer can be set so that it is not applied to the striking force transmission member when the striking force transmission member has struck the sound source. The striking force transmission member therefore does not stop in contact with the sound source, and rebounds immediately toward the hammer side after striking the sound source. More specifically, vibration of the sound source is not inhibited by the striking force transmission member in the timepiece according to the invention, and a pleasing sound can be produced. The initial sound pressure from the sound source is therefore high, sound pressure attenuation over time is reduced, and a pleasing sound with long-lasting reverberation can be produced.

Preferably, the sound source is disposed outside the case; and the case houses the movement in an airtight state, and has disposed thereto a holding unit that supports the striking force transmission member movably bidirectionally between the hammer and the sound source while the inside of the case remains airtight.

More specifically, in a timepiece having an internal sound source that produces sound when struck by a hammer, a gap is generally provided where the case and the back cover are joined so that the sound produced when the hammer strikes the sound source can be heard outside the case, and the timepiece is therefore not sufficiently water resistant. Furthermore, if packing is provided between the case and the back cover in order to make the timepiece water resistant, or packing is used to make the inside of the case airtight, the air inside the case does not vibrate easily and the resulting sound is therefore small.

In this aspect of the invention, however, the sound source is disposed outside the airtight case. As a result, the movement can be rendered water resistant without muffling or changing the sound produced by the sound source. Because the invention transmits the striking force of the hammer to a sound source outside the case by means of an intervening striking force transmission member, the air vibrations around the sound source carry the desirable sound produced by the sound source.

Furthermore, by locating the hammer inside the case (in an airtight chamber), it is not necessary to provide a water resistant structure for the hammer. If packing, for example, is disposed to the pivot axis of the hammer (when a pivoting hammer is used), the sliding resistance of the hammer is increased when the hammer operates. However, because only the sound source is outside the case and the hammer is inside the case in this aspect of the invention, the sliding resistance when the hammer operates can be reduced. Wear on the pivot axis of the hammer can therefore be reduced, and less energy is required to strike the sound source. As a result, if a hairspring is used as the power source of the hammer drive device, the duration time of the spring can be increased.

The case in the invention includes the crystal and back cover. If the case member and back cover are rendered as a one-piece construction, the case includes this one-piece case member and the crystal. If a bezel holds the outside edge part of the crystal, the bezel is also part of the case. In other words, the case is rendered by the case member, crystal, back cover, and other members forming an airtight chamber.

In a timepiece according to another aspect of the invention the striking force transmission member includes a pin that can move bidirectionally between the hammer and the sound source, a closing member that closes a space between the pin and a holding unit that supports the pin, and an urging member that urges the pin toward the hammer.

Structures enabling movement (displacement) bidirectionally through the case are known from the literature and are used on the crown stem and chronograph buttons, for example, and typically have packing provided around the crown stem or shaft of the button to make the inside of the case water resistant. If the striking force transmission member is rendered with a pin as in this invention, known timepiece technology can be used to easily manufacture the striking force transmission member. More specifically, a new component design is not needed and extra cost is not incurred.

Note that after the pin transfers the striking force of the hammer to the sound source, the pin is returned to its original position by an urging member. This pin urging member can be a coil spring disposed to the pin, or a spring disposed to the base plate of the movement, for example.

In a timepiece according to another aspect of the invention the striking force transmission member has a stopper that contacts part of the pin and limits pin movement when the pin moves to the sound source side.

In this aspect of the invention the striking force transmission member has a stopper that prevents the pin from moving too far to the sound source side. As a result, if the air pressure outside the case suddenly drops and the pressure inside the case becomes greater than the outside pressure, the stopper limits movement of the pin and prevents such problems as the inside pressure pushing the pin outside and separating from the case.

In a timepiece according to another aspect of the invention the closing member is an annular or tubular elastic member; the inside edge part of the elastic member when the elastic member is annular, or one axial end part of the elastic member when the elastic member is tubular, is fixed to an outside surface part of the pin; and the outside edge part of the elastic member when the elastic member is annular, and the other axial end part of the elastic member when the elastic member is tubular, is fixed to the holding unit.

When a ring-shaped elastic member (packing or an O-ring) is disposed between the outside of the pin and the holding unit, there is friction resistance between the surface of the elastic member and the holding unit, and the sliding resistance to pin movement is great.

By fixing the elastic member to the pin and the holding unit in this aspect of the invention, however, the pin moves with deformation of the elastic member and there is no sliding resistance between the pin and the holding unit. Compared with using an O-ring, this aspect of the invention increases the striking force transmitted to the sound source by the pin, and reduces the energy required to strike the sound source. As a result, if a hairspring is used as the power source of the hammer drive device, the duration time of the spring can be increased.

In addition, if an O-ring is disposed between the pin and the holding unit, lubrication runs out, and the O-ring becomes damaged, water resistant may drop, but such problems cannot occur with the invention.

If an elastic member without a hole is disposed between the hammer and pin, the elastic member imposes an unavoidable loss of mechanical energy driving the hammer, but this problem cannot occur with the invention.

In a timepiece according to another aspect of the invention the striking force transmission member has a first pin and a second pin that are connected lengthwise as the pin; and the inside edge part of the elastic member when the elastic member is annular, or one axial end part of the elastic member when the elastic member is tubular, is held between the first pin and the second pin.

By rendering the pin from two parts, this aspect of the invention enables easily fixing the elastic member to the outside of the pin between the first pin and the second pin.

Rendering the pin from two parts also improves greater freedom selecting the materials from which the pins are made. For example, the material of the second pin that strikes the sound source can be selected according to the material used for the sound source to improve the sound quality.

In a timepiece according to another aspect of the invention the striking force transmission member includes a pin that can move bidirectionally between the hammer and the sound source, and a closing member that closes a space between the pin and a holding unit that supports the pin; the closing member is an annular or tubular elastic member; and the pin is urged toward the hammer by the elastic member.

By using an elastic member to urge the pin, it is not necessary in this aspect of the invention to provide a spring or other such urging member to return the pin after striking. More specifically, the elastic member is used both to assure water resistance and as an urging member returning the pin, and the parts cost can therefore be reduced.

A timepiece according to another aspect of the invention also has an outside case disposed outside the case covering at least a part of the sound source; and an opening enabling the free passage of air in and out is formed in the outside case.

Even if the cuff of a shirt sleeve, for example, contacts the outside of the timepiece according to this aspect of the invention, the cuff cannot touch the sound source covered by the outside case and attenuate vibration of the sound source, and the volume and quality of sound will therefore not change.

In addition, because openings are formed in the outside case, air can move freely between the inside and outside of the outside case, and the sound produced by the sound source can travel directly outside the outside case. This enables producing the original sound of the sound source using air vibrations that is produced when an outside case is not present.

This outside case is fastened to the case member, bezel, or other part of the case (also referred to herein as the inside case) that is rendered airtight.

The shape, number, and location of the openings formed in the outside case can be determined as desired, and the openings can be, for example, a through-hole formed at a position facing the side of the inside case. Because the water resistance of the movement is assured by the inside case in the invention, large openings can be formed in the outside case. These openings can also be decoratively shaped, and can be used to improve the external appearance.

The outside case itself can also be freely designed. For example, the outside case can be shaped like a bird nest using metal wire. In this case the spaces between the metal wires become the openings and a large opening is rendered by the entire outside case. The openings can also be shaped using screen mesh or a porous member with many holes.

The space between the outside case and the inside case in the invention is preferably large, but a particularly large distance is not needed between the sound source and the inside of the outside case because air can move freely through the openings in the outside case. In other words, the size of the timepiece is not necessarily increased by providing the outside case.

The timepiece according to another aspect of the invention preferably also has an outside case disposed outside the case covering at least a part of the sound source; and an echo chamber that is disposed between the case and the outside case and causes sound produced by the sound source to echo.

The space between the case (inside case) and the outside case can be used as the echo chamber, or a separate echo chamber can be rendered enclosing the sound source. The sound produced by the sound source can be made to echo by providing an echo chamber. By causing the sound to echo, the echo produces a resonating effect that increases the sound pressure produced by the sound source. Providing an echo chamber also inhibits dispersion of the produced sound outside the timepiece, and can make the reverberation last longer.

Further preferably, the timepiece also has a gap connecting the outside of the outside case with the inside of the echo chamber.

This aspect of the invention renders a space to the echo chamber. If the echo chamber is completely sealed, the produced sound will be blocked by the walls of the echo chamber, the sound will not leak outside the timepiece, and the sound vibrations will be damped. The sound will therefore be heard outside the timepiece as a muffled sound with low sound pressure, and the sound pressure attenuation rate will increase.

The size of the gap is set to an open area that will not interfere with the resonance effect of the echo chamber. If the area of the gap is less than a predetermined size, for example, sufficient sound will not be output from the echo chamber to the outside, sound output will be substantially the same as when the echo chamber is sealed, and the sound pressure will therefore be low and the sound pressure attenuation rate high. On the other hand, if the size of the gap is greater than a predetermined area, sound will not resonate in the echo chamber and the sound pressure will not be amplified by resonation. The sound pressure attenuation rate will also increase because sound will disperse easily through the gap.

By rendering a gap of a specifically sized area, however, the invention enables outputting a good sound through the gap to the outside after the initial sound pressure and the sound pressure at the start of reverberation are amplified by the resonance effect of echoing inside the echo chamber. In addition, because the echo chamber lowers the attenuation rate of the reverberations, the sound pressure can be sustained for a long time after the sound starts reverberating.

Further preferably, the timepiece also has a gap opening and closing means for opening and closing the gap.

This aspect of the invention renders a gap opening and closing means for opening and closing the gap disposed to the echo chamber. As a result, when it is necessary to seal the inside of the timepiece, such as when it is raining and preventing water from entering the timepiece is desirable, or when reducing the volume is desirable, water resistance and dust resistance can be improved by operating the gap opening and closing means to close the space. On the other hand, when it is desirable to hear the sound clearly, the gap opening and closing means can be operated to open the space to the echo chamber so that good sound output can be achieved as described above.

Further preferably, the echo chamber is formed by the case and the outside case, and has a communication hole connected to the outside is formed in the outside case; a gap forming member that is substantially cylindrical is fit to the communication hole, and has a hole formed in the outside cylindrical wall connecting the outside of the outside case with the inside of the cylinder; the gap is formed by the hole in the gap forming member and the cylindrical wall part of the gap forming member. The gap opening and closing means has a closing surface that can close the hole in the gap forming member, can advance and retract freely in the axial direction of the gap forming member, and can open and close the gap by moving the closing surface to a closed position where the hole is closed or an open position where the hole is open.

This aspect of the invention fits a cylindrical gap forming member to a communication hole connecting the echo chamber to the outside of the outside case, and a hole communicating the inside of the cylinder part to the outside of the outside case is formed in the circumference part of the gap forming member. The communication channel from this hole through the inside circumference part of the gap forming member into the echo chamber forms the gap. The gap opening and closing means can move in and out along the axial direction of the gap forming member to open or close the hole by means of the closing surface.

Between the communication hole and the gap forming member, and between the gap forming member and opening and closing member, are kept sealed, and the gap can therefore be easily opened and closed by the simple action of moving the gap opening and closing means in or out. Furthermore, because a mechanism for easily opening and closing the gap can be rendered using two parts, the gap opening and closing means and the gap forming member, a structure for switching the gap open or closed as described above with a simple construction can be achieved without complicating the structure.

In a timepiece according to another aspect of the invention the case has a cylindrical case member disposed around the movement, and a crystal and cover unit respectively disposed on the opposite axial ends of the case member; and the sound source is bowl shaped with a bottom part opposing the cover unit of the case and a side wall part opposing the case member of the case.

This aspect of the invention enables disposing the case in the space inside the bowl-shaped sound source, and therefore does not interfere with reducing timepiece thickness. In addition, because this configuration is space efficient, a large bowl-shaped sound source can be used, and the sound can be made to reverberate longer.

The case member of the case and the cover unit can also be rendered as a single part. The case member of the case and the cover unit can also be rendered as a single part in the aspects of the invention described below.

In a timepiece according to another aspect of the invention the case has a cylindrical case member disposed around the movement, and a crystal and cover unit respectively disposed on the opposite axial ends of the case member; and the sound source is a bar shaped along the circumference of the case member.

In this aspect of the invention the outside case can be simply disposed at a position opposite the side of the case member and does not need to be provided on the cover unit side. The double case construction rendered by the case member of the inside case and the case member of the outside case in this aspect of the invention provides a water resistant construction while also achieving the desired sound output of the sound source.

A transparent construction rendering the movement mechanism visible from the outside can also be achieved by using glass for the cover unit of the inside case.

The timepiece according to another aspect of the invention has a plurality of sound sources, and a plurality of striking force transmission members corresponding to the plurality of sound sources.

By using a plurality of sound sources, this aspect of the invention can increase the sound pressure and produce a better sound by striking the sound sources simultaneously. By using sound sources of different lengths, a plurality of different tones can also be produced, and by changing the timing at which the sound sources are struck, richly varied sounds, including musical chords, can be produced.

The plural sound sources can be struck using a single striking force transmission member, but a separate striking force transmission member is preferably disposed for each of the plural sound sources. More specifically, if plural sound sources are struck using a single striking force transmission member, the striking force will be dispersed and outputting a good sound may not be possible. However, by using a plurality of striking force transmission members, this aspect of the invention can transmit sufficient striking force to each sound source, and each sound source can therefore produce a good sound.

Further preferably, at least a part of the case is a magnetic body.

By making at least a part of the inside case, such as the case member of the inside case, using a magnetic material, this aspect of the invention eliminates the need to provide a separate antimagnetic plate. This enables reducing the parts count, lowering the cost, and reducing the size commensurately to the size of the eliminated antimagnetic plate.

By rendering the case member of the inside case using a magnetic material, this aspect of the invention also enables using a rare metal for the outside case. An antimagnetic effect and a small size can therefore both be achieved while achieving a beautiful external appearance.

In a timepiece according to another aspect of the invention the sound source is attached to the case.

By fastening the sound source to the inside case in which the movement with the hammer is housed and the striking force transmission member is disposed, the outside case can be installed after adjusting the distance between the striking force transmission member and the sound source and the relationship between the position of the hammer and the striking force. This aspect of the invention is therefore advantageous compared with when the sound source is fastened to the outside case and readjustment is required after assembly.

In the timepiece according to another aspect of the invention the case has a cylindrical case member disposed around the movement, and a crystal and cover unit respectively disposed on the opposite axial ends of the case member; the sound source is bowl shaped with a bottom part opposing the cover unit of the case and a side wall part opposing the case member of the case; a part of the bottom part of the sound source is attached by a fastening member to the cover unit of the case; and the fastening member has a fastening member body that is fixed to the bottom part and the cover unit, and an elastic member that has a portion disposed with a gap to the bottom part on the opposite side of the bottom part as the cover unit side, and a support portion that supports the bottom part.

This aspect of the invention disposes the fastening member on the bottom part, which has less effect on sound reverberation than the side wall part. The fastening member therefore does not impede vibration of the side wall part, and enables the sound to reverberate.

In addition, because the bottom part of the bowl-shaped sound source is supported by an elastic member, or is supported with a gap at one place, vibration of the bottom part is impeded less. Vibration of the entire bowl-shaped sound source is thus attenuated less, and the sound reverberates longer.

Another aspect of the invention is a portable device that has a movement having a hammer and a hammer drive device that drives the hammer; a case that houses the movement; a sound source that produces sound by vibrating when struck by the hammer; and a striking force transmission member that is disposed to the case and can move bidirectionally between the hammer and the sound source to transmit the striking force of the hammer to the sound source while keeping the case airtight.

This aspect of the invention achieves the same effect as the timepiece of the invention described above.

Examples of such portable devices include toys; music boxes; simple timers; electronically controlled mechanical timepieces; timepieces having at least one of a group of devices including an alarm, a repeater, a striking mechanism, and an automaton (automata); mechanical chimes; mechanical cameras (a timer photography mechanism); an automaton or automata; radios; and flashlights.

As described above, the invention enables easily setting the spring force of each spring and producing a good sound.

Other objects and attainments together with a fuller understanding of the invention will become apparent and appreciated by referring to the following description and claims taken in conjunction with the accompanying drawings.

DESCRIPTION OF PREFERRED EMBODIMENTS

Figure 1:
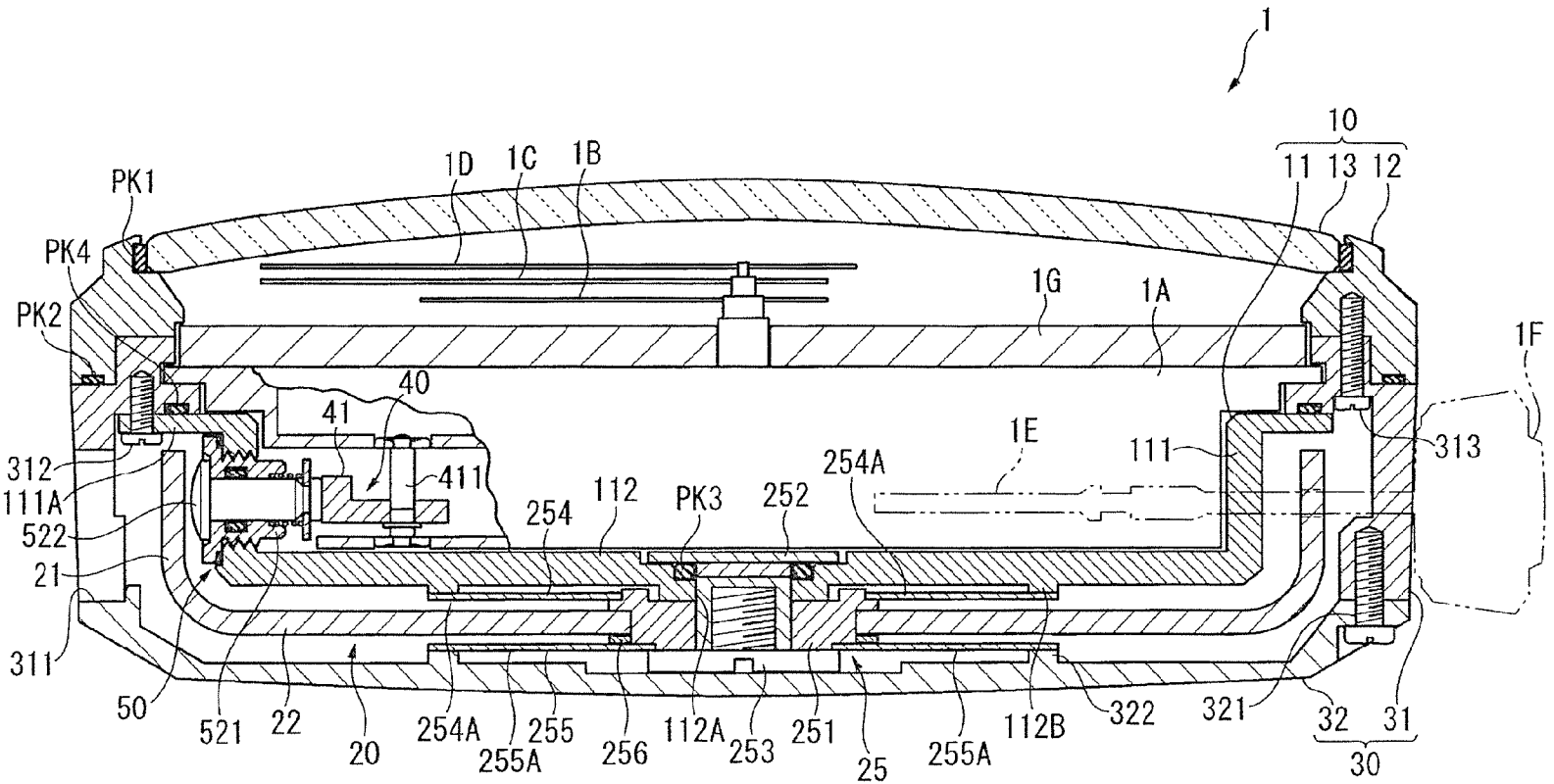
FIG. 1 is a vertical section view of a timepiece according to a first embodiment of the invention.

Preferred embodiments of the present invention are described below with reference to the accompanying figures. Note that parts that are functionally the same as parts that have already been described are identified by the same reference numerals, and further description thereof is omitted.

Embodiment 1

A first embodiment of the invention is described below with reference to FIG. 1 to FIG. 5.

1. General Configuration

FIG. 1 is a vertical section view of a timepiece 1 according to a first embodiment of the invention. The timepiece 1 has a movement 1A as the main timekeeping mechanism, an inside case 10 that houses the movement 1A, a bell 20 that is a bowl-shaped sound source disposed outside the inside case 10, and an outside case 30 that encloses the bell 20. The timepiece 1 according to this embodiment of the invention is an electronically controlled mechanical timepiece that drives the hands using the drive power from a spring, and supplies power produced by the drive power of a spring to an electronic circuit to govern the speed.

While not shown in detail in the figures, the movement 1A has a main spring, a drive wheel train that drives the hour hand 1B, minute hand 1C, and second hand 1D using drive power from the main spring, a generator that converts drive power from the main spring to electrical energy, and a circuit board to which power is supplied from the generator. A crystal oscillator circuit and a frequency divider circuit are also disposed to the circuit board. This movement 1A is inserted to the inside case 10 from the crystal 13 side of the timepiece 1 and fastened inside the inside case 10.

The movement 1A also includes a sonnerie mechanism 4 (sonnerie or striking mechanism) (see FIG. 2) that produces sound by striking a sound source.

A stem 1E (indicated by the double-dot dash line) is disposed at the 3:00 o'clock side of the timepiece 1 as shown in FIG. 1. A crown 1F is attached to the stem 1E. A push button not shown is also disposed to the movement 1A for turning the sonnerie mechanism 4 on and off.

2. Sonnerie Mechanism

Figure 2:
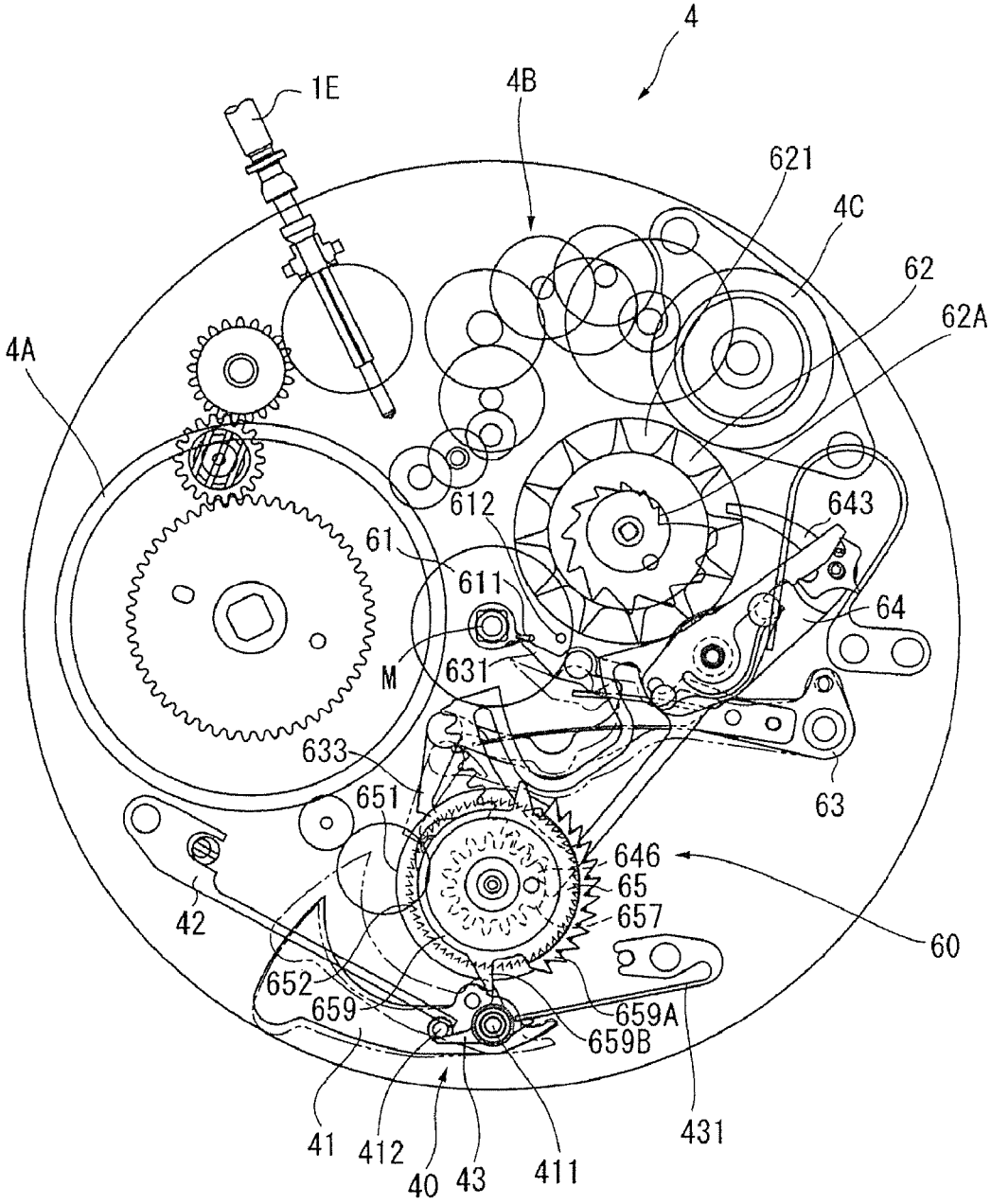
FIG. 2 is a plan view of the sonnerie mechanism used in the timepiece.

FIG. 2 is a plan view of the sonnerie mechanism 4 included in the movement 1A.

The sonnerie mechanism 4 includes a barrel wheel 4A with an internal spring that drives the sonnerie mechanism 4, a drive power wheel train 4B that is a speed-increasing wheel train conveying torque from the barrel wheel 4A to a governor 4C, a hammer 40, a hammer pin unit 50 as a striking force transmission member that transfers the striking force of the hammer 40 to the bell 20 (see FIG. 1), a striking control means 60 (FIG. 2) as a hammer driving device that drives the hammer 40 to strike a number of times corresponding to the time, and the bell 20 (FIG. 1).

Except for using a bell instead of a gong as the sound source, the basic configuration of the sonnerie mechanism 4 is known from the literature, and detailed description of the sonnerie mechanism is therefore omitted or simplified below.

The construction of a sonnerie mechanism according to the related art is described, for example, in "A Guide to Complicated Watches" by Francois Lecoultre, pages 159 to 179.

The governor 4C is shown in figures and described in detail in Japanese Patent Application 2006-189812 previously filed by us, and further description thereof is thus omitted.

The barrel wheel 4A is provided specifically for the sonnerie mechanism and is separate from the barrel wheel of the main spring that drives the hands 1B, 1C, 1D of the timepiece displaying the time, renders a mechanical energy storage means as the drive power source for the sonnerie mechanism. The spring inside the barrel wheel 4A can be wound by turning the crown 1F with the stem 1E at step 0.

Striking Control Means

Figure 3:
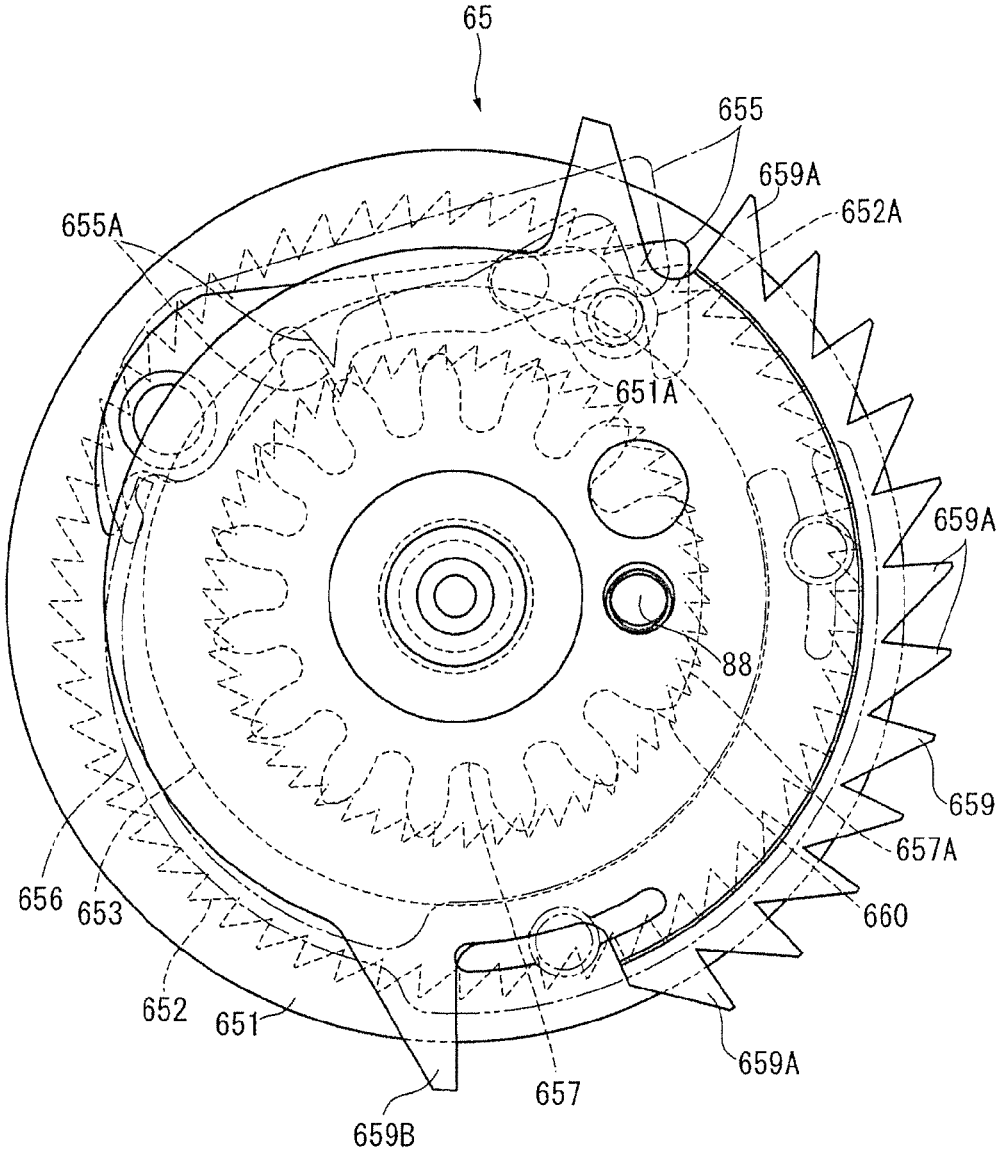
FIG. 3 is a plan view of the center wheel included in the sonnerie mechanism.

The striking control means 60 includes a screw nut 61 disposed in unison with the cannon pinion M to which the minute hand is disposed, a snail wheel 62, a release lever 63, an hour repeating rack 64, and a center wheel 65 (FIG. 3).

The striking control means 60 is also shown in figures and described in detail in Japanese Patent Application 2006-189812 previously filed by us, and further description thereof is thus omitted.

During normal use when the sonnerie mechanism 4 is not operating, torque from the barrel wheel 4A is transferred through the drive power wheel train 4B to the center wheel 65, and the center wheel 65 receives this torque in the direction causing the center wheel 65 to turn counterclockwise as viewed in FIG. 1. The center wheel 65 does not turn and remains stopped, however, because the toothless portion 657A of the gathering rack pinion 657 part of the center wheel 65 (FIG. 3) is against the stop 646 of the hour repeating rack 64.

Note that FIG. 2 does not show the click that stops the spring inside the barrel wheel 4A.

The hour repeating rack 64 converts the current time displayed by the snail wheel 62 to strokes equal to the number of times the bell 20 is struck, and prevents the barrel wheel 4A from unwinding when the sonnerie mechanism 4 is stopped.

Hammer

The hammer 40 includes a hammer arm 41 disposed to pivot freely on a pivot pin 411, a hammer spring 42 that urges the hammer arm 41 toward the hammer pin unit 50, and a hammer trip 341 that is disposed to pivot freely on the pivot pin 411 of the hammer arm 41.

The hammer arm 41 is made of a copper alloy such as brass, and has a pin 412 protruding in the axial direction of the pivot pin 411.

The hammer spring 42 urges the pin 412 of the hammer arm 41 toward the hammer pin unit 50, and the hammer arm 41 is thus urged counterclockwise as seen in FIG. 2.

A hammer trip 43 has a claw that contacts the pin 412, a claw that engages the triangular teeth 659A and pawl 659B of the hour ratchet 659 affixed to the gathering rack pinion 657, and a claw that engages the hammer trip spring 431. The hammer trip 43 is urged clockwise as seen in FIG. 2 by the hammer trip spring 431.

When the sonnerie mechanism 4 is not operating, the hammer trip 43 is held in the position shown in FIG. 2 by the pawl 659B of the hour ratchet 659. The position of the hammer arm 41 when the pin 412 is held between the hammer spring 42 and hammer trip spring 431 is thus determined, and the hammer arm 41 is held at rest in a position separated from the hammer pin unit 50. This prevents the bell 20 from sounding when the sonnerie mechanism 4 is not operating even when the timepiece 1 is worn on the wrist and the user claps his hands or swings his arm vigorously, for example.

The configuration of the bell 20 used in the sonnerie mechanism 4 and the configuration of the hammer pin unit 50 are further described below.

3. Configuration of the Bowl-Shaped Sound Source and Case

The configuration of the inside case 10, the bell 20, and the outside case 30 is described next referring again to FIG. 1.

3-1 Inside Case Configuration

The inside case 10 includes an inside case member 11 that holds the movement 1A, a bezel 12 disposed to the inside case member 11, and the crystal 13 that is held in the bezel 12 by intervening plastic packing PK1.

Another packing PK2 member (made of a fluoroelastomer or other rubber material) intervenes between the bezel 12 and inside case member 11.

The inside case member 11 is stainless steel, and includes a cylindrical body 111 and a cover 112 disposed on the opposite side as the crystal 13. The body 111 and cover 112 are formed in unison.

A flange 111A to which the movement 1A is affixed is formed at the edge part of the body 111 facing the crystal 13. This flange 111A extends from the inside to the outside of the bell 20.

The hammer pin unit 50 is disposed to the body 111 at a position opposite the hammer arm 41 as a striking force transfer member that transfers the striking force of the hammer arm 41 to the bell 20. A threaded hole 111B (FIG. 4) to which the hammer pin unit 50 is disposed is also formed in the body 111.

A through-hole 112A to which the bell 20 is secured, and a pedestal 112B rising from the bell 20 side surface of the cover 112, are disposed to the cover 112 of the body 111. The through-hole 112A is formed in the center of the cover 112. The pedestal 112B is formed in a circle centered on the through-hole 112A.

3-2 Configuration of the Hammer Pin Unit

Figure 4:
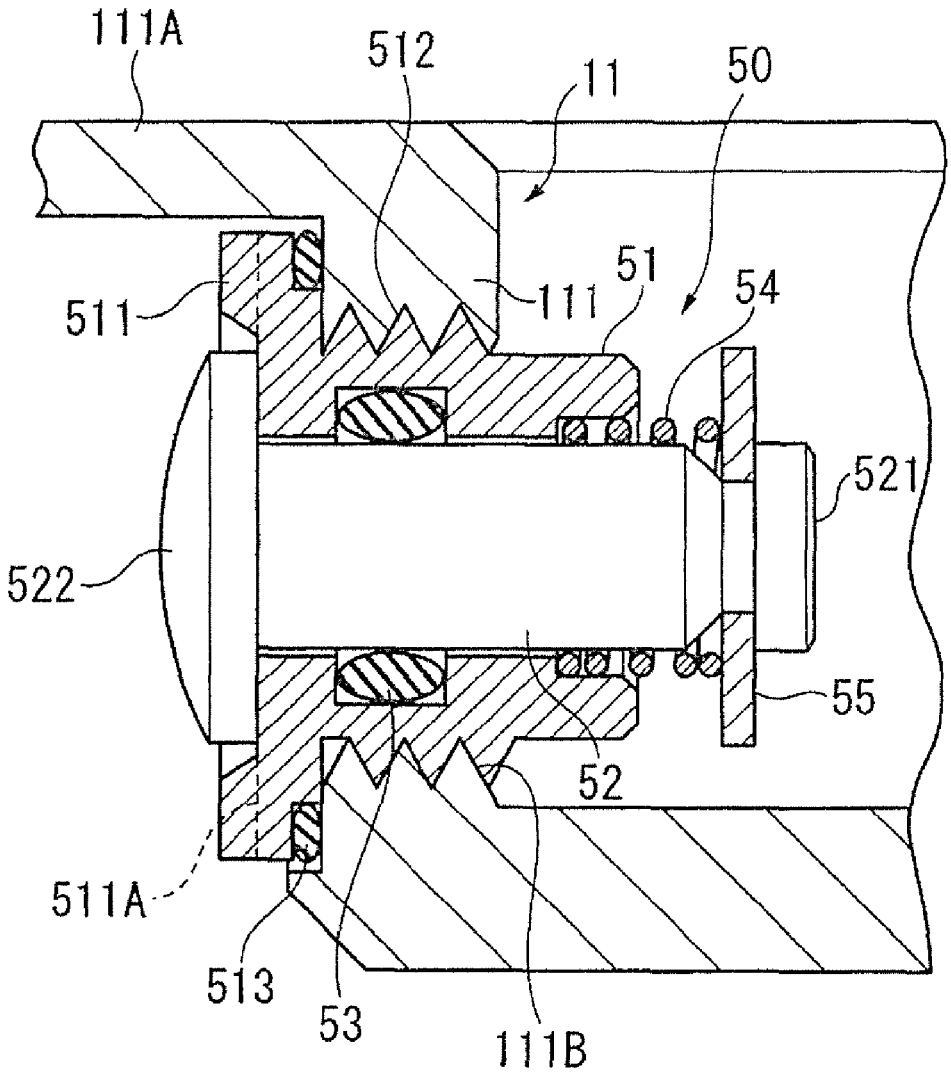
FIG. 4 shows the hammer pin unit in this embodiment of the invention.

FIG. 4 shows the hammer pin unit 50 disposed to the body 111 of the inside case member 11 at a position opposite the distal end of the hammer arm 41 (FIG. 1).

The hammer pin unit 50 has a sleeve 51, a hammer pin 52, an O-ring 53, a compression spring 54, and a C-ring 55. The sleeve 51 is a holding unit whereby the hammer pin unit 50 is attached to the body 111. The hammer pin 52 passes through the inside of the sleeve 51. The O-ring 53, or packing, is rubber used as a seal between the outside surface of the hammer pin 52 and the inside wall of the sleeve 51. The compression spring 54 is disposed to the sleeve 51 inside the body 111. The C-ring 55 holds the compression spring 54 between the C-ring 55 and the sleeve 51.

The sleeve 51 is a cylinder with a flange 511 and a male thread 512 formed around the outside of the sleeve 51. The hammer pin unit 50 is secured to the body 111 by screwing the male thread 512 into the threaded hole 111B in the inside case member 11. A slot 511A for inserting the tip of a screwdriver is also formed in the flange 511.

An O-ring 513 is also disposed between the body 111 and the flange 511 of the sleeve 51.

The hammer pin 52 is brass or other copper alloy, and is disposed so that when the end part 521 of the hammer pin 52 inside the body 111 is struck by the hammer 40 (FIG. 1), the end part 522 outside the body 111 strikes the inside surface near the open edge of the bell 20.

The hammer pin 52 is urged to the inside of the body 111 by the compression spring 54 disposed around the outside of the hammer pin 52.

The O-ring 53 provides a water-resistant seal in the hammer pin unit 50 between the hammer pin 52 and the sleeve 51, and the other O-ring 513 provides a water-resistant seal between the sleeve 51 and the inside case member 11.

3-3 Configuration of the Bell

Figure 5:
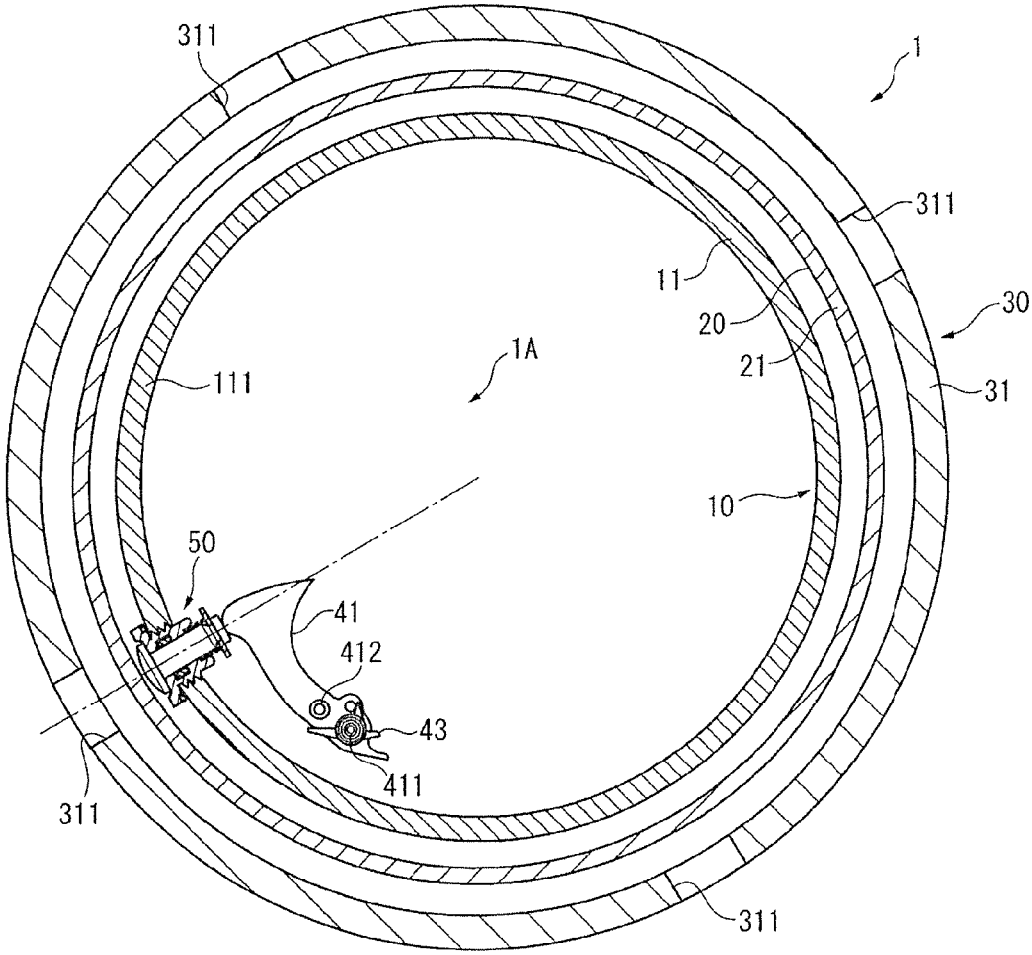
FIG. 5 is a horizontal section view of the timepiece.

FIG. 5 is a lateral section view of the timepiece 1. Only the hammer arm 41 and hammer trip 43 parts of the movement 1A are shown in FIG. 5, and other parts of the movement 1A are not shown.

The bell 20 is a bell-shaped sound source, and is disposed outside of the inside case member 11 enclosing the body 111 and cover 112 of the inside case member 11. The bell 20 has a side wall part 21 opposing the body 111 of the inside case member 11, and a bottom part 22 (FIG. 1) opposite the cover 112 of the inside case member 11. A fastening member 25 (FIG. 1) secures the bell 20 to the inside case member 11 at the center of the bottom part 22 of the bell 20.

In this embodiment of the invention the bell 20 is made of brass or other copper alloy, and a corrosion resistant coating is applied to the surface of the bell 20. The bell 20 can be made permanently resistant to deformation caused by striking by making the bell 20, the hammer pin 52, and the hammer arm 41 from the same brass or other copper alloy.

As shown in FIG. 1, the fastening member 25 includes a fixed sleeve 251 (main fixing member) made of metal that is pressed into a through-hole formed in the bottom part 22 of the bell 20; a threaded pin 252 that is inserted to the through-hole 112A in the inside case member 11 and the fixed sleeve 251, a set screw 253 that is threaded to the female thread of the threaded pin 252; a flat pressure spring 254 (elastic member) inserted between the bell 20 and the cover 112 of the inside case member 11; a flat pressure spring 255 inserted between the bell 20 and the outside case 30; and a plastic O-ring 256 that supports the bell 20. The hole diameter in the bottom part 22 of the bell 20 is greater than the shaft diameter of the fixed sleeve 251.

The parts 251 to 255 of the fastening member 25 can be steel with a corrosion resistant coating, or stainless steel.

Rubber packing PK3 intercedes between the threaded pin 252 and the cover 112 of the inside case member 11.

The pressure spring 254 has an annular portion that is disposed around the outside circumference of the fixed sleeve 251, and a plurality of support parts 254A radiating out from this annular part and touching the pedestal 112B of the cover 112.

The other pressure spring 255 has an annular portion that is disposed around the outside circumference of the fixed sleeve 251 with the O-ring 256 between the pressure spring 255 and the bell 20, and a plurality of support parts 255A radiating out from this annular part.

In this embodiment of the invention there are four support parts 254A and four support parts 255A. The number of support parts 254A and 255A is not limited to this number, but there are preferably three or more of each into order to control the plane position of the bell 20.

By tightening the set screw 253 in the threaded pin 252 that is inserted to the fixed sleeve 251, the pressure springs 254 and 255 are slightly deformed so that the bell 20 is held between the pressure springs 254 and 255. The fastening member 25 thus holds the bell 20 secured in a suspended state not touching any parts (such as the inside case member 11 and outside case 30) other than the fastening member 25.

When the bell 20 is thus suspended of its own weight, there is a gap between the pressure spring 254 and the cover 112 of the inside case member 11, between the pressure spring 254 and the bell 20, between the pressure spring 255 and the outside case 30, and between the pressure spring 255 and the bell 20.

The spring constants of the pressure springs 254 and 255 are set to a strength (rigidity) so that during normal use the bell 20 cannot move to a position touching the inside case member 11 or the outside case 30.

3-4 Configuration of the Outside Case

As shown in FIG. 1 and FIG. 5, the outside case 30 includes a substantially cylindrical external case member 31 opposing the side wall part 21 of the bell 20, and a back cover 32 opposing the bottom part 22 of the bell 20. The external case member 31 and bell 20 do not touch, and the back cover 32 and bell 20 are separated except where the fastening member 25 is located.

The external case member 31 is made from a rare metal such as gold or platinum. Openings 311 passing through the external case member 31 are formed at a plurality of places around the circumference of the external case member 31. There are four openings 311 formed at equal intervals in the circumferential direction as shown in FIG. 5 in this embodiment of the invention with the center of one opening 311 aligned with the axis of the hammer pin 52, but otherwise the locations, number, and shape of the openings formed in the outside case 30 are not so limited.

The flange 111A of the inside case member 11 is fastened by screws 312 (FIG. 1) to the top edge part of the external case member 31 of the outside case 30. The screws 312 are disposed at a plurality of locations around the circumference of the external case member 31, and rubber packing PK4 is disposed to the flange 111A on the movement 1A side of the screws 312.

The external case member 31 is also fastened by screws 313 to the bezel 12 at a plurality of locations different from where the external case member 31 is fastened to the flange 111A of the inside case member 11.

The back cover 32 is fastened to the external case member 31 by screws 321 at a plurality of locations around the circumference. An annular pedestal 322 that touches the distal end part of the pressure spring 255 of the fastening member 25 is formed on the back cover 32 on the surface facing the bell 20.

4. Timepiece Assembly

The timepiece 1 configured as described above can be assembled as described below for example.

The hammer pin unit 50, the sleeve through which the stem 1E passes, sleeves through which the shafts of push buttons not shown pass, and the bell 20 are assembled in the inside case member 11. The inside case member 11 is then inserted to the outside case 30 from the back cover 32 side, and fastened by screws 312 with the intervening packing PK4. This renders the outside case 30 and inside case member 11 as a single unit.

The movement 1A is then inserted to the inside case member 11 from the crystal 13 side using a bayonet mount, and the movement 1A is then fastened to the flange 111A of the inside case member 11 by means of screws disposed at a plurality of locations around the circumference to prevent the movement 1A from turning.

With the crystal 13 pressed into the bezel 12, the bezel 12 is placed on the body 111 of the inside case member 11 with the packing PK2 therebetween, and the bezel 12 is then fastened from the back cover 32 side to the external case member 31 by screws 313.

With the crown 1F attached to the stem 1E, the stem 1E is inserted through the hole in the external case member 31 of the outside case 30 and the sleeve in the inside case member 11 to the movement 1A.

The back cover 32 is then fastened by screws 321 to the external case member 31 to complete assembly of the inside case member 11, the bezel 12, the crystal 13, the external case member 31, and the back cover 32 in unison.

The packing members PK1 to PK4 seal and create an airtight chamber inside the inside case 10 rendered by the inside case member 11, the bezel 12, and the crystal 13, and the movement 1A is thus stored airtight inside the inside case 10.

However, the openings 311 formed in the outside case 30 enable air to move freely between the inside of the outside case 30 and the outside.

While the stem BE disposed to the movement 1A and the push button stems not shown also pass through the external case member 31, the bell 20, and the inside case member 11, the packing disposed between the crown stem 1E and the push button stems and the sleeves disposed in the inside case member 11 render the inside of the inside case 10 airtight.

The O-ring 53 and O-ring 513 packing in the hammer pin unit 50 (FIG. 4) described above also help keep the inside of the inside case 10 airtight.

5. Operation of the Sonnerie

The operation of the sonnerie mechanism 4 in this embodiment of the invention is described next with reference to FIG. 2 and FIG. 3.

Rotation of the cannon pinion M causes the screw nut 61 (FIG. 2) to rotate once per hour. Before the stud 611 protruding from the screw nut 61 contacts the beak 631 disposed pivotably on the main part of the release lever 63, a pin 612 protruding from the screw nut 61 engages the star wheel 621 of the snail wheel 62, and causes the snail wheel 62 to rotate only the distance of one hour (1/12 revolution=30 degrees).

When the cannon pinion M turns, the stud 611 on the screw nut 61 contacts the beak 631 of the release lever 63, and the release lever 63 turns counterclockwise as seen in FIG. 2, the release lever click 633 causes the release ratchet 652 of the center wheel 65 to turn. The release pin 652A (FIG. 3) pressed into the release ratchet 652 therefore moves left and up as seen in FIG. 3 in the long hole 651A in the driving roller 651, and causes the center wheel release click 655 to rotate counterclockwise as seen in FIG. 3 against the center wheel release click spring 656.

As a result, the pawl 655A of the center wheel release click 655 disengages the driving ratchet 660. The hour repeating rack 64 (FIG. 2) thus causes the gathering rack pinion 657 to rotate instantly clockwise in FIG. 2 until the distal end of the hour repeating rack click 643 contacts the side 62A of the snail wheel 62. The hour ratchet 659 fixed to the gathering rack pinion 657 thus rotates clockwise while the outside triangular teeth 659A trip the hammer trip 43.

When the center wheel release click 655 (FIG. 3) disengages the driving ratchet 660, the driving roller 651 is released from the gathering rack pinion 657, and the driving roller 651 begins turning counterclockwise as seen in FIG. 2 as a result of the torque transferred from the barrel wheel 4A through the drive power wheel train 4B and the center wheel pinion 653.

The driving roller 651 rotates at the same speed as the barrel wheel 4A, the speed of which is governed by the governor 4C, and the driving roller 651 turns at an extremely slow substantially constant speed.

When the driving roller 651 rendered in unison with the center wheel pinion 653 turns, the release ratchet 652 is held stationary by the pressure from the release lever click 633, and the force of the center wheel release click spring 656 causes the center wheel release click 655 that is pressed against the release pin 652*a* to engage the driving ratchet 660 again. Movement of the gathering rack pinion 657 is thus constrained by the center wheel release click 655, and rotates counterclockwise in unison with the driving roller 651.

The hour ratchet 659 affixed to the gathering rack pinion 657 turns counterclockwise at this time, and the hammer trip 43 turns clockwise as a result of the triangular teeth 659A of the hour ratchet 659 contacting the hammer trip 43. The claw of the hammer trip 43 pushes the pin 412 on the hammer arm 41, and the hammer arm 41 is lifted away from the bell 20 against the urging force of the hammer spring 342. When the hour ratchet 659 rotates further counterclockwise and the triangular teeth 659A pass the claw of the hammer trip 43, the hammer spring 42 causes the hammer arm 41 to strike the end part 521 of the hammer pin 52. This causes the hammer pin 52 to slide inside the sleeve 51 so that the end part 522 strikes the side wall part 21 of the bell 20.

Immediately after striking the bell 20, the hammer pin 52 is pulled back to its original position (the position indicated by the solid line denoting the hammer arm 41 in FIG. 2) by repulsion from the bell 20 and the force of the compression spring 54. This bidirectional displacement of the hammer pin 52 transfers the striking force of the hammer arm 41 to the bell 20, causing the bell 20 to reverberate and ring as a result of the air waves produced by vibration of the bell 20. These air waves travel through the openings 311 in the bell 20. A bell 20 that sounds using air vibrations rings with the reverberations caused by the gradually attenuating vibration of the bell 20, producing the rich sound of a bell 20 that travels through the openings 311 directly outside the case and can be heard with sufficient volume. Furthermore, by providing a plurality of openings 311, the sound of the bell 20 can be held in all directions around the timepiece.

Because the support parts 254A and 255A of the fastening member 25 are suitably deflected when the bell 20 is struck by the hammer pin 52, and the bell 20 vibrates to the side away from the hammer pin 52, the bell 20 does not contact the hammer pin 52 again before the hammer pin 52 returns to the non-striking position. This assures a longer reverberation.

Because this operation striking the bell 20 occurs each time the driving roller 651 turns and the triangular teeth 659A on the hour ratchet 659 trip the hammer trip 43, the bell 20 is rung a number of times equal to the hour according to the rotational position of the snail wheel 62. The user of the timepiece 1 can therefore know the hour by counting the number of times the bell 20 rings.

Furthermore, because the governor 4C limits the speed that the barrel wheel 4A turns and there is thus a relatively long interval between each strike of the bell 20, the reverberations of the bell 20 can be made to last longer.

When the bell 20 has rung a number of times equal to the hour according to the rotational position of the snail wheel 62, the toothless portion 657A of the gathering rack pinion 657 meets the stop 646 of the hour repeating rack 64, and the center wheel 65 stops turning.

When rotation of the cannon pinion M causes the beak 631 to separate from the stud 611 of the screw nut 61, the spring causes the release lever 63 to turn clockwise and return to the original position.

This completes the operating sequence of the sonnerie mechanism 4.

The effect of this embodiment of the invention is described next.

(1) In a timepiece 1 with a sonnerie mechanism 4 the bell 20 is disposed outside an inside case 10, and the striking force of the hammer 40 is transferred through a hammer pin unit 50 to the bell 20. A hammer spring 42 that urges the hammer 40 toward the hammer pin 52 is disposed to the hammer 40 in this configuration, and a compression spring 54 that urges the hammer pin 52 to the inside of the body 111 is disposed to the hammer pin 52. During timepiece manufacture it is therefore only necessary to set the urging force of the hammer spring 42 and the compression spring 54 that are disposed to the hammer 40 and hammer pin 52, which are separate members. The invention therefore enables setting the force of the springs more easily and improves efficiency in timepiece manufacture compared with a configuration that disposes springs working in opposite directions to the hammer 40.

Furthermore, because the hammer pin 52 is returned to its original position by repulsion from the bell 20 and the force of the compression spring 54 immediately after striking the bell 20, the hammer pin 52 does not continue to push against the bell 20 due to the urging force of the hammer 40 and interfere with vibration of the bell 20. The bell 20 can thus vibrate freely with a large initial sound pressure, long-lasting reverberation, and pleasing tone.

(2) Because the inside case 10 is airtight, the bell 20 can vibrate freely in a space allowing free movement of air in and out, and the bell 20 can reverberate with the pleasing sound of a real bell with sufficient volume by means of air waves. More specifically, because the bell 20 is outside the airtight chamber and there are plural openings 311 in the external case member 31 surrounding the outside of the bell 20, the sound of the bell 20 can be heard directly outside of the case.

Furthermore, because the movement 1A is located in the airtight space inside the inside case 10, water and vapor are prevented from entering when the timepiece is worn, and the movement 1A is protected from corrosion and problems caused by immersion in water. More specifically, the invention achieves a water resistant movement 1A while also producing the pleasing sound of a real bell 20.

(3) Because the bell 20 is covered by the external case member 31 in which the openings 311 are formed, shirt cuffs, for example, touching the outside of the timepiece 1 will not touch the bell 20 and therefore cannot attenuate reverberation of the bell 20. Furthermore, because the openings 311 are formed at positions opposite the side wall part 21 of the bell 20, which contribute more to the reverberation of sound than the bottom part 22 of the bell 20, the sound of the bell 20 travels outside the outside case 30 with sufficient volume and pleasing tone.

(4) A thin timepiece 1 can also be achieved as a result of disposing the inside case 10 in the space inside the bell 20. This space-efficient construction enables using a larger bell 20, which can increase the length of the reverberations accordingly.

(5) Because a hammer pin unit 50 including the hammer pin 52 is used as the means of transferring the striking force of the hammer 40 to the bell 20, the same type of water resistant structure used for the crown stem BE and push button stems can be used for the hammer pin unit 50. Furthermore, because existing timepiece technology can be used, a new part design is not needed and the parts cost is minimal.

(6) Because the bell 20 is fastened to the inside case member 11 to which the hammer pin unit 50 and the movement 1A with the hammer 40 are disposed, the outside case 30 can be attached after adjusting the distance between the hammer pin 52 and bell 20 and the relationship between the position and the striking force of the hammer arm 41. Readjustment related to the operation of the sonnerie mechanism 4 is therefore not necessary after assembly.

(7) Disposing the fastening member 25 to the bottom part 22 of the bell 20 inhibits attenuation of bell 20 reverberation compared with when the fastening member is disposed to the side wall part 21 of the bell 20, and thus enables the bell 20 to ring with a lasting reverberation. Furthermore, because the hole diameter in the bottom part 22 of the bell 20 is larger than the shaft diameter of the fixed sleeve 251, deformation of the O-ring 256 enables the bell 20 to vibrate freely. In addition, because the pressure springs 254 and 255 support the bell 20 without interfering with vibration of the bell 20, attenuation of bell 20 vibration is inhibited and the sound of the bell 20 reverberates longer.

Furthermore, because the pressure springs 254 and 255 give when the timepiece is dropped or hit, the center of the bottom part 22 of the bell 20, the fixed sleeve 251, and other parts are protected from plastic deformation.

Embodiment 2

A second embodiment of the invention is described next with reference to FIG. 6 to FIG. 8.

This embodiment of the invention uses a gong instead of a bell as the sound source, and the timepiece according to this embodiment of the invention has a repeater mechanism.

The timepiece according to this embodiment of the invention has a see-through back with a protective crystal disposed in the back cover.

The striking force transmission member in this embodiment is also different from the first embodiment.

Other than these main differences, the timepiece according to this embodiment of the invention is substantially the same as the timepiece 1 described in the first embodiment above.

Figure 6:
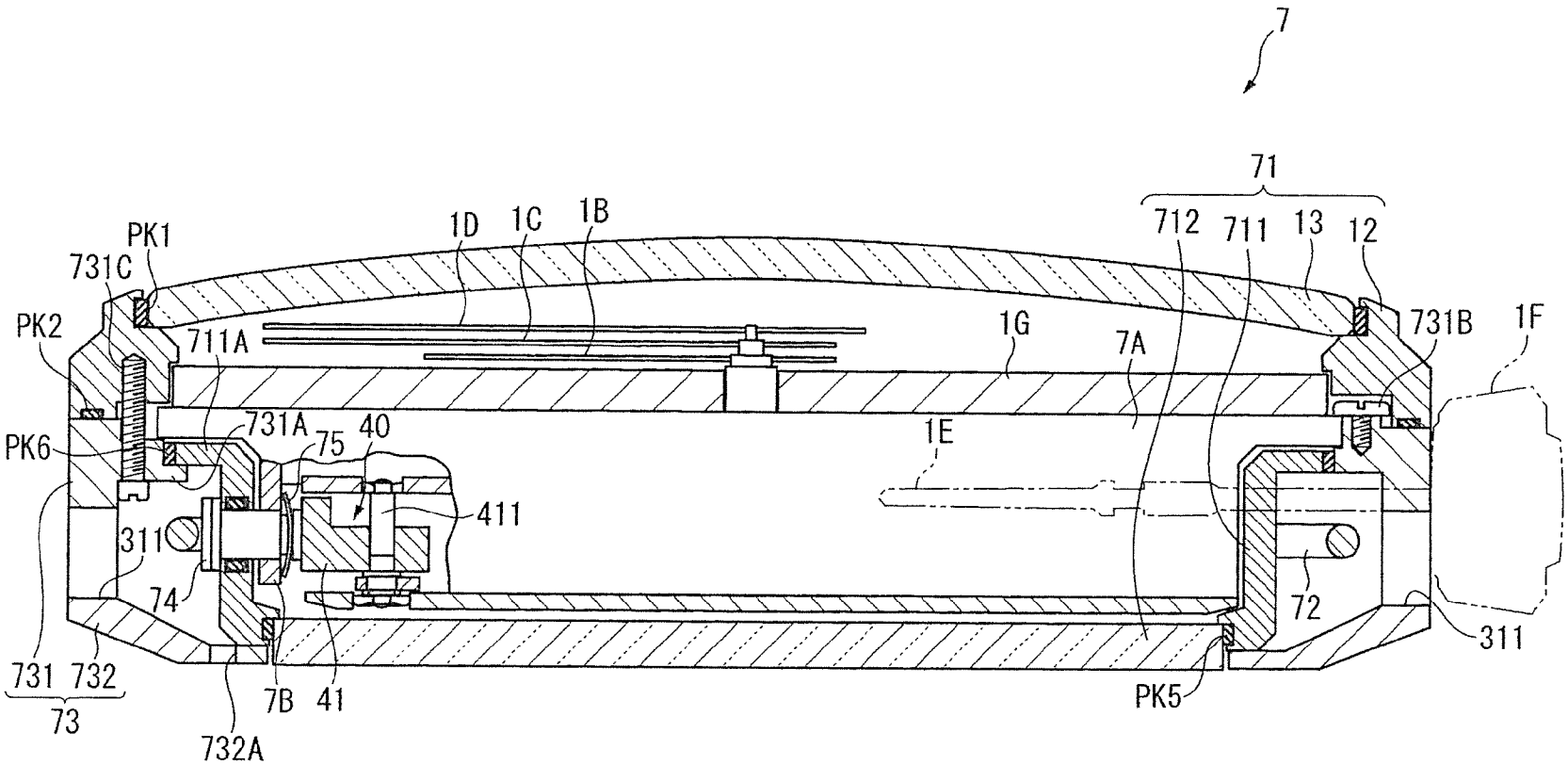
FIG. 6 is a vertical section view of a timepiece according to a second embodiment of the invention.
Figure 7:
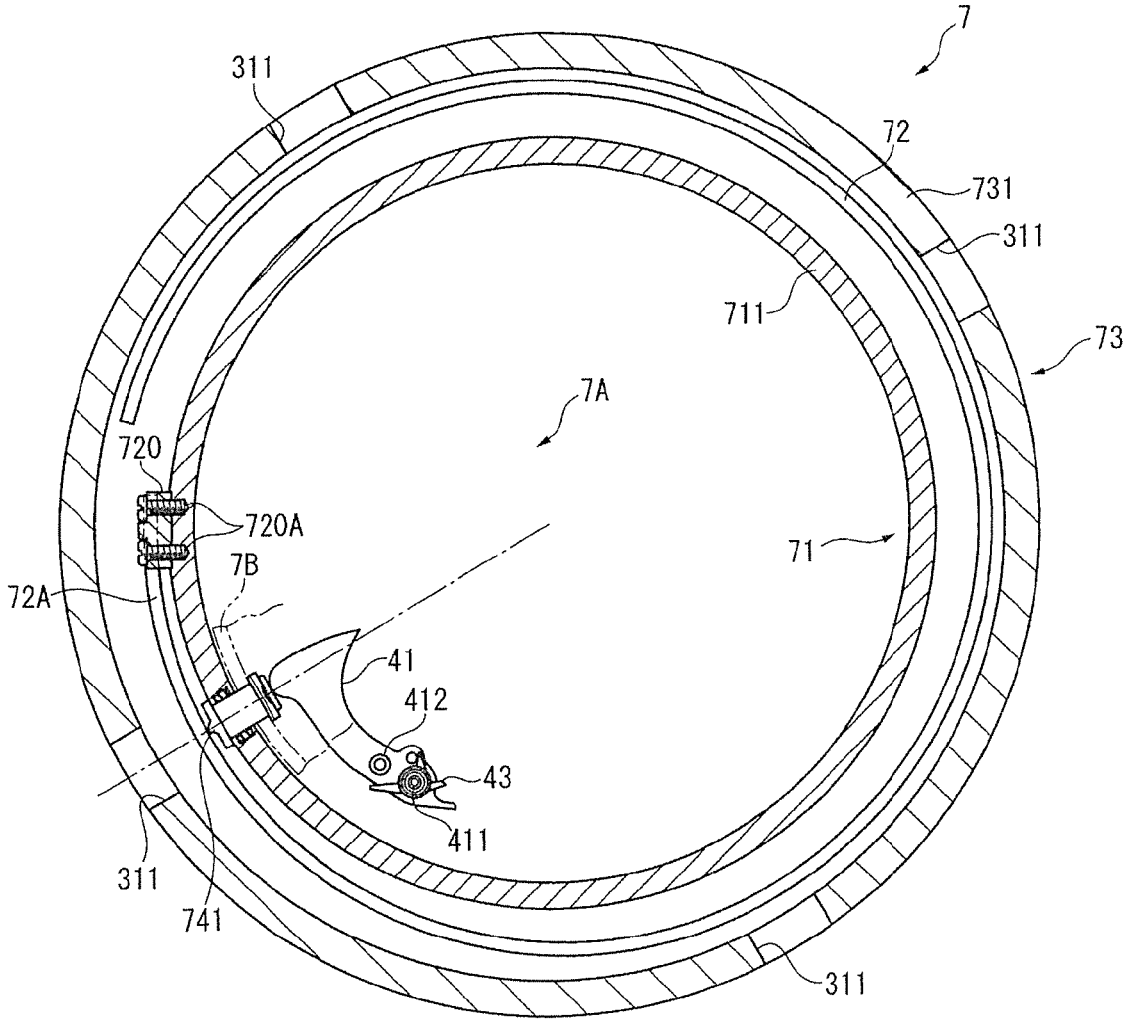
FIG. 7 is a horizontal section view of the timepiece.

FIG. 6 is a vertical section view of the timepiece 7 according to this embodiment of the invention, and FIG. 7 is a horizontal section view of the timepiece 7. Parts of the movement other than the hammer arm 41 and the hammer trip 43 are not shown in FIG. 7.

The timepiece 7 has a movement 7A, an inside case 71 housing the movement 7A, a C-shaped gong 72 disposed outside the inside case 71, and an outside case 73 that covers the gong 72.

The movement 7A in this embodiment of the invention also includes a repeater mechanism that marks the time every hour, 15 minutes, or one minute, for example, by striking the gong 72 instead of the sonnerie mechanism used in the first embodiment. This repeater mechanism includes a hammer 40, a striking control means (not shown in the figure) as a hammer drive mechanism that controls the striking operation of the hammer 40, the gong 72, and a hammer pin 74 as a striking force transmission member.

When the repeater mechanism is not operating, the hammer 40 is held still by an engaging means that is part of the striking control means.

Except for the hammer pin 74, the repeater mechanism in this embodiment of the invention is the same as a repeater mechanism known from the literature, and description of the striking control means, for example, is therefore omitted.

The sonnerie mechanism 4 described in the first embodiment of the invention can also be used in this embodiment. More specifically, a configuration that sounds the gong 72 every hour to count the hour can also be used.

The inside case 71 includes a cylindrical inside case member 711, a back crystal 712 disposed on the back cover side of the inside case member 711, a crystal 13, and a bezel 12.

A flange 711A that is fastened to the external case member 731 is formed at the top edge part of the inside case member 711. A through-hole 711B is formed in the side of the inside case member 711 as a holding unit in which the hammer pin 74 is disposed as shown in FIG. 8.

The back crystal 712 is press fit to the inside circumference part of the inside case member 711 with intervening plastic packing PK5.

The gong 72 is formed by bending hardened steel rod stock into a C-shape, and is disposed with space between the gong 72 and the outside surface of the inside case member 711 as well as the external case member 731. As shown in FIG. 7, the base end part 72A of the gong 72 is secured pressed into a hole in the gong base 720 disposed in the inside case member 711.

The gong base 720 is a rectangular steel block that is fastened to the outside of the inside case member 711 by screws 720A. The screw holes in the inside case member 711 that the screws 720A are screwed into are blind holes to keep the inside of the inside case member 711 airtight. Rubber packing or other sealant is therefore not needed around the screws 720A. There is therefore no packing to absorb the vibrations of the gong 72, and thereby reduce or attenuate the volume.

As shown in FIG. 6, the outside case 73 includes a cylindrical external case member 731 and a back cover ring 732 that holds the outside edge of the back crystal 712.

Openings 311 are formed at a plurality of locations around the circumference of the external case member 731. A shoulder 731A on which the flange 711A of the inside case member 711 is set is formed around the top on the inside circumference of the external case member 731.

A plurality of drain holes 732A for draining water that gets inside the external case member 731 are also formed in the back cover ring 732. These drain holes 732A are formed at plural locations around the circumference of the back cover ring 732. The drain holes 732A also function as sound openings.

This embodiment of the invention has one gong 72 and hammer 40 each, but could have a plurality of gongs and hammers. By adjusting the length of the gong to produce a specific frequency, the pitch of the produced sound can be varied, and the time can be reported using a combination of different tones.

If plural gongs are used, the height at which each gong is attached to the side of the inside case member 711 is adjusted so that the gongs do not touch and interfere with each other.

The gongs can also be fastened to a common gong base, or a plurality of gong bases can be disposed at plural locations around the circumference of the inside case member.

The gongs can also be disposed leading clockwise and counterclockwise from opposite sides of the gong base.

Further alternatively, the gongs can be be disposed spiraling with the opposite ends of each gong at a different height.

Figure 8:
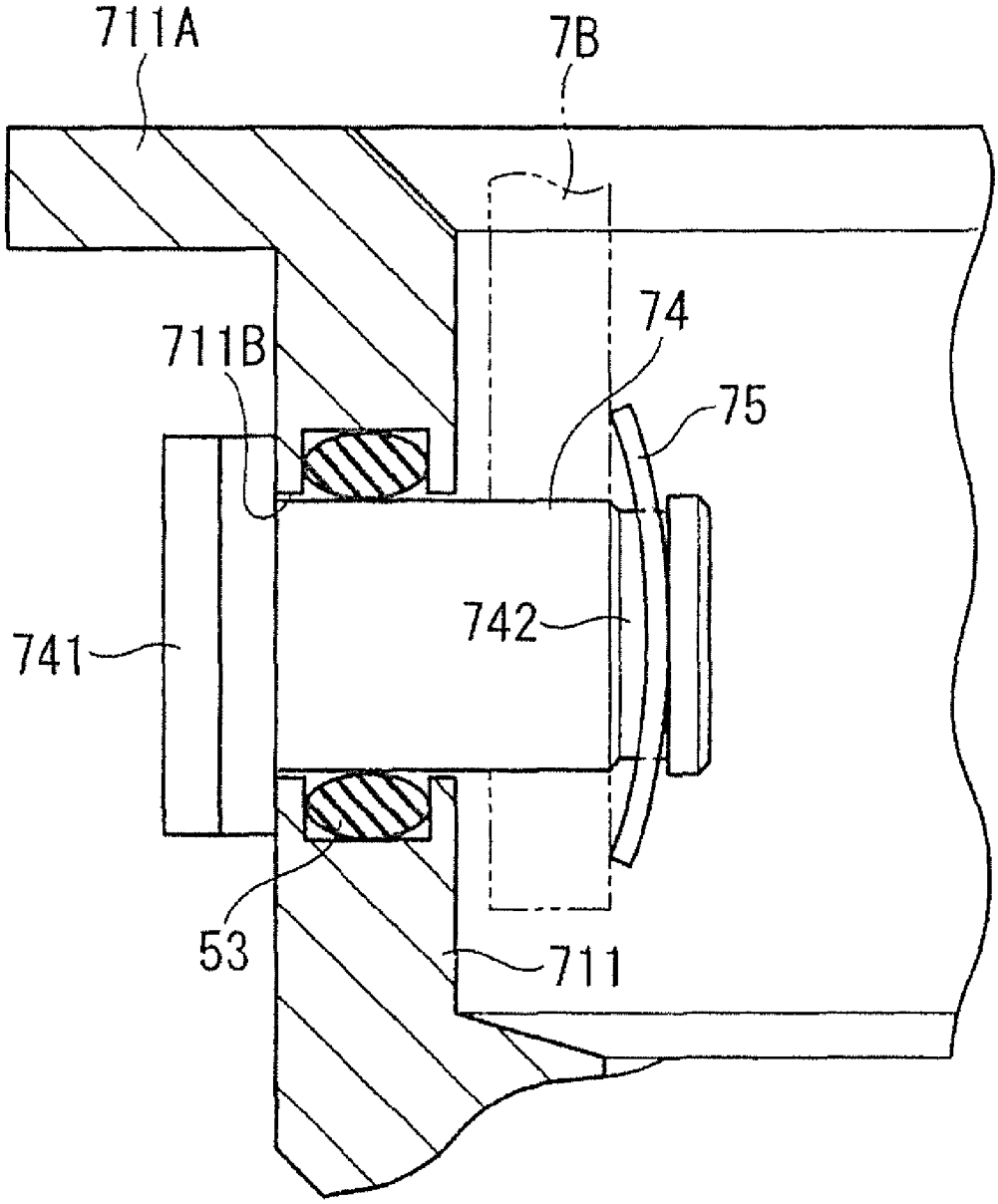
FIG. 8 shows the hammer pin in this embodiment of the invention.

FIG. 8 shows the hammer pin 74. The hammer pin 74 is inserted directly to the through-hole 711B in the inside case member 711 near the base end part 72A of the gong 72 (FIG. 7), and the pin engaging part 7B formed in the outside circumference part of the movement 7A without using an intervening sleeve. The hammer pin 74 has a striking part 741 for striking the gong 72, and a groove 742. The striking part 741 is triangular when seen in plan view as shown in FIG. 7, and the groove 742 passes through the pin engaging part 7B and engages a flat spring 75. An O-ring 53 intervenes between the outside of the hammer pin 74 and the through-hole 711B in the inside case member 711.

The flat spring 75 is rectangular when seen in plan view, curves, and has a notch formed from one short side toward the other short side. The groove 742 in the hammer pin 74 is inserted to this notch. The flat spring 75 pushes against the pin engaging part 7B and urges the hammer pin 74 to the hammer 40 side.

The timepiece 7 according to this embodiment of the invention can be assembled as described below.

The back crystal 712 is first attached to the inside case member 711 with the intervening plastic packing PK5.

Plastic packing PK6 is then placed on the shoulder 731A of the external case member 731, the inside case member 711 is inserted to the external case member 731 from the side where the crystal 13 is located, and the flange 711A of the inside case member 711 is placed on the shoulder 731A of the external case member 731. The packing PK6 is elastically deformed radially to the timepiece between the shoulder 731A and the side of the flange 711A, and the flange 711A is secured press fit to the shoulder 731A. This packing PK6 differs from the packing PK4 (FIG. 1) that is used in the first embodiment and elastically deformed in the thickness direction of the timepiece.

Note that the gong 72 is attached to the inside case member 711 before assembling the external case member 731 and the inside case member 711.

The movement 7A is then inserted from the crystal 13 side to the inside case member 711 assembled to the external case member 731, and the movement 7A is then fastened to the top of the external case member 731 by screws 731B engaging the outside edge part of the base plate of the movement 7A with the base plate therebetween.

After thus securing the movement 7A to the external case member 731, the stem 1E, push buttons not shown, the hammer pin 74, and the flat spring 75 are installed.

With packing PK2 between the top edge of the external case member 731 and the bezel 12, the bezel 12 is fastened to the external case member 731 by screws 731C disposed to the inside side of the packing PK2. Packing is also provided around the shank of the screws 731C.

The back cover ring 732 is then fastened to the external case member 731 by screws not shown, completing assembly of the inside case member 711, bezel 12, crystal 13, external case member 731, back cover ring 732, and back crystal 712 in unison.

A water-resistant seal enclosing the movement 7A is assured by the packing members PK1, PK2, PK5, and PK6 rendering an airtight chamber inside the inside case 71 including the inside case member 711, back crystal 712, bezel 12, and crystal 13.

The repeater mechanism in this embodiment of the invention controls striking the gong by the hammer 40 in conjunction with the operation of the wheel train driving the hands in substantially the same way as the sonnerie mechanism 4 in the first embodiment. After the striking control means causes the hammer arm 41 to pivot away from the gong 72, the hammer arm 41 strikes the end of the hammer pin 74 and causes the hammer pin 74 to move toward the gong 72. The hammer pin 52 thus strikes and causes the gong 72 to vibrate.

After striking the gong 72, the hammer pin 74 is returned to its original position by the spring force of the flat spring 75, and does not touch the gong 72 again until the hammer pin 74 is again struck by the hammer 40.

When the gong 72 vibrates, the air waves produced by vibration of the gong 72 create a ringing sound which travels through the openings 311 in the external case member 731 to the outside and is emitted with sufficient volume. After causing the hammer 40 to strike a number of times corresponding to the minute, the striking control means stops and holds the hammer 40 still by an engaging means.

Similarly to the first embodiment, this embodiment of the invention renders the inside case 71 airtight while disposing the gong 72 outside the inside case member 711, thereby achieving a water resistant construction while also producing the sound typical of a gong 72.

This embodiment of the invention has the following effects in addition to the effects of the first embodiment described above.

(8) By disposing packing PK6 between the side of the flange 711A of the inside case member 711 and the shoulder 731A of the external case member 731 when fastening the inside case member 711 and external case member 731 together, the thickness of the joint between the inside case member 711 and the external case member 731 can be reduced compared with the construction of the first embodiment using packing PK4 that compresses vertically. This increases the space around the gong 72 and enables the gong 72 to sound louder.

(9) Because the hammer pin 74 is inserted directly to the inside case member 711, the thickness of the inside case member 711 can be reduced compared with a configuration using a hammer pin unit 50 with a sleeve 51 as in the first embodiment, and the thickness of the timepiece 7 can therefore be reduced.

Embodiment 3

A third embodiment of the invention is described next with reference to FIG. 9 to FIG. 11.

This embodiment of the invention differs from the preceding embodiments in the method of connecting the inside case and the outside case.

This embodiment also uses a different type of striking force transmission member.

Other than these main differences, the timepiece according to this embodiment of the invention is substantially the same as the timepiece 7 described in the second embodiment above.

Figure 9:
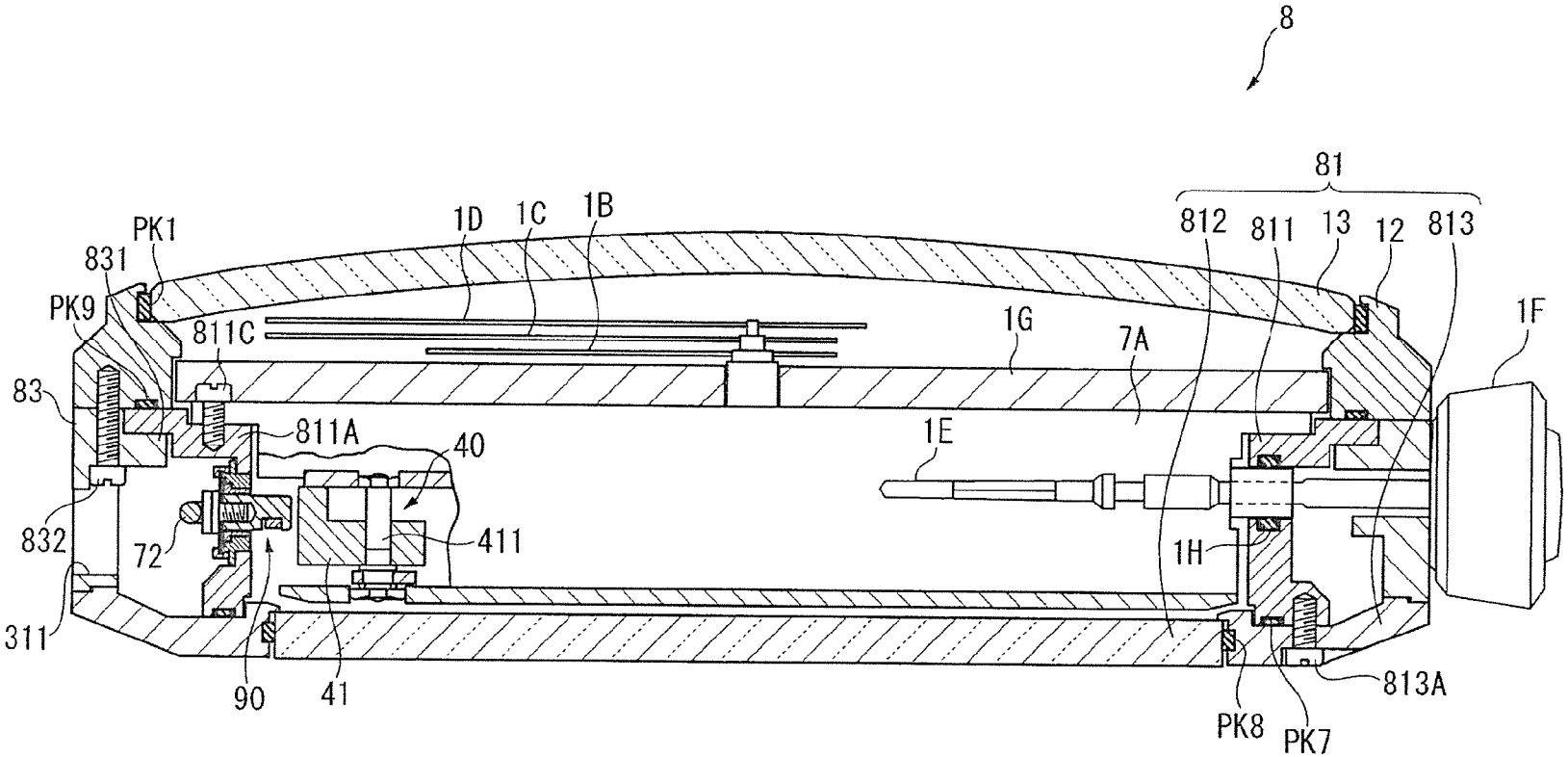
FIG. 9 is a vertical section view of a timepiece according to a third embodiment of the invention.
Figure 10:
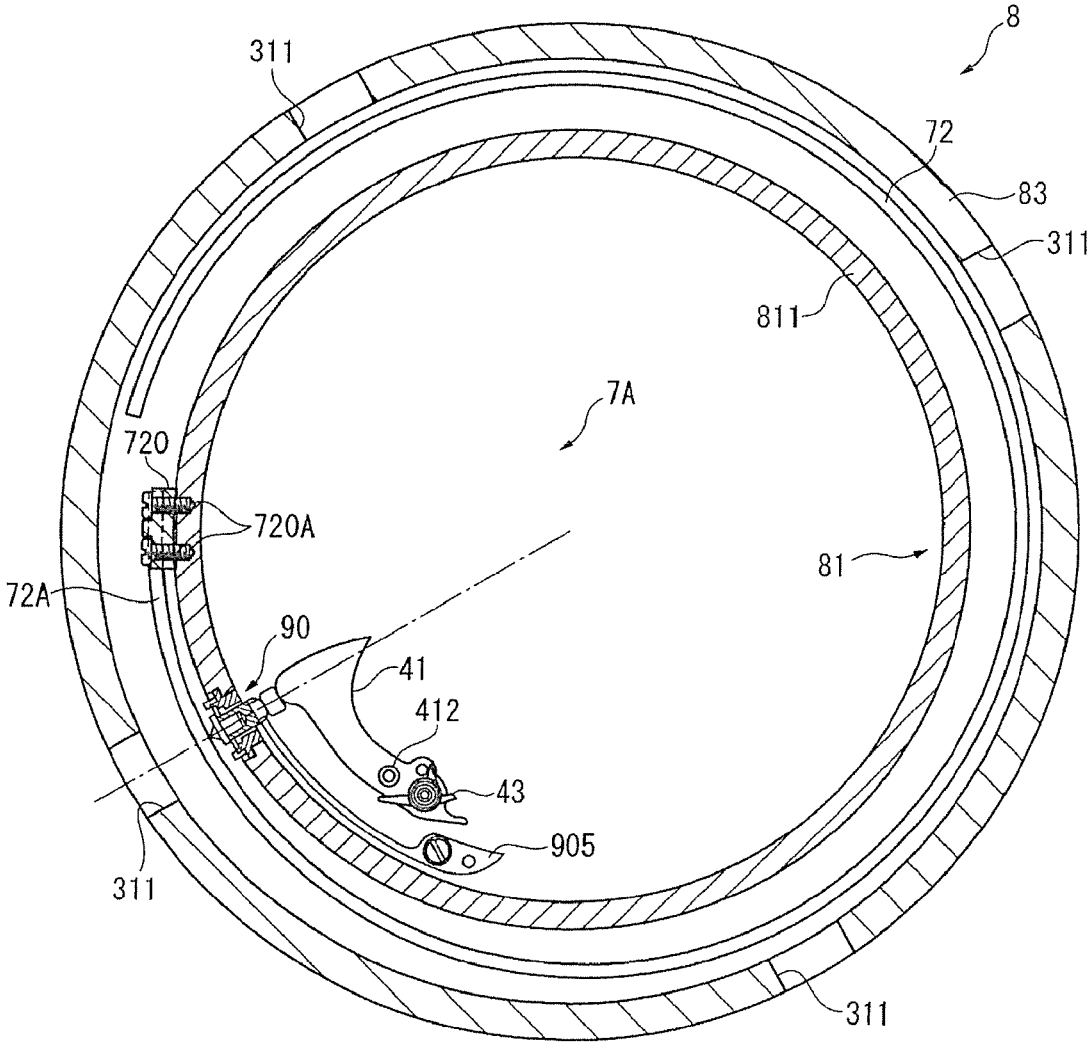
FIG. 10 is a horizontal section view of the timepiece.

FIG. 9 is a vertical section view of the timepiece 8 according to this embodiment of the invention. FIG. 9 is a section view through the part where the stem 1E is disposed (shown on the right side in FIG. 9). FIG. 10 is a horizontal section view of the timepiece 8. Parts of the movement 7A other than the hammer arm 41 and the hammer trip 43 are not shown in FIG. 10.

The timepiece 8 has a movement 7A, an inside case 81 housing the movement 7A, a gong 72 disposed outside the inside case 81, and an outside case 83 that covers the gong 72.

The inside case 81 includes a cylindrical inside case member 811, a back crystal 812 and a back cover ring 813 disposed on the back cover side of the inside case member 811, a crystal 13, and a bezel 12.

The inside case member 811 is an anti-magnetic body made of pure iron or a ferritic stainless steel, for example, that also functions as an antimagnetic plate protecting the parts of the movement 7A from magnetization. Note that by coating the inside case member 811 with an anticorrosion coating approximately 30 μm thick, bimetallic corrosion between different types of metals can be prevented even if the inside case member 811 is made from ferrite or a ferritic stainless steel and the outside case 83 is made from gold, platinum, or other rare metal. Because the surface of the inside case member 811 is covered by the outside case 83 and is not touched when the timepiece 8 is used, the surface coating of the inside case member 11 will not be damaged by wear or scratches. Note that if a ferritic stainless steel that has been modified to improve the corrosion resistance of the surface is used for the inside case member 811, a coating or plating process to improve the corrosion resistance is not needed.

In addition, when the gong base 720 is screwed to the inside case member 811, the threads are preferably coated with an anaerobic adhesive to prevent corrosion.

The back cover ring 813 is then fastened with screws 813A to the bottom end part of the inside case member 811 with intervening rubber packing PK7.

The back crystal 812 is then pressed into the inside circumference part of the back cover ring 813 with intervening plastic packing PK8. The back crystal 812 and back cover ring 813 thus work together as the back cover of the timepiece.

A flange 811A to which the base plate of the movement 7A is secured is formed at the top edge of the inside case member 811. A through-hole 811B (FIG. 11) in which a hammer pin unit 90 is disposed is formed in the side of the inside case member 811.

Openings 311 are formed at a plurality of locations around the circumference of the outside case 83. A shoulder 831 against which the flange 811A of the inside case member 811 is set is formed around the top on the inside circumference of the outside case 83.

Figure 11:
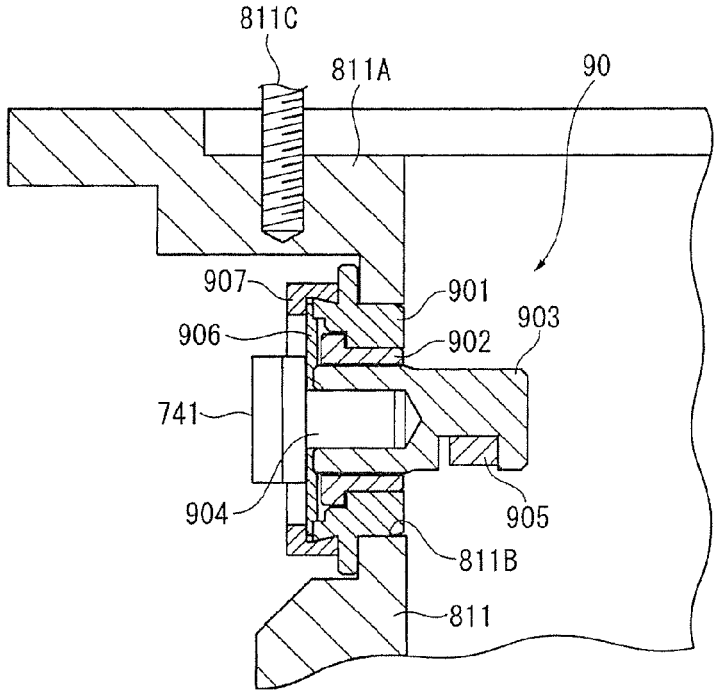
FIG. 11 shows the hammer pin unit in this embodiment of the invention.

FIG. 11 shows the hammer pin unit 90 as the striking force transmission member.

The hammer pin unit 90 has an outside sleeve 901 disposed in the inside case member 811, a guide sleeve 902, a first hammer pin 903, a second hammer pin 904 connected to the first hammer pin 903, a spring 905 (see FIG. 10) disposed on the base plate of the movement 7A, an elastic sheet 906 disposed as an elastic member blocking the opening in the outside sleeve 901 to form an airtight seal, and a fastening ring 907 that secures the elastic sheet 906 to the end of the outside sleeve 901.

The outside sleeve 901 is a flanged metal cylinder, and is press fit into the through-hole 811B in the inside case member 811.

The guide sleeve 902 is a flanged plastic cylinder which is press fit inside the outside sleeve 901 so that the flange engages the outside sleeve 901. The guide sleeve 902 is made of Teflon®, Delrin®, or other material with a lower coefficient of friction than the outside sleeve 901.

The outside sleeve 901 and guide sleeve 902 function as a holding unit to which the first and second hammer pins 903 and 904 are inserted. This holding unit can also be rendered using a single sleeve without the guide sleeve 902.

The pin that strikes the gong 72 when hit by the hammer 40 is rendered in this embodiment of the invention using the two first and second hammer pins 903 and 904. The first hammer pin 903 is inserted to the guide sleeve 902 with some play, and is urged to the inside of the inside case member 811 by the spring 905 (FIG. 10). After striking the gong 72, the first and second hammer pins 903 and 904 are returned to the original positions by the force of the spring 905.

The second hammer pin 904 has a striking part 741 that is triangular in plan view, and is pressed into a hole in the first hammer pin 903.

The elastic sheet 906 is made from a waterproof sheet that is stamped to form a round washer. The inside edge part of the elastic sheet 906 is held compressed between the first and second hammer pins 903 and 904. The elastic sheet 906 can be inexpensively manufactured by stamping a general purpose material using a simple die.

The outside edge part of the elastic sheet 906 is held compressed by the fastening ring 907 fit to the flange part of the outside sleeve 901. The elastic sheet 906 thus closes the opening in the outside sleeve 901, and helps assure that the space inside the inside case member 811 is water resistant even though the hammer pin unit 90 passes through the side wall.

Water resistance can be improved by coating the inside edge part and outside edge part of the elastic sheet 906 with a coating or adhesive.

The timepiece 8 in this embodiment of the invention can be assembled as follows.

The end part of the gong 72 is pressed into the gong base 720, which is then fastened by screws 720A to the outside of the inside case member 811. The hammer pin unit 90 is assembled to the inside case member 811, and the movement 7A is inserted to the inside case member 811 from the crystal 13 end. The base plate of the movement 7A is fastened by screws 811C to the flange 811A of the inside case member 811.

With the movement 7A and gong 72 attached, the inside case member 811 is then inserted to the outside case 83 from the crystal 13 side, and the flange 811A of the inside case member 811 are placed on the shoulder 831 of the outside case 83. The bezel 12 is then placed on the flange 811A of the inside case member 811 with the intervening rubber packing PK9, and screws 832 are then inserted from the back cover side to fasten the outside case 83 to the bezel 12 with the flange 811A of the inside case member 811 therebetween.

The back cover ring 813 with attached back crystal 812 is then fastened by screws 813A to the bottom end of the inside case member 811 with intervening packing PK7, thereby assembling the inside case member 811, the bezel 12, the crystal 13, the outside case 83, the back cover ring 813, and the back crystal 812 in unison.

The water resistance of the movement 7A is assured in this embodiment of the invention by packing PK1, PK7, PK8, and PK9 rendering an airtight space inside the inside case 81 including the inside case member 811, back crystal 812, back cover ring 813, bezel 12, and crystal 13. The elastic sheet 906 of the hammer pin unit 90 and the O-ring 1H disposed to the stem 1E also help keep the inside of the inside case 81 airtight.

Operation of the repeater mechanism in this embodiment of the invention is the same as in the second embodiment. Striking control by the striking control means of the movement 7A causes the hammer arm 41 to strike the end of the first hammer pin 903, causing the first and second hammer pins 903 and 904 to move inside the guide sleeve 902 toward the gong 72 and the striking part 741 of the second hammer pin 904 to strike the gong 72.

Because the elastic sheet 906 deforms elastically during this operation and tracks the movement of the first and second hammer pins 903 and 904, the first and second hammer pins 903 and 904 moves smoothly toward the gong 72. The outside sleeve 901 and guide sleeve 902 do not slide because the positions of the inside edge part and outside edge part of the elastic sheet 906 are fixed.

This embodiment of the invention has the following effects in addition to the effects of the second embodiment described above.

(10) Because the inside case member 811 is magnetic, separately providing an antimagnetic plate to prevent magnetization of parts inside the movement 7A is not necessary.

The parts count can therefore be reduced, cost can be reduced, and the size can be reduced commensurately to the size of the antimagnetic plate.

In addition, by rendering the inside case member 811 as a magnetic body, the outside case 83 can be made from a rare metal, and antimagnetism and a small size can be achieved while maintaining an attractive appearance.

(11) The water resistance of the hammer pin unit 90 is assured by using a elastic sheet 906 instead of a water resistant O-ring between the first hammer pin 903 and the guide sleeve 902 of the hammer pin unit 90, thereby greatly reducing resistance to movement of the first and second hammer pins 903 and 904 used as the striking force transmission member compared with using an O-ring. Problems caused by tearing of the O-ring from wear are also prevented. Using a elastic sheet 906 also increases the striking force transmitted to the gong 72 by the first and second hammer pins 903 and 904, and less energy is therefore required to strike the gong 72. The duration time of the spring inside the barrel wheel 4A can therefore be increased.

Furthermore, because the positions of the inside edge part and outside edge part of the elastic sheet 906 are fixed, the water resistance is more reliable than using an O-ring.

(12) Because the elastic sheet 906 is shaped like a washer and is disposed around the outside of the first and second hammer pins 903 and 904, there is no mechanical energy loss from compressing a sheet such as happens when an elastic sheet without a hole is disposed between the hammer and the pin.

(13) Using two pins provides greater freedom selecting the materials used for the first and second hammer pins 903 and 904.

(14) Because the movement 7A and gong 72 are fixed to the inside case member 811 before attaching the outside case 83, the outside case 83 can be attached after adjusting the position of the hammer 40 and the distance to the gong 72, for example.

(15) Because the back cover (back crystal 812 and back cover ring 813) is attached at the end of assembly, parts inside the movement 7A can be adjusted after the inside case member 811 and outside case 83 are assembled.

Furthermore, because the back cover is attached and removed using screws 813A, the movement 7A can be easily maintained without removing the crystal 13. A means for tilting the setting lever to remove the stem 1E from the movement 7A and inside case member 811 can therefore also be disposed on the back cover side. The dial 1G can therefore be fastened to the movement 7A because removing the dial 1G is not necessary for maintenance of the movement 7A.

(16) Because the screws 832 holding the bezel 12 and outside case 83 together are located outside of the packing PK9 between the bezel 12 and the inside case member 811, packing is not needed outside of the screws 832.

First Variation of Embodiment 3

Figure 12:
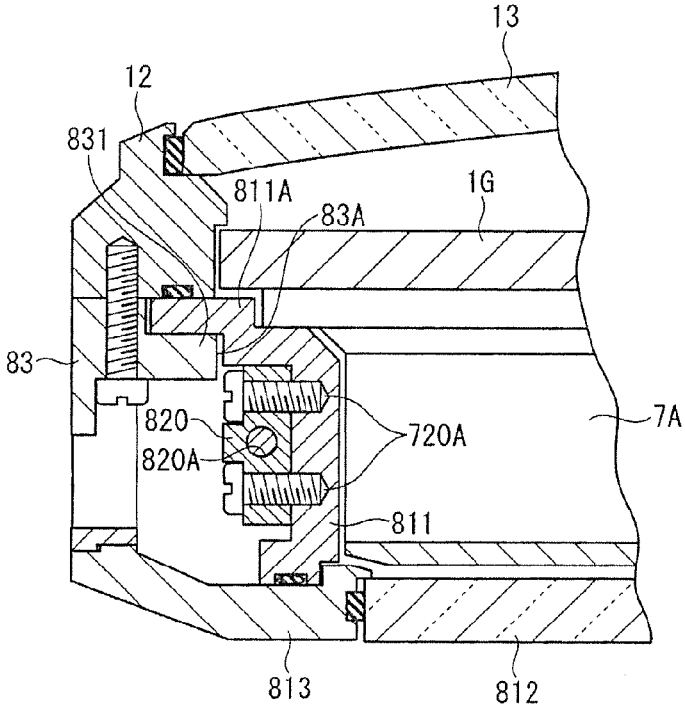
FIG. 12 shows a first variation of the third embodiment.

FIG. 12 shows the relative positions of the gong base 820 and the inside circumference of the outside case 83 in one variation of the third embodiment.

The gong base 820 in this example is disposed to a position that is proximate to but not touching the farthest inside end 83A of the inside circumference part of the outside case 83. This inside end 83A of the outside case 83 is the inside diameter of the shoulder 831. By rendering the outside diameter of the inside case member 811 including the gong base 820 smaller than the inside diameter of the shoulder 831, the inside case member 811 can be easily inserted with the gong 72 attached thereto into the outside case 83 by tightly winding the free end of the flexible gong 72 (FIG. 10) that is secured in the hole 820A in the gong base 820.

The two screws 720A that fasten the gong base 820 to the side of the inside case member 811 in this embodiment are one above the other in line with the thickness of the timepiece. The depth of the hole 820A into which the gong 72 is press fit therefore does not overlap the insertion direction of the screws 720A, and the gong base 820 can be rendered small.

Second Variation of Embodiment 3

Figure 13:
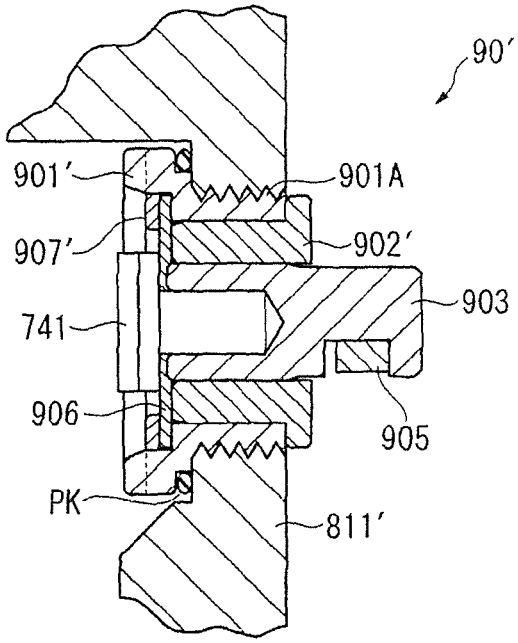
FIG. 13 shows a second variation of the third embodiment.

FIG. 13 shows the hammer pin unit 90' in another variation of the third embodiment.

This hammer pin unit 90' has a male thread 901A formed on the outside of the outside sleeve 901', which is then screwed into a threaded hole in the inside case member 811'. Water resistance is achieved by packing PK between the flange of the outside sleeve 901' and the side of the inside case member 811. The outside sleeve is press fit into the inside case member in the third embodiment of the invention, but the outside sleeve can be installed in the inside case member using a threaded connection as in this example.

Note that the elastic sheet 906 is placed on a shoulder on the inside circumference side of the outside sleeve 901' in this example, and the outside edge part of the elastic sheet 906 is compressed by the fastening ring 907 that is press fit into the inside circumference of the outside sleeve 901'.

Third Variation of Embodiment 3

Figure 14:
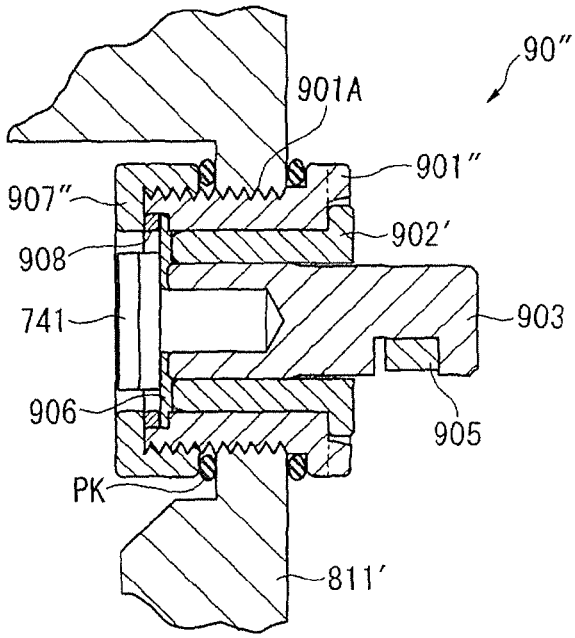
FIG. 14 shows a third variation of the third embodiment.

FIG. 14 shows the hammer pin unit 90" in another variation of the third embodiment.

In this embodiment the outside sleeve 901" is screwed in from the inside of the inside case member 811', and the fastening ring 907" is screwed onto the end of the outside sleeve 901" protruding from the outside of the inside case member 811' with a washer 908 therebetween. A key formed on the outside circumference of the washer 908 fits into a notch formed in the inside circumference part of the outside sleeve 901", thereby preventing the washer 908 from turning. The elastic sheet 906 is thus not abraded when the fastening ring 907" is screwed on, and the elastic sheet 906 can be compressed uniformly.

Embodiment 4

A fourth embodiment of the invention is described next with reference to FIG. 15.

Figure 15:
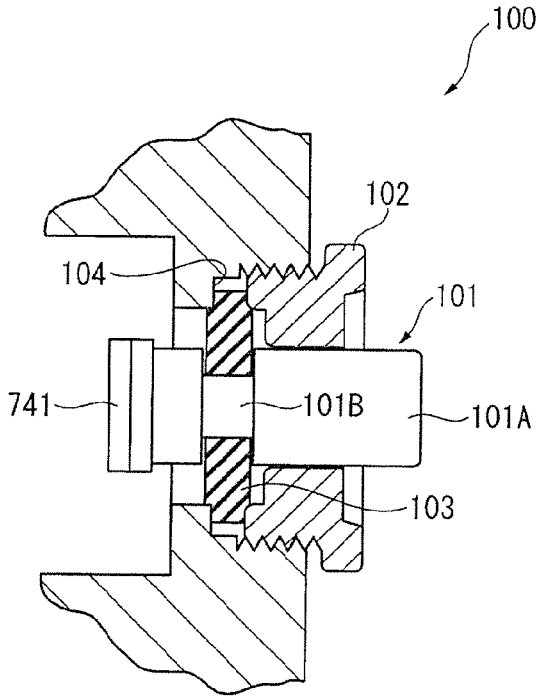
FIG. 15 shows the hammer pin unit in a fourth embodiment of the invention.

FIG. 15 shows the hammer pin unit 100 in this embodiment of the invention. The hammer pin unit 100 has a hammer pin 101, a sleeve 102 that is threaded on the outside, and a rubber sheet 103 as a circular elastic member. The hammer pin unit 100 in this embodiment of the invention does not have a spring for returning the hammer pin 101.

The hammer pin 101 has a striking part 741, a large diameter part 101A, and a small diameter part 101B that is recessed from the large diameter part 101A.

The inside diameter of the sleeve 102 is slightly larger than the large diameter part 101A of the hammer pin 101, and the sleeve 102 thus guides the hammer pin 101 in the thrusting (axial) direction.

The inside circumference edge part of the rubber sheet 103 is fit to the small diameter part 101B of the hammer pin 101. The hole diameter in the rubber sheet 103 is smaller than the outside (shaft) diameter of the small diameter part 101B, and the holding force of the rubber sheet 103 against the small diameter part 101B assures a water resistant seal between the hammer pin 101 and the inside circumference edge part of the rubber sheet 103.

If the rubber sheet 103 is first warmed up using hot water, for example, the rubber sheet 103 can be easily installed to the small diameter part 101B without applying excessive force to and damaging the rubber sheet 103.

The outside edge part of the rubber sheet 103 is compressed between a seat 104 formed on the inside case member and the sleeve 102 screwed into the inside case member, thereby assuring a water resistant seal around the outside edge part of the rubber sheet 103.

When the hammer arm 41 (FIG. 10) strikes the hammer pin 101, the hammer pin 101 moves while elastically deforming the rubber sheet 103.

When the hammer arm 41 then moves away from the struck end of the hammer pin 101, the elasticity of the rubber sheet 103 returns the hammer pin 101 to a position between the hammer arm 41 and the sound source. The rubber sheet 103 is thus both a member assuring the water resistance of the hammer pin unit 100 and an urging member for resetting the hammer pin 101.

In addition to the effects (11) and (12) described in the third embodiment above, the hammer pin unit 100 according to this embodiment of the invention has the following effect.

(17) Because the rubber sheet 103 also functions as an urging member for the hammer pin 101, a spring or other member for pulling the hammer pin 101 back after being struck by the hammer 40 is not needed. The parts cost can therefore be reduced.

Embodiment 5

Figure 16:
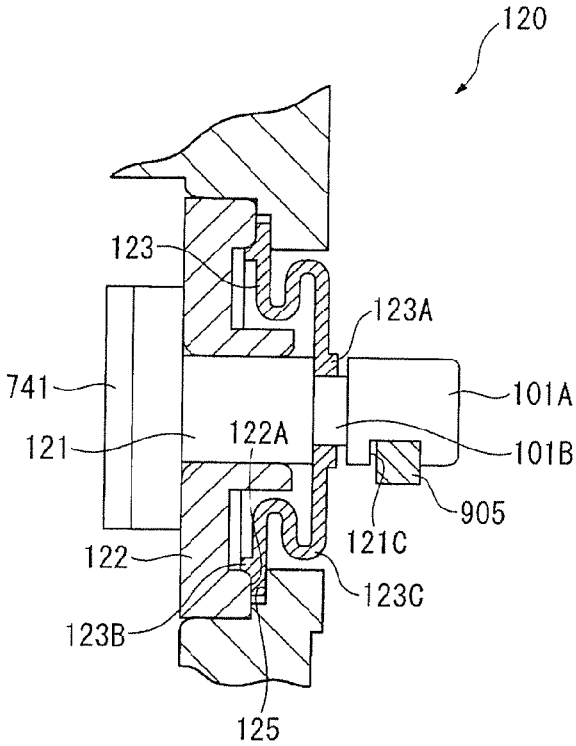
FIG. 16 shows the hammer pin unit in a fifth embodiment of the invention.

FIG. 16 shows the hammer pin unit 120 in a variation of the fourth embodiment.

The hammer pin unit 200 has a hammer pin 121, a sleeve 122 as a holding unit with a flange, and a bellows-shaped rubber sleeve 123 as a cylindrical elastic member. The spring 905 (FIG. 10) for pulling the hammer pin 121 back is disposed to the movement in this embodiment of the invention.

The hammer pin 121 has a striking part 741, a large diameter part 101A, a small diameter part 101B that is recessed from the large diameter part 101A, and a flat 121C formed by removing a part of the large diameter part 101A.

The inside diameter of the sleeve 122 is slightly larger than the large diameter part 101A of the hammer pin 121, and the sleeve 122 thus guides the hammer pin 121 in the thrusting (axial) direction.

The bellows-like rubber sleeve 123 is a cylindrical body with one end 123A having a small hole diameter and the other end 123B having a large hole diameter, and a bellows part 123C formed between the ends 123A and 123B. The wall thickness of the one end 123A and the other end 123B of the rubber sleeve 123 is greater than the wall thickness of the bellows part 123C.

The one end 123A of the rubber sleeve 123 is fit to the small diameter part 101B of the hammer pin 121. The hole diameter in the one end 123A of the rubber sleeve 123 is smaller than the small diameter part 101B, and the holding force of the rubber sleeve 123 against the small diameter part 101B assures a water resistant seal between the hammer pin 121 and one end 123A of the rubber sleeve 123.

The other end 123B of the rubber sleeve 123 is held and compressed between a seat 125 formed on the inside case member and the flange 122A of the sleeve 122 pressed into the inside case member, thereby assuring a water resistant seal around the outside edge part of the other end 123B of the rubber sleeve 123.

When the hammer 40 (FIG. 10) strikes the hammer pin 121, the hammer pin 121 moves while deforming the bellows part 123C of the rubber sleeve 123.

Because the wall thickness of the bellows part 123C is thinner than the wall thickness of the one end 123A and other end 123B, there is little loss of striking energy from deformation of the rubber sleeve 123 when the hammer pin 121 moves.

The hammer pin unit 120 according to this embodiment of the invention has effect (19) described below in addition to effect (18), which is substantially identical to effect (11) described in the third embodiment. The hammer pin unit 120 also has the effect (11) described in the third embodiment.

(18) Because the elastic member is a bellows-shaped rubber sleeve 123 and the ends 123A and 123B of the rubber sleeve 123 provide water resistant, resistance to movement of the hammer pin 121 is significantly less than when an O-ring is used, and absorption of the striking energy of the hammer 40 by the elastic member can be minimized. The duration time of the spring inside the barrel wheel 4A can therefore be increased.

(19) By rendering the wall thickness of the bellows part 123C relatively thin and the wall thickness of the end parts 123A and 123B relatively thick in the rubber sleeve 123, energy loss caused by deformation of the rubber sleeve 123 when the hammer pin 121 can be reduced while water resistance can be improved by firmly securing the ends 123A and 123B of the rubber sleeve 123.

Embodiment 6

A sixth embodiment of the invention is described next with reference to FIG. 17 and FIG. 18.

Figure 17:
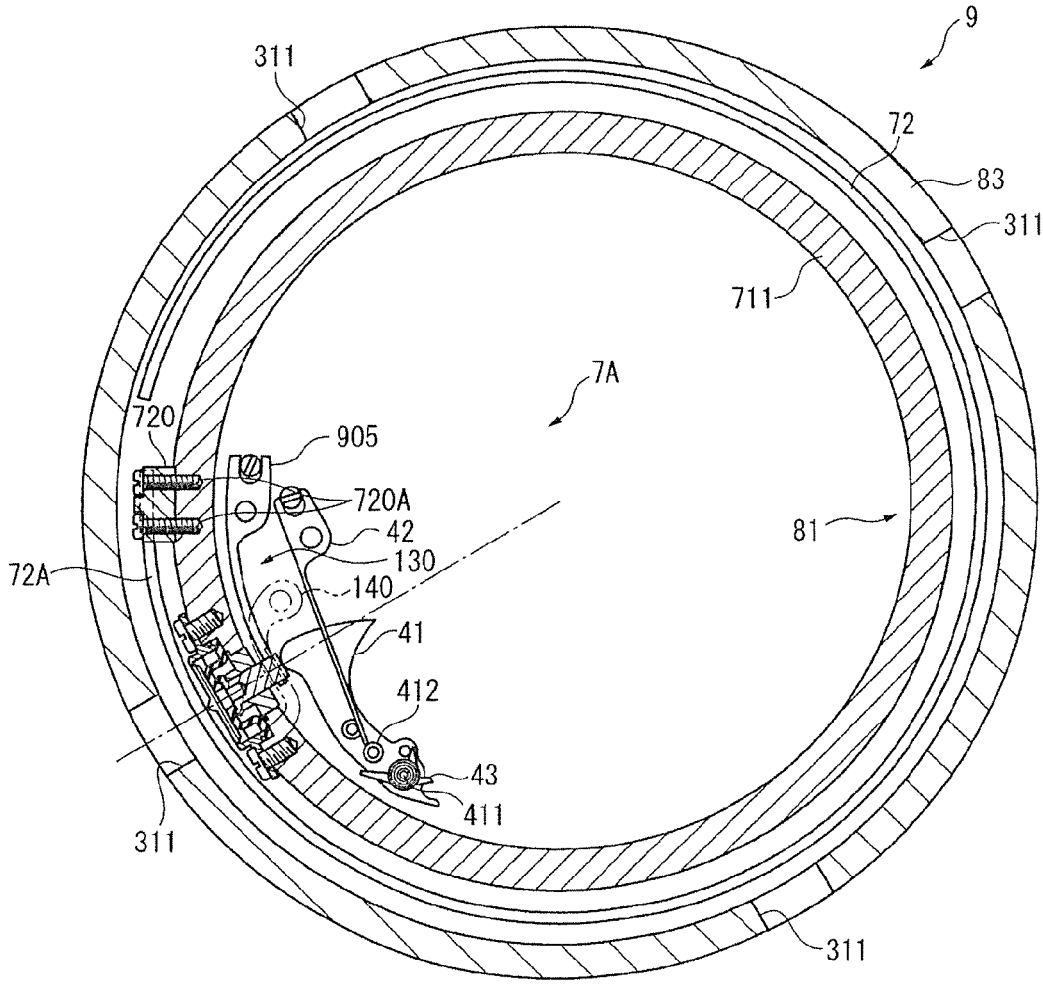
FIG. 17 is a horizontal section view of a timepiece according to a sixth embodiment of the invention.
Figure 18:
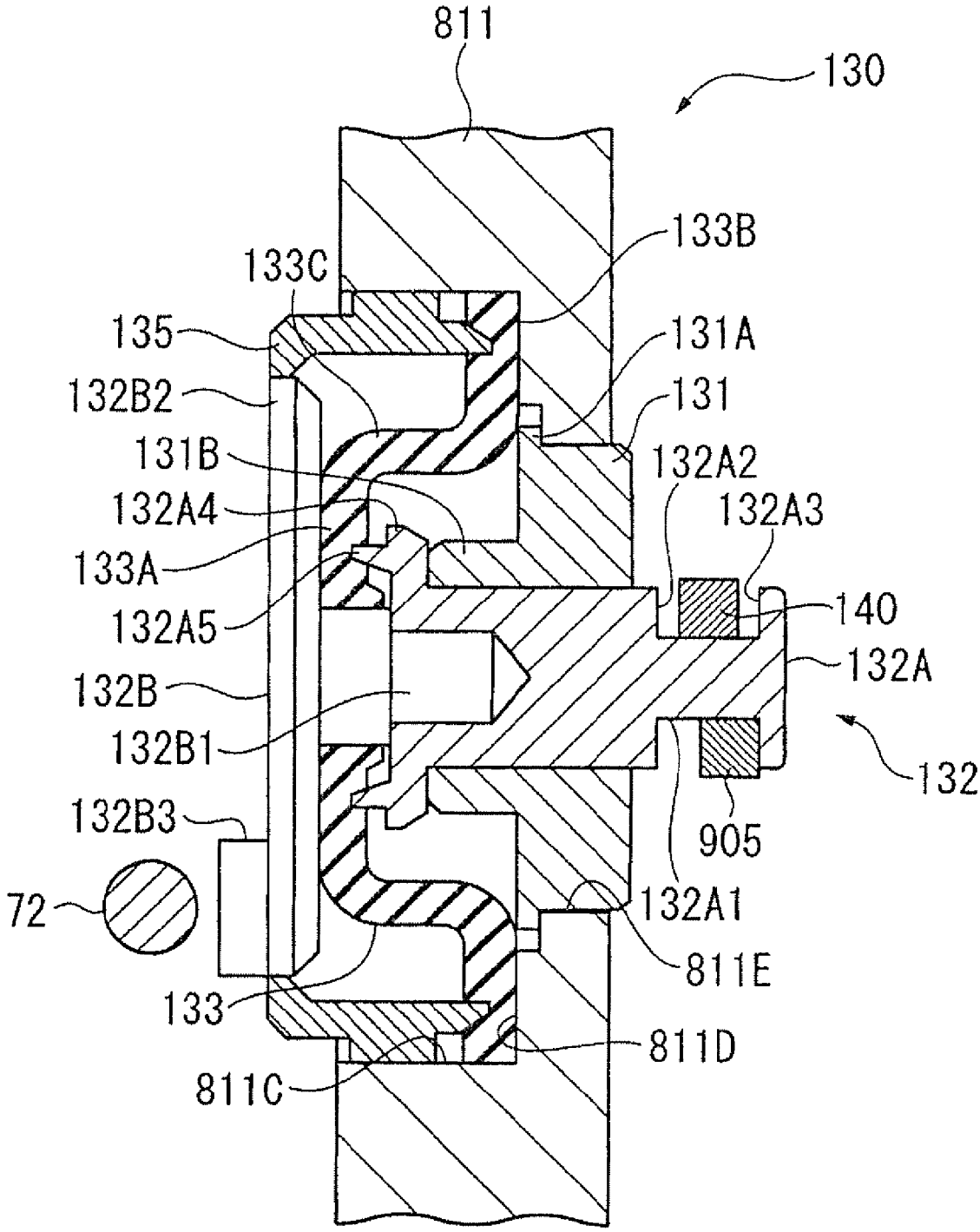
FIG. 18 shows the hammer pin unit in the sixth embodiment of the invention.

FIG. 17 is a horizontal section view of the timepiece 9 according to this sixth embodiment of the invention, and FIG. 18 shows the hammer pin unit in the sixth embodiment. Parts of the movement other than the hammer arm 41, the hammer spring 42, and the hammer trip 43 are not shown in FIG. 17. Note further that like parts in this and the foregoing embodiments are identified by the same reference numerals, and further description thereof is omitted or simplified.

The timepiece 9 according to this sixth embodiment of the invention modifies the hammer pin unit 90 in the timepiece 8 according to the third embodiment.

More specifically, the hammer pin unit 130 in this sixth embodiment includes a sleeve 131 as a holding unit, a hammer pin 132, and a rubber sleeve 133 as a substantially cylindrical elastic member. As in the fifth embodiment, the spring 905 that pulls the hammer pin 132 back is fastened to the movement.

The sleeve 131 is made from metal such as steel or brass, and is press fit with the outside against the wall of an installation hole formed passing between the inside and the outside of the inside case member 811. As shown in FIG. 18, this installation hole has a large diameter part 811C and a small diameter part 811E.

This installation hole is disposed in the inside case member 811 of the inside case 81 at a position opposite the hammer 40, and holds the hammer pin unit 130.

The large diameter part 811C and small diameter part 811E are coaxial, and the sleeve 131 is press fit into the small diameter part 811E. A shoulder is formed between the large diameter part 811C and the end part of the small diameter part 811E on the gong 72 side.

A sleeve flange 131A protruding radially is formed to the outside surface of the sleeve 131, and this sleeve flange 131A stops against the shoulder. This prevents the sleeve 131 from sliding inside the inside case 81.

The sleeve 131 also has a boss 131B protruding to the gong 72 side inside the large diameter part 811C for engaging the second hammer pin 132B described below.

As shown in FIG. 18, the hammer pin 132 includes a first hammer pin 132A, and a second hammer pin 132B with a striking part 132B3. In this embodiment of the invention the first hammer pin 132A and second hammer pin 132B together render the pin that strikes the gong 72 when struck by the hammer 40.

The first hammer pin 132A is inserted to the sleeve 131 to move freely in and out. A small diameter part 132A1 (groove) with a smaller diameter than the other part is formed at one end on the hammer 40 side of the first hammer pin 132A. The return spring 905 fastened to the movement 7A engages this small diameter part 132A1, and urges the first hammer pin 132A to the inside of the inside case member 811.

A stopper 140 that is attached to the movement 7A inside the inside case member 811 is also disposed to this small diameter part 132A1. This stopper 140 has an arm with a width that is less than the channel width of the small diameter part 132A1 along the axis of the hammer pin 132, and one end of this arm part is fastened pivotably to a predetermined location in the movement 7A. The other end of the arm part of the stopper 140 touches the inside surface of the inside case member 811.

In the initial position when the hammer pin 132 is not driven, the arm part of the stopper 140 is located at a position separated a predetermined distance from the wall 132A2 on the gong 72 of the small diameter part 132A1 and the wall 132A3 on the hammer 40 side.

If internal pressure of the inside case 81 becomes greater than the external pressure and the first hammer pin 132A is pushed to the outside, such as when the air pressure outside the case drops suddenly or the pressure inside the case becomes greater than the outside pressure, the stopper 140 contacts the hammer 40 side wall 132A3 of the small diameter part 132A1 and limits movement of the first hammer pin 132A.

However, if the hammer pin 132 is driven by the hammer 40, contacts the gong 72, and rebounds, or if the internal pressure of the inside case 81 becomes less than the external pressure and the first hammer pin 132A slides toward the inside case member 811, movement of the first hammer pin 132A is limited by both the pin flange 132A4 of the first hammer pin 132A and the sleeve flange 131A of the sleeve 131.

The position of the stopper 140 can be adjusted when manufacturing the timepiece 9 by grinding the other end part that contacts the inside surface of the inside case member 811 or grinding the part of the inside case member 811 that is touched by the stopper. More specifically, the position of the stopper 140 is determined so that when the gong 72 is struck by the hammer pin 132, there is a gap of a predetermined size to the wall 132A3. This enables the hammer pin 132 to strike the gong 72 when the hammer pin 132 is driven by the hammer 40 without the stopper 140 interfering with driving the hammer pin 132.

While this embodiment of the invention renders a small diameter part 132A1 to the first hammer pin 132A, and engages the return spring 905 and the stopper 140 in this small diameter part 132A1, separate grooves of predetermined widths can be formed in the first hammer pin 132A one above the other through the thickness of the timepiece, and the stopper 140 and return spring 905 can be separately engaged in these grooves.

A substantially ring-shaped pin flange 132A4 protruding radially from the shank of the first hammer pin 132A is formed at the other end part on gong 72 side of the first hammer pin 132A. After the hammer pin 132 strikes the gong 72 and returns to its original position, the pin flange 132A4 contacts the boss 131B of the sleeve 131 and limits further movement. When the pressure inside the inside case 81 is greater than the outside pressure, the pin flange 132A4 also limits movement of and prevents the first hammer pin 132A from falling inside the inside case 81.

A substantially ring-shaped rubber holding boss 132A5 that clamps and holds the rubber sleeve 133 against the second hammer pin 132B is also formed protruding from the pin flange 132A4.

A hole into which the second hammer pin 132B is pressed and held is formed in the gong 72 side end surface of the first hammer pin 132A.

The second hammer pin 132B has a press-fit pin 132B1 that is pressed into and held in the hole formed in the end of the first hammer pin 132A, and a striker mounting plate 132B2 formed in unison with the gong 72 end surface of the press-fit pin 132B1.

As described above, the second hammer pin 132B secures the rubber sleeve 133 and is secured to the first hammer pin 132A by inserting the rubber sleeve 133 between the striker mounting plate 132B2 and the rubber holding boss 132A5 of the first hammer pin 132A, and then pressing the press-fit pin 132B1 into the hole rendered in the end of the first hammer pin 132A.

The striking part 132B3 is formed at a position opposite the gong 72 on the striker mounting plate 132B2, and the striking part 132B3 contacts the gong 72 when the hammer pin 132 moves to the gong 72 side.

The rubber sleeve 133 is a cylindrical body having one end part 133A with a small hole diameter, an other end part 133B with a large hole diameter, and a cylindrical part 133C between the ends 133A and 133B.

As described above, the one end part 133A of the rubber sleeve 133 is held between the rubber holding boss 132A5 of the first hammer pin 132A and the striker mounting plate 132B2 of the second hammer pin 132B. This assures a water resistant seal between the first hammer pin 132A and the second hammer pin 132B. The hole diameter of the one end part 133A of the rubber sleeve 133 is smaller than the diameter of the press-fit pin 132B1, and the holding force of the rubber sleeve 133 also assures a water resistant seal between the second hammer pin 132B and the one end part 133A of the rubber sleeve 133.

The other end part 133B of the rubber sleeve 133 is held between a tubular rubber clamp 135 that is fit into the large diameter part 811C of the inside case member 811 and the seat 811D connecting the large diameter part 811C and the small diameter part 811E, thus assuring a water resistant seal proximate to the outside of the other end part 133B of the rubber sleeve 133. The rubber clamp 135 is held by a screw thread to the outside of the inside case member 811 so that it does not fall out.

In addition to the effects of the third embodiment described above, the hammer pin unit 130 according to this embodiment of the invention has the following effects.

(20) The sleeve flange 131A is held on a shoulder formed between the small diameter part 811E and the large diameter part 811C, and the pin flange 132A4 of the first hammer pin 132A is held against the boss 131B of the sleeve 131. Movement of the first hammer pin 132A is thus limited so that the first hammer pin 132A is prevented from falling inside the inside case 81 when the hammer pin 132 rebounds to the hammer 40 side after striking the gong 72, and when the hammer pin 132 moves toward the hammer 40 because the pressure inside the inside case 81 is less than the outside pressure.

(21) A small diameter part 132A1 is formed on one end of the first hammer pin 132A on the hammer 40 side, and the stopper 140 is disposed inside this small diameter part 132A1. As a result, when the hammer pin 132 moves to the gong 72 side because the pressure inside the inside case 81 is greater than the outside pressure, for example, the stopper 140 contacts the wall 132A3 on the hammer 40 side of the small diameter part 132A1 and prevents further movement. The first hammer pin 132A is thus prevented from slipping out to the gong 72 side of the first hammer pin 132A.

Embodiment 7

A seventh embodiment of the invention is described next with reference to the accompanying figures.

Figure 19:
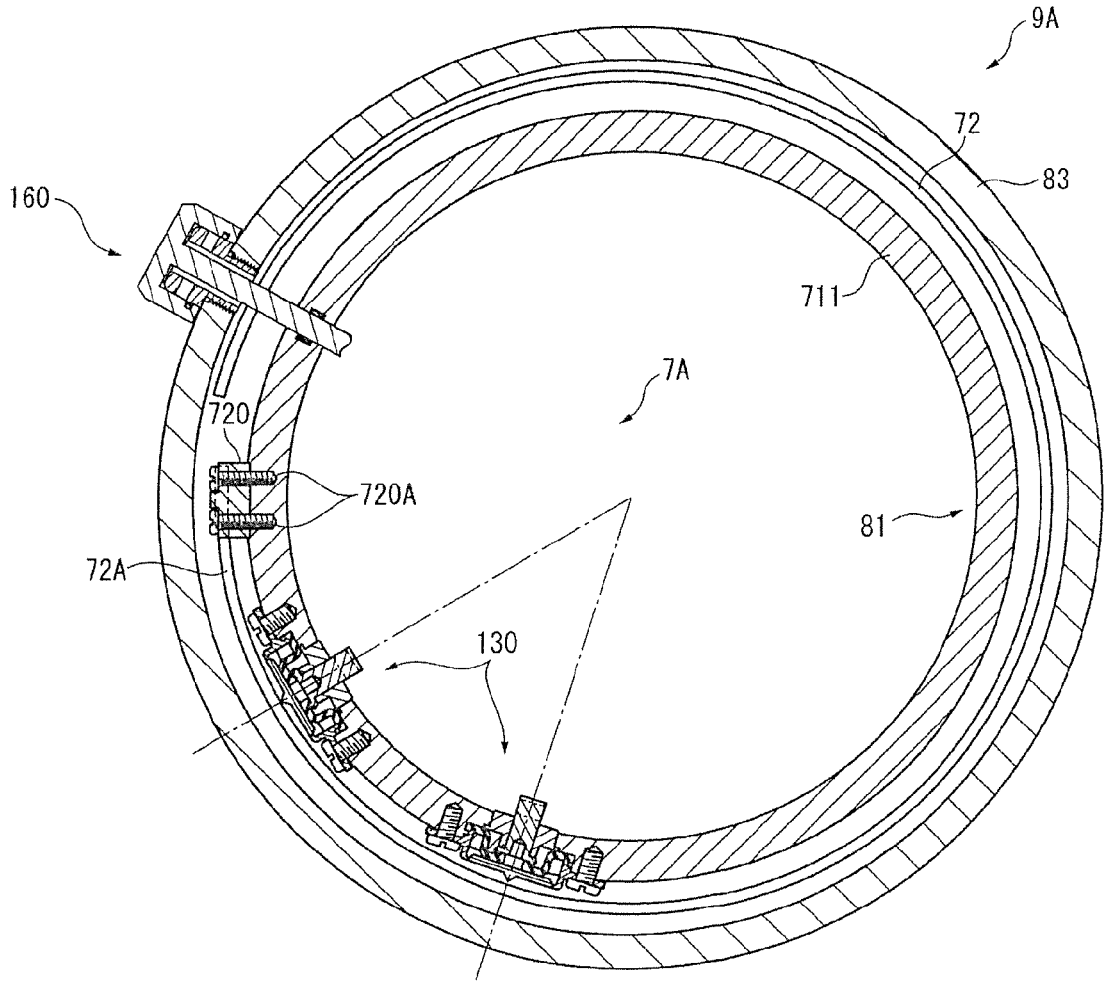
FIG. 19 is a horizontal section view of a timepiece according to a seventh embodiment of the invention.
Figure 20:
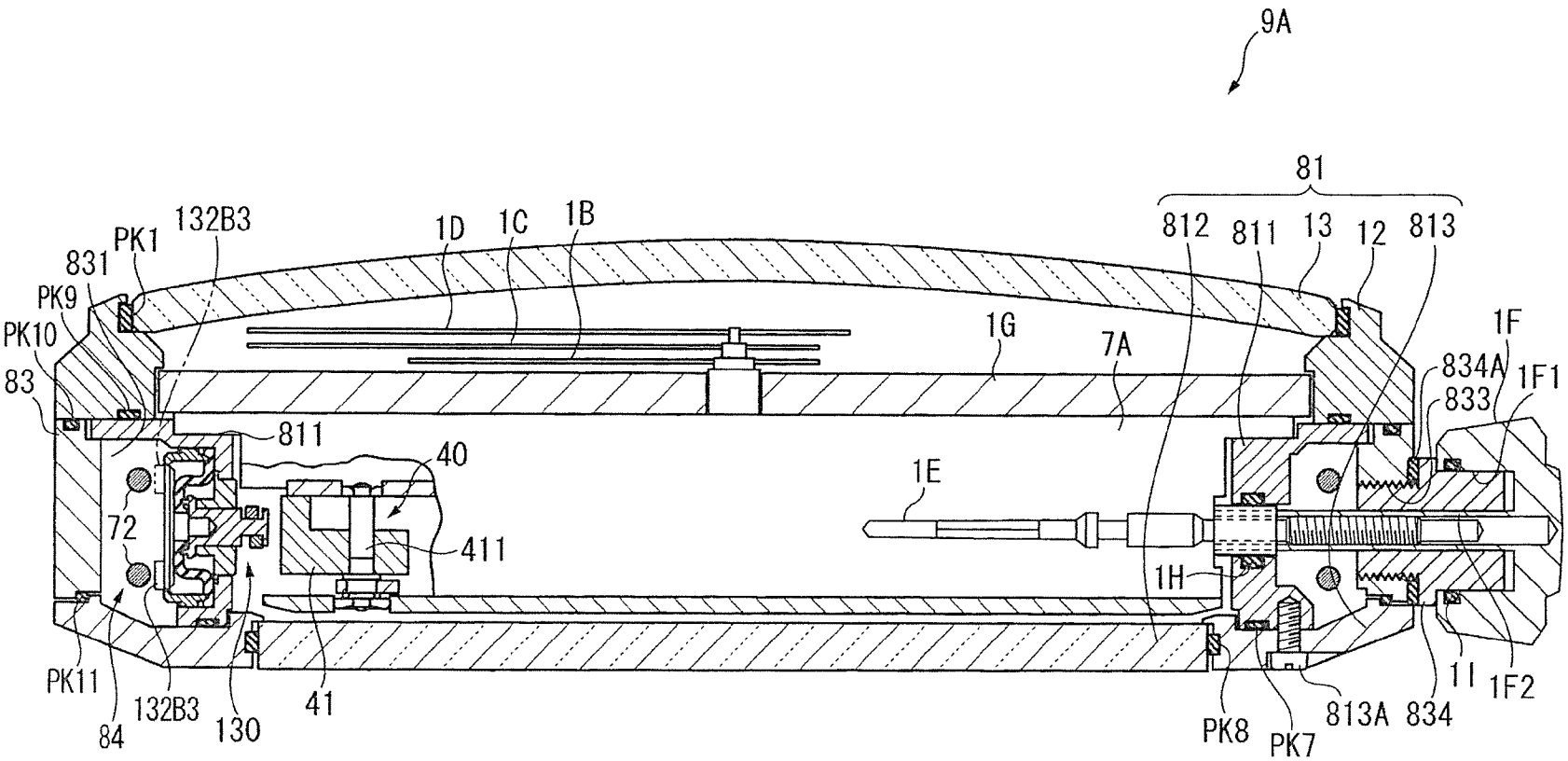
FIG. 20 is a vertical section view of a timepiece according to the seventh embodiment of the invention.
Figure 21:
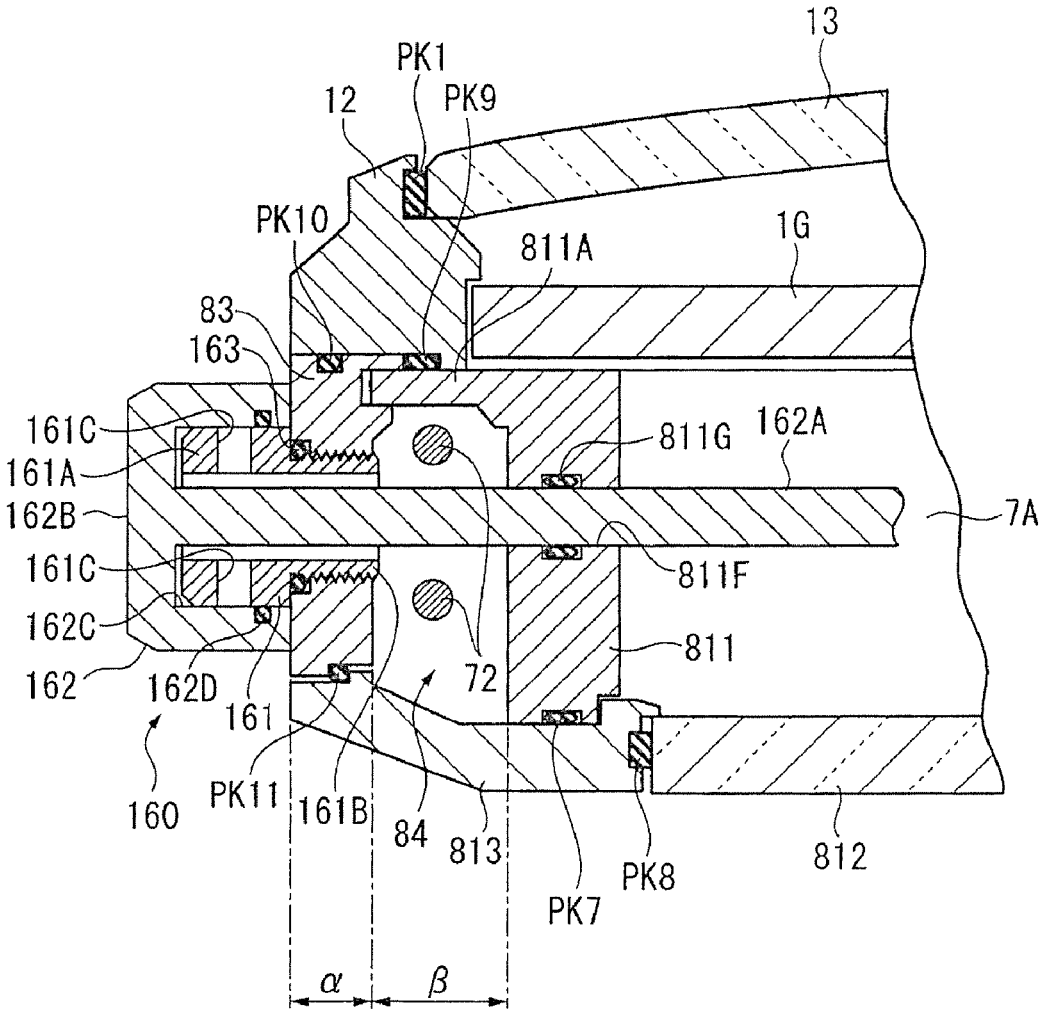
FIG. 21 shows the gap opening and closing means according to the seventh embodiment of the invention.
Figure 22:
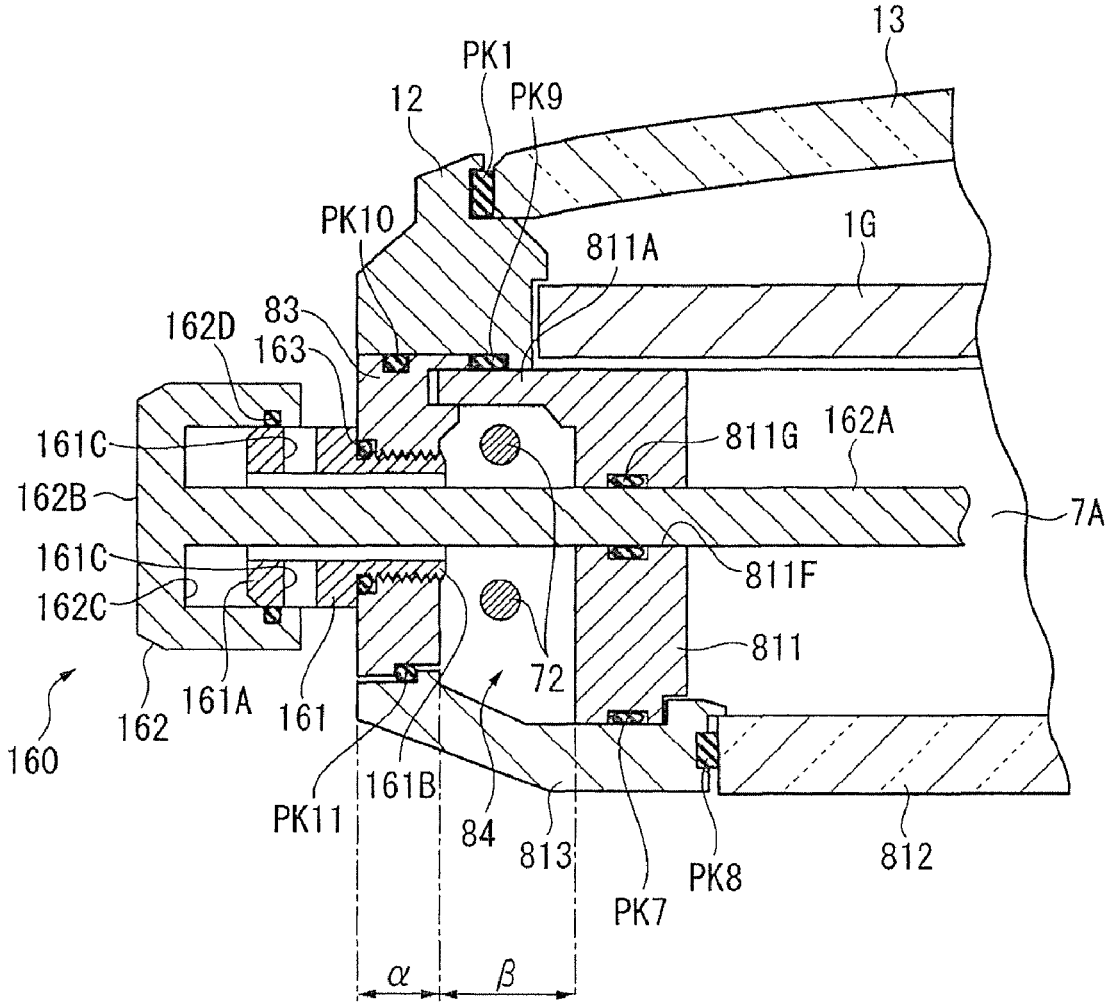
FIG. 22 shows the gap opening and closing means according to the seventh embodiment of the invention.

FIG. 19 is a horizontal section view of a timepiece according to this seventh embodiment of the invention. FIG. 20 is a vertical section view of the timepiece according to this seventh embodiment of the invention. FIG. 21 is a vertical section view of the area near the gap opening and closing means in the timepiece according to this seventh embodiment of the invention when the gap opening and closing means is closed. FIG. 22 is a vertical section view of the area near the gap opening and closing means in the timepiece according to this seventh embodiment of the invention when the gap opening and closing means is open.

As shown in FIG. 19 to FIG. 22, the timepiece 9A according to the seventh embodiment of the invention has two gongs 72 as sound sources. The gongs 72 are disposed offset vertically from each other through the thickness of the timepiece outside the inside case member 811 of the inside case 81, and wrap in a C-shape along the outside of the inside case member 811.

The gongs 72 can be secured to a single gong base 720 fastened to the inside case member 811, or secured to the inside case member 811 by means of different gong bases 720. The gongs 72 can also be the same length or different lengths to produce different tones. The gongs 72 shown in the figures are substantially round in section, but the gongs 72 can be rectangular in section, for example. Further alternatively, the gongs 72 can have different shapes when seen in section.

Two hammer pin units 130 corresponding to the two gongs 72 are disposed in the inside case member 811. This embodiment of the invention uses two hammer pin units 130 as described in the sixth embodiment, but the invention is not so limited and the hammer pin units described in any of the first to fifth embodiments and variations thereof can be used instead.

The hammer pin units 130 are positioned so that the axial centers of the first hammer pin 132A and the second hammer pin 132B in the timepiece thickness direction are aligned substantially with the center of the gap between the pair of gongs 72. This configuration enables easily adjusting the positions of the striking parts 132B3 of the pair of hammer pin units 130 so that one hammer pin unit 130 strikes one gong 72 and the other hammer pin unit 130 strikes the other gong 72 by simply rotating the second hammer pin 132B in one hammer pin unit 130 180 degrees from the position of the second hammer pin 132B in the other hammer pin unit 130. It is therefore not necessary to manufacture different second hammer pins 132B according to the position of the corresponding gong 72, thus reducing the number of part types and reducing the production cost.

The timepiece 9A according to this seventh embodiment of the invention also has an echo chamber 84 between the inside case 81 and the outside case 83. This echo chamber 84 is airtight, and a gap to the outside can be provided in the echo chamber 84 only by the opening and closing operation of the gap opening and closing means described below.

More specifically, as shown in FIG. 20, the inside case 81 includes the cylindrical inside case member 811, a back cover including the back crystal 812 and back cover ring 813, the crystal 13, and the bezel 12. As in the third embodiment, packing PK1, PK7, PK8, and PK9 is disposed between the crystal 13 and bezel 12, between the bottom edge of the inside case member 811 and the back cover ring 813, between the back cover ring 813 and the back crystal 812, and between the flange 811A of the inside case member 811 and the bezel 12.

The outside case 83 member used as the outside case covering the gongs 72 is substantially cylindrical. The top edge of the outside case 83 is fastened to the bezel 12 with ring-shaped plastic packing PK10 therebetween, and the bottom edge is fastened to the back cover ring 813 with ring-shaped plastic packing PK11 therebetween. An airtight seal is assured in this embodiment by the packing PK10 between the outside case 83 and bezel 12, but the outside case 83 and bezel 12 can alternatively be rendered as a single piece, in which case the packing PK10 is not needed.

A stem installation hole 833 is formed in the outside case 83 in line with the stem 1E, and a stem sleeve 834 is secured with an intervening O-ring 834A in this stem installation hole 833 protruding radially to the timepiece 9A. The crown 1F has a recess 1F1 that is substantially round in section for inserting the protruding end of the stem sleeve 834, and a crown cylinder 1F2 inside the recess 1F1 in which the stem 1E is inserted and secured. This crown cylinder 1F2 is inserted to the movement 7A through the stem sleeve 834 disposed in the outside case 83 and a sleeve disposed in the inside case member 811. An O-ring 1H also intervenes between the sleeve in the inside case member 811 and the crown cylinder 1F2. The inside of the inside case 81 is thus rendered airtight by packing members PK1, PK7, PK8, PK9 and the O-ring 1H.

The inside surface of the recess 1F1 in the crown 1F and the outside surface of the stem sleeve 834 slide against each other through an intervening O-ring 11, and the echo chamber 84 is therefore also kept airtight at the crown 1F.

A volume adjusting unit 160 as shown in FIG. 21 and FIG. 22 is disposed to the outside case 83 at a predetermined location. The volume adjusting unit 160 has a guide sleeve 161 as a substantially cylindrical gap forming member, and a volume adjustment button 162 as a gap opening and closing means.

The guide sleeve 161 has a main part 161A that protrudes to the outside of the outside case 83, and an insertion fastening part 161B rendered at one end of the main part 161A. A hole that communicates with the inside and outside of the outside case 83 and has a female thread on the inside surface, for example, is formed at a predetermined position to the outside case 83. A corresponding male thread is formed on the outside surface of the insertion fastening part 161B, and the guide sleeve 161 is fastened by screwing this male thread into the female thread of the hole. As shown in FIG. 21 and FIG. 22, the insertion fastening part 161B is screwed into the hole in the outside case 83 with an O-ring 163 fit into the corner between the insertion fastening part 161B and main part 161A so that the O-ring 163 is between the main part 161A and the outside case 83, and the gap between the guide sleeve 161 and the outside case 83 is airtight.

A hole 161C connecting the inside and outside cylindrical surfaces is formed in the outside surface of the main part 161A of the guide sleeve 161. The gap according to this aspect of the invention is formed by the communication channel that passes from this hole 161C through the inside of the guide sleeve 161 to the echo chamber 84.

In the communication path connecting the inside of the echo chamber 84 to the outside of the outside case 83, the area of this gap as used here denotes the smallest area in the area of the communication surface substantially perpendicular to the communication direction of the communication path. In this embodiment of the invention the area of the hole 161C is smaller than the area of the inside communication surface of the guide sleeve 161 (not including the shaft part 162A of the volume adjustment button 162 described below), and the area of the gap is determined by the area of this hole 161C.

The hole 161C is also formed with an area that does not interfere with the resonance effect of the echo chamber 84 and transmits the sound amplified by resonation to the outside when the second hammer pin 132B strikes the gong 72.

More specifically, the area of the hole 161C is set so that the frequency of the Helmholtz resonance produced by the space inside the echo chamber 84 and the frequency of the sound produced by the gong 72 are substantially equal. The resonance frequency of the Helmholtz resonance is described by equation (1) below where V is the volume of the echo chamber, L is the length from the hole 161C through the inside of the guide sleeve 161 to the echo chamber 84, S is the area of the hole 161C, ‹is the speed of sound through air, and ™ is an open end correction factor.

$$f_H = \frac{v}{2\pi}\sqrt{\frac{S}{V(L+\delta)}} \tag{1}$$

By appropriately adjusting the gap in the hole 161C, the length of the guide sleeve 161, and other factors so that the frequency derived from this equation substantially matches the frequency of the gong 72, a gap that is optimal for the echo chamber 84 can be formed. In this embodiment of the invention the area of the hole 161C is 1 $mm^2$ to 2 $mm^2$.

If the area of the hole 161C is too large, sound will not resonate in the echo chamber 84, the sound produced by the gong 72 will be directly transmitted outside the timepiece 9A, and the volume may be low. When the hole 161C is not provided, the echo chamber 84 will be completely sealed, the sound produced by the gong 72 will be impeded from travelling outside the timepiece 9A, and the volume will be low. However, by disposing a hole 161C with the area described above to the echo chamber 84, sound waves can be made to resonate sufficiently inside the echo chamber 84 so that the sound pressure rises and the sound resonating from the hole 161C can travel efficiently to the outside.

The volume adjustment button 162 has a shaft part 162A and a head part 162B. The diameter of the shaft part 162A is smaller than the inside diameter of the guide sleeve 161. The shaft part 162A is inserted to a guide hole 811F formed in the inside case member 811 and can slide in and out freely in the axial direction. The shaft part 162A is inserted to the guide hole 811F of the inside case member 811 with an intervening plastic O-ring 811G, thereby assuring that the inside of the inside case 81 is airtight.

The head part 162B is formed on the opposite end of the shaft part 162A as the end through the inside case member 811. The head part 162B has a guide recess 162C that is substantially round in section and is coaxial to the axial center of the shaft part 162A. The inside surface of this guide recess 162C renders the closing surface of this aspect of the invention. The inside diameter of the guide recess 162C is substantially equal to the outside diameter of the main part 161A of the guide sleeve 161, and opens and closes the hole 161C in the guide sleeve 161 as the volume adjustment button 162 moves in and out. An O-ring 162D is disposed to the inside surface of the guide recess 162C at the end (near the open end of the recess) proximate to the outside case 83, and the inside surface of the guide recess 162C slides against the outside surface of the guide sleeve 161 through this intervening O-ring 162D.

As a result, when the volume adjustment button 162 moves toward the inside case member 811 to the closed position with the inside surface of the guide recess 162C covering the hole 161C as shown in FIG. 21, the guide sleeve 161 is completely closed and the echo chamber 84 is kept airtight.

However, when the volume adjustment button 162 moves away from the inside case member 811 and the O-ring 162D at the inside surface of the guide recess 162C moves to a position separated from the outside case 83 to the outside of the hole 161C in the guide sleeve 161, the hole 161C is open as shown in FIG. 22. More specifically, a sound wave transmission path is formed passing from the hole 161C through the inside of the guide sleeve 161 (the gap between the inside cylindrical wall of the guide sleeve 161 and the shaft part 162A of the volume adjustment button 162) and communicating with the inside of the echo chamber 84.

A stopper not shown that prevents the volume adjustment button 162 from coming all the way out is disposed to the inside case member 811 side end of the shaft part 162A. This stopper is, for example, a flange with a larger diameter than the shaft part 162A so that when the volume adjustment button 162 is pulled out a predetermined amount the stopper meets a stop not shown disposed to the inside case 81 and limits further movement of the volume adjustment button 162.

Echo Effect of the Echo Chamber

The echo effect of the echo chamber 84 described above on sound was tested and the results are described below with reference to FIG. 23 to FIG. 27.

Sample timepieces were manufactured as shown in (I) to (IV) below.

(I) A timepiece in which the wall thickness < of the outside case 83 (see FIG. 21 and FIG. 22) was 0.6 mm, the distance β from the outside surface of the inside case member 811 to the inside surface of the outside case 83 (see FIG. 21 and FIG. 22) was 2.95 mm, and there was no echo chamber 84.

(II) A timepiece 9A in which the wall thickness < of the outside case 83 was 0.6 mm, the distance β from the outside surface of the inside case member 811 to the inside surface of the outside case 83 was 2.95 mm, and there was an echo chamber 84.

(III) A timepiece in which the wall thickness < of the outside case 83 was 1.2 mm, the distance β from the outside surface of the inside case member 811 to the inside surface of the outside case 83 was 2.3 mm, and there was no echo chamber.

(IV) A timepiece 9A in which the wall thickness < of the outside case 83 was 1.2 mm, the distance β from the outside surface of the inside case member 811 to the inside surface of the outside case 83 was 2.3 mm, and the echo chamber 84 was smaller than in timepiece sample (II) above.

The gongs 72 used in each of the timepiece samples (I) to (IV) were the same size and had the same vibration frequency. The hammer pin units 130 were also identical, the striking force of the hammers were the same, and the maximum sound pressure, the sound pressure at the start of reverberation (10 msec after sound was produced), and the sound pressure attenuation rate were measured at a position the same distance from the timepiece when the gong 72 was struck.

Figure 23:
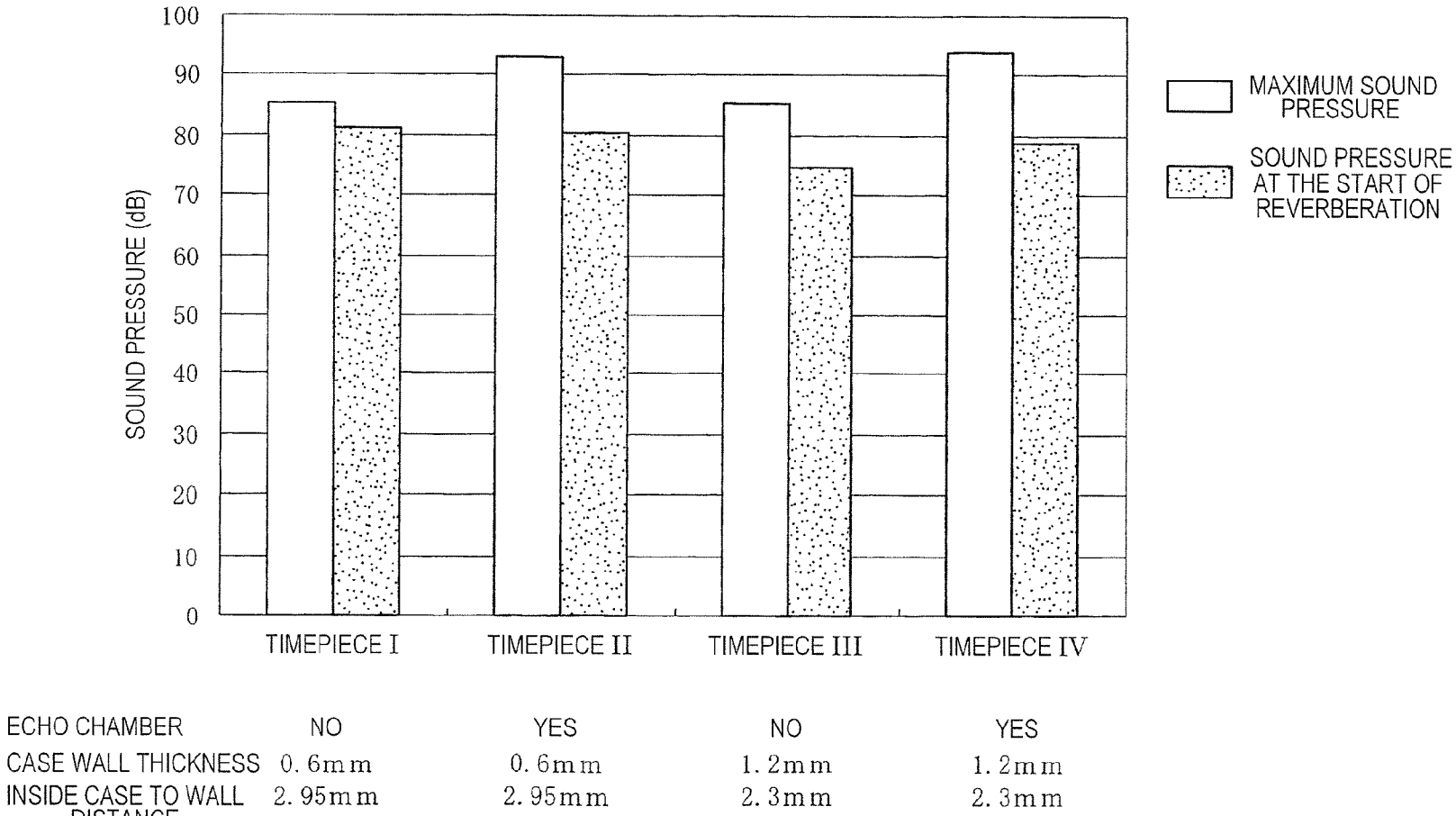
FIG. 23 shows the differences in maximum sound pressure and sound pressure at the start of reverberation based on the size of the echo chamber and whether there is an echo chamber.

FIG. 23 shows the differences in the maximum sound pressure and the sound pressure at the start of reverberation depending whether or not the timepiece had a echo chamber 84 and the size of the echo chamber 84.

Figure 24:
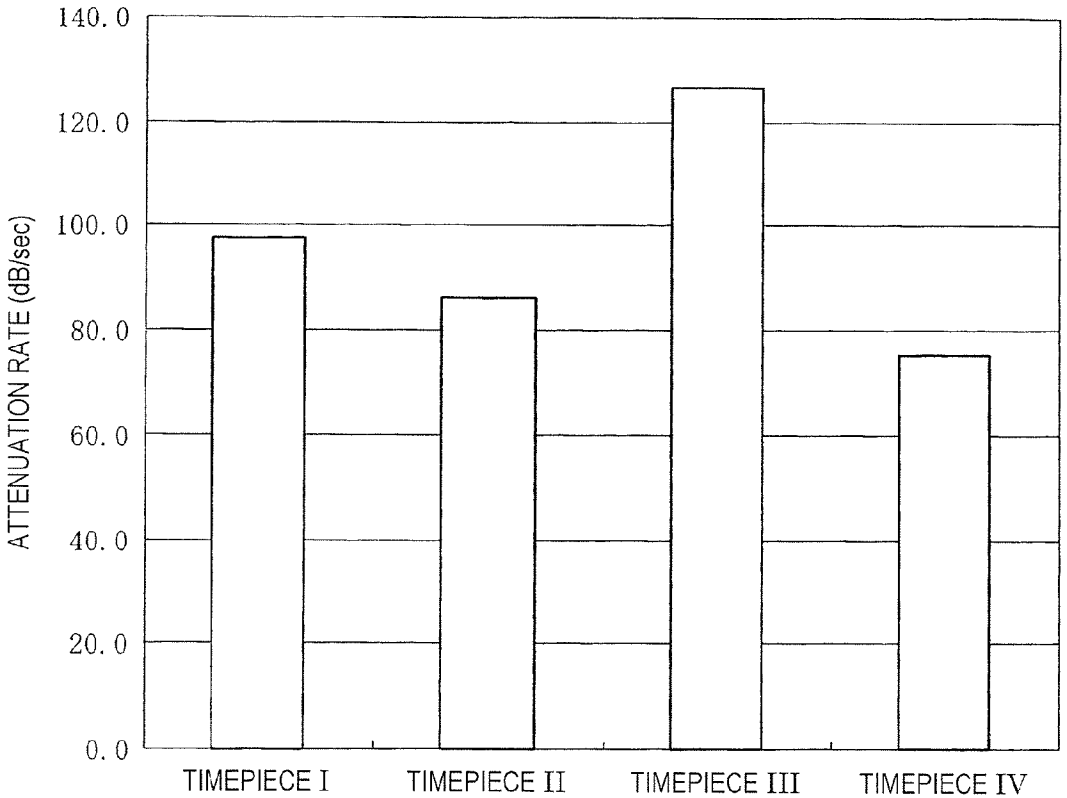
FIG. 24 shows the sound pressure attenuation rate based on the size of the echo chamber and whether there is an echo chamber.

FIG. 24 shows the sound pressure attenuation rate depending whether or not the timepiece had a echo chamber 84 and the size of the echo chamber 84.

In FIG. 23 and FIG. 24, the timepiece not having an echo chamber means that the airtightness of the echo chamber was eliminated by, for example, rendering an opening of at least a predetermined area in the outside case 83. Having an echo chamber meant only that a space of approximately 1-2 $mm^2$ was rendered in the echo chamber 84, and the inside of the echo chamber 84 was substantially airtight. In addition, the case wall thickness is the wall thickness of the outside case 83, and the inside case to wall distance is the distance from the outside surface of the inside case member 811 to the inside surface of the outside case 83. The smaller the case wall thickness and the greater the inside case to wall distance, the greater the internal volume of the echo chamber 84.

In FIG. 23 the bars on the right indicate the maximum sound pressure, and the bars on the left indicate the sound pressure at the start of reverberation.

Comparing timepieces that have an echo chamber 84 with timepieces that do not have a echo chamber 84 by comparing (I) with (II) and (III) with (IV) in FIG. 23 and FIG. 24 confirms that the maximum sound pressure is increased when the timepiece has an echo chamber 84.

It was also confirmed that the sound pressure attenuation rate is lower and reverberations last longer when there is an echo chamber 84. More specifically, when the timepiece does not have an echo chamber 84, the sound produced by the gong 72 does not resonate and escapes directly outside the timepiece, and the sound pressure is therefore low and the sound pressure attenuation rate rises.

However, by rendering an echo chamber 84 as described in this embodiment of the invention, the sound waves produced by the gong 72 resonate and the sound pressure can be increased. It is also more difficult for the sound to escape to the outside, and the reverberations continue for a long time.

Furthermore, while changing the volume of the echo chamber 84, that is, the distance between the inside case member 811 and outside case 83, does not produce a great change in the maximum sound pressure, an echo chamber 84 with a large volume produces a higher sound pressure at the start of reverberation than does an echo chamber 84 with a smaller volume. On the other hand, an echo chamber 84 with a smaller volume has a lower sound pressure attenuation rate than a larger echo chamber.

As a result, to manufacture a timepiece 9A with a high sound pressure at the start of reverberation, the echo chamber 84 is designed with a larger internal volume, and to manufacture a timepiece 9A with a long reverberation time, the echo chamber 84 is designed with a smaller internal volume. The timepiece 9A can thus be easily manufactured for a desired objective.

Timepieces were also manufactured with the open area of the hole 161C disposed to the echo chamber 84 ranging from 0 (a completely airtight echo chamber) to 1-2 $mm^2$, 5-6 $mm^2$, 8-10 $mm^2$, 15-18 $mm^2$, and 30-34 $mm^2$, and the maximum sound pressure, sound pressure at the start of reverberation, and sound pressure attenuation rate were measured at a position a predetermined distance from each timepiece.

Figure 25:
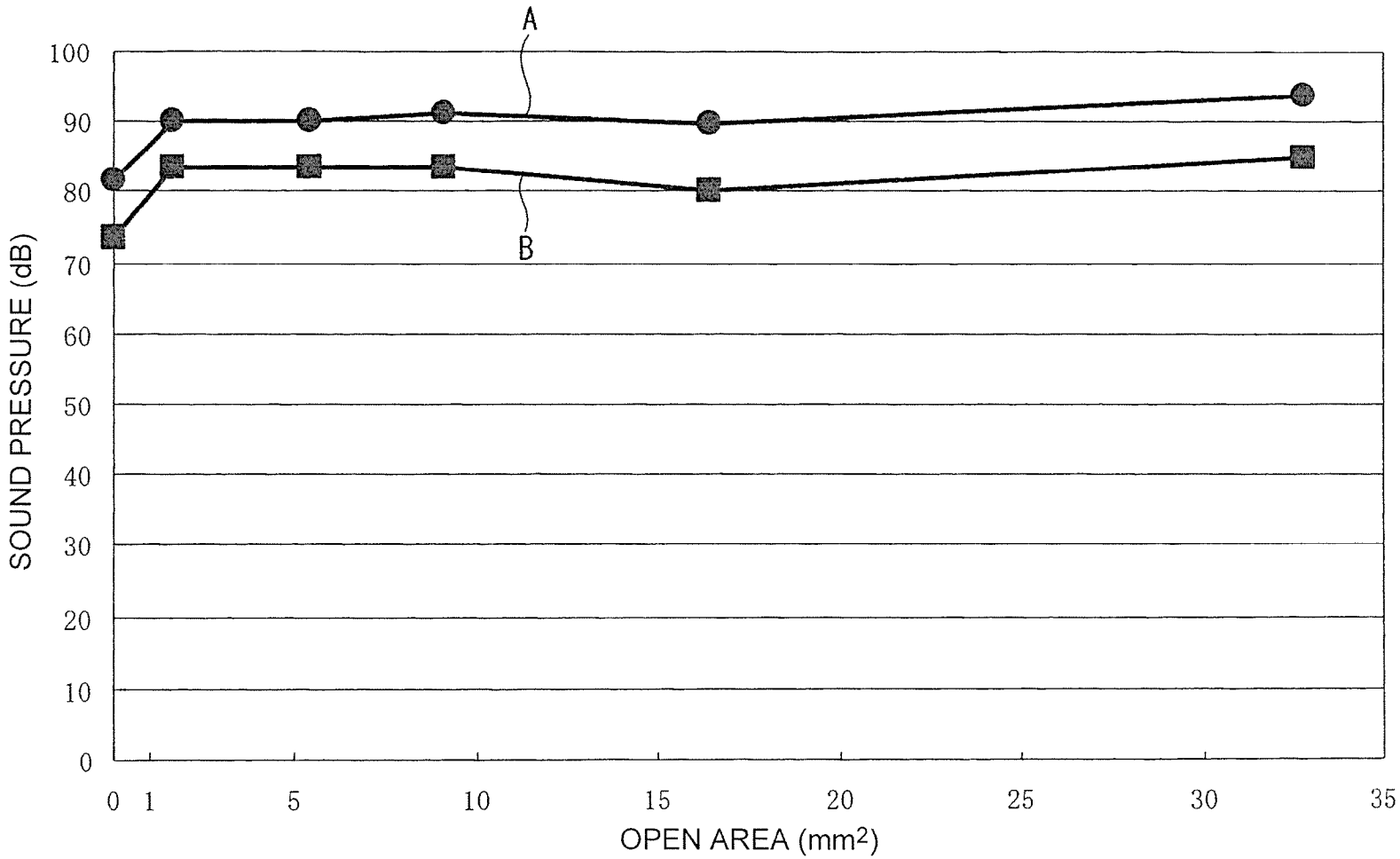
FIG. 25 shows the relationship between the open area of the space and the sound pressure of the sound produced by the gong.

FIG. 25 shows the relationship between the open area of the hole 161C and the sound pressure of the sound produced by the gong 72. In FIG. 25 curve A denotes the change in maximum sound pressure, and curve B denotes the change in sound pressure at the start of reverberation.

Figure 26:
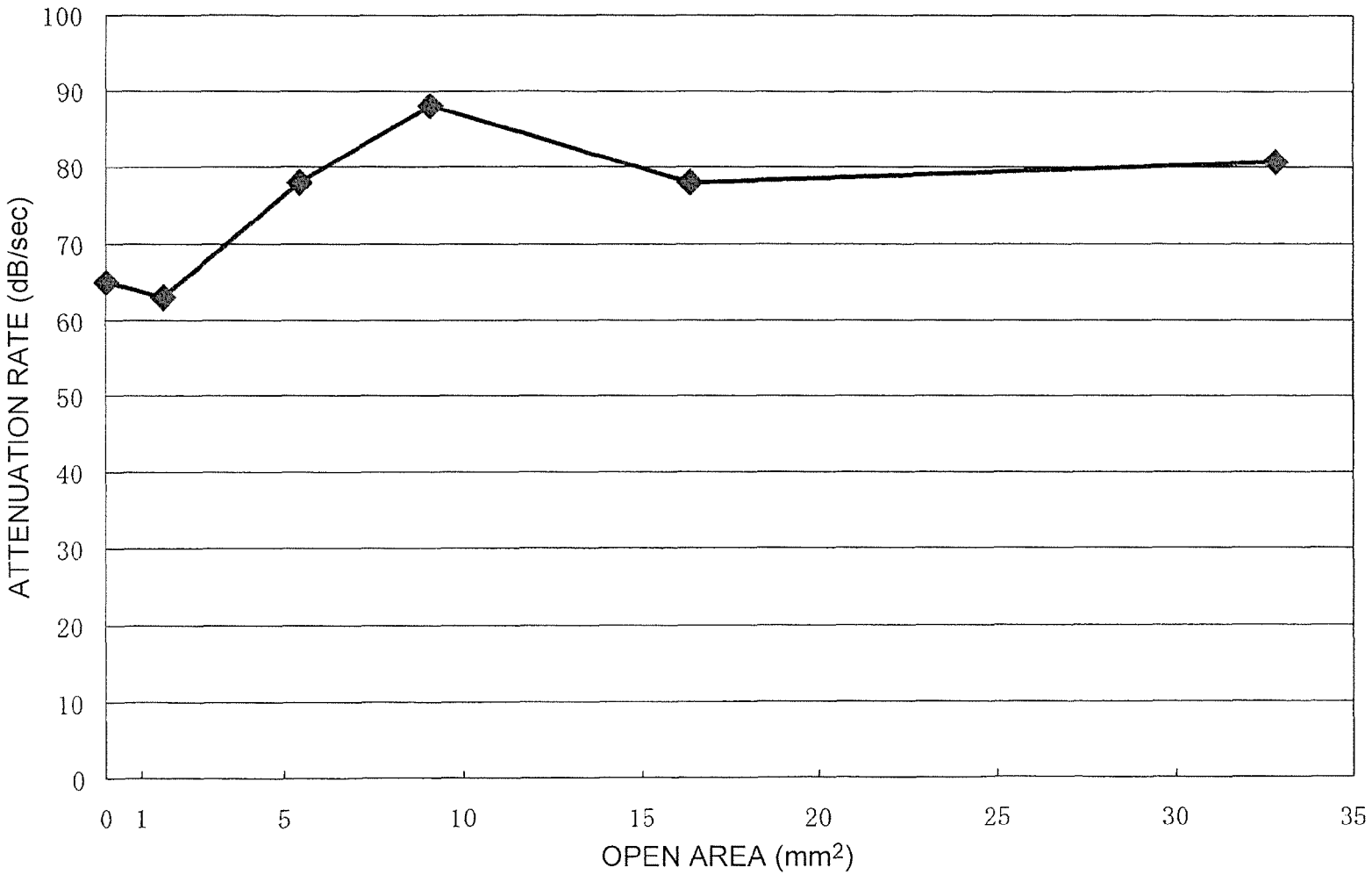
FIG. 26 shows the relationship between the open area of the space and the sound pressure attenuation rate.

FIG. 26 shows the relationship between the open area of the hole 161C and the sound pressure attenuation rate.

As shown in FIG. 25 the maximum sound pressure and sound pressure at the start of reverberation are greatest and the sound pressure attenuation rate is lowest when the hole 161C disposed to the echo chamber 84 is approximately 1-2 $mm^2$. Because sound is trapped inside the echo chamber 84 when the echo chamber 84 is airtight and there is no hole 161C, the output of sound outside of the timepiece is suppressed and the sound pressure drops. As shown in FIG. 26, the sound pressure attenuation rate rises as the area of the hole 161C increases. More specifically, if the hole 161C is large, the sound escapes through the hole 161C without echoing inside the echo chamber 84, and the duration of the reverberation drops.

However, by setting the area of the hole 161C to approximately 1-2 $mm^2$ as described in this embodiment of the invention, the sound echoes desirably inside the echo chamber 84 and the sound can be output from the hole 161C to the outside of the timepiece with sufficient volume.

The change in the sound pressure from the maximum sound pressure was measured and compared for timepieces using a bell 20 such as described in the first embodiment as the sound source, using a single gong 72 as described in the timepieces according to second to sixth embodiments, and using two gongs 72 as described in this embodiment.

Figure 27:
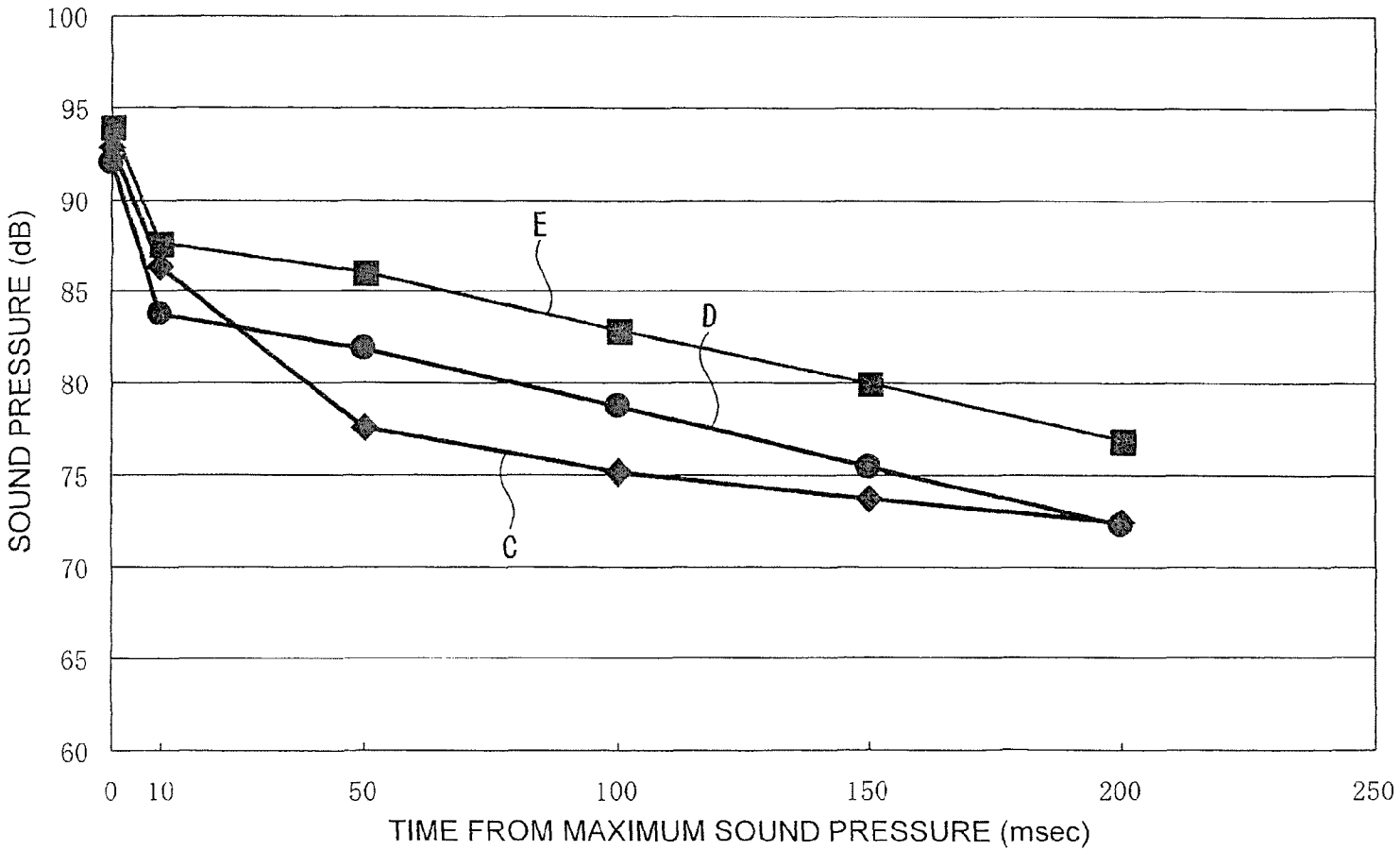
FIG. 27 shows the change in sound pressure when a bell and a gong are struck by a hammer with a predetermined spring force.

FIG. 27 shows the change in sound pressure when the bell and gongs were struck by a hammer driven by a spring with a predetermined force. In FIG. 27 curve C denotes the change in sound pressure when a bell 20 was struck using a hammer 40 driven with a predetermined spring force. Curve D denotes the change in sound pressure when a gong 72 was struck using a hammer 40 driven with the same force used to sound the bell 20 in curve C. Curve E denotes the change in sound pressure when the gong 72 was struck with a hammer 40 using twice the spring force used to strike the gong 72 denoted by curve D.

While a bell 20 has greater volume than a gong 72 and is therefore generally less space efficient, a bell 20 produces more sound than a gong 72 when struck by a hammer using the same spring force. However, as will be known from curves C and D in FIG. 27, using an echo chamber 84 produces approximately the same sound at the maximum sound pressure, and doubling the spring force used to drive the hammer 40 produces reverberations that last longer than the bell 20.

Note that an extremely large space is required for the echo chamber 84 when a bell 20 is used. Therefore, when a bell 20 is built into a wristwatch as described in the foregoing embodiment, a configuration not having an echo chamber 84 is better for producing a sound with the desired sound pressure, and the sound of the bell 20 can be more easily emitted to the outside by rendering openings in the inside case member.

In addition to the effects of the first to sixth embodiments of the invention described above, the timepiece according to this seventh embodiment of the invention also has the following effects.

The timepiece 9A according to the seventh embodiment of the invention has two gongs 72 disposed offset in the thickness direction of the timepiece 9A. The maximum sound pressure can therefore be increased and a better sound can be produced compared with a configuration having only one gong 72.

The timepiece 9A also has two hammer pin units 130 corresponding to the two gongs 72. The striking force for sounding the two gongs 72 is therefore transmitted to each gong from the corresponding hammer pin unit 130, and the gongs 72 can be sounded with a strong striking force because the striking force is not dispersed as it is when two gongs 72 are sounded simultaneously by a single hammer pin unit 130. Each gong 72 can therefore produce a pleasant tone with high sound pressure.

An outside case 83 covers the inside case member 811 and gongs 72, and a substantially airtight echo chamber 84 is formed in the space enclosed by the inside case member 811 and outside case 83.

The sound produced by the gong 72 therefore echoes and resonates inside the echo chamber 84, and the resonation increases the sound pressure. Sound with greater sound pressure can therefore be produced than a configuration in which the sound produced by the gongs 72 is output directly to the outside without echoing. Furthermore, because the sound echoes inside the echo chamber 84, the sound does not escape all at once and the reverberation time can be extended for a long time.

A gap with a small hole 161C of approximately 1-2 $mm^2$ is also disposed to the echo chamber 84. The sound can therefore be output to the outside from this hole 161C. More specifically, if the echo chamber 84 is completely airtight the sound resonates inside the echo chamber 84 but is impeded from travelling to the outside, and the sound pressure outside the timepiece is therefore low.

However, disposing this hole 161C enables the sound amplified by the resonance effect inside the echo chamber 84 is output desirably, the sound pressure outside the timepiece can be increased, and a better sound can be produced.

A volume adjusting unit 160 is disposed to the outside case 83 of the timepiece 9A so that the open or closed state of the foregoing hole 161C can be changed. As a result, when it is desirable to prevent the penetration of dust or the penetration of moisture inside the timepiece when it is raining, for example, the volume adjusting unit 160 can be moved to the closed position to improve the water resistance and dust resistance of the timepiece, or to reduce the volume. Alternatively, when it is desirable to sound the gong so that the sound pressure output from the timepiece 9A is high and the reverberation is long, the volume adjusting unit 160 can be operated open the hole 161C so that sound amplified by the resonance effect inside the echo chamber 84 can be output and a better sound can be produced. Depending on the user's preference and the operating conditions, the timepiece can therefore be switched between a quiet, low volume mode emphasizing water and dust resistance, and a high volume mode with a lasting reverberation.

The volume adjusting unit 160 has a tubular guide sleeve 161 that connects the outside of the outside case 83 with the inside of the echo chamber 84 and has a hole 161C formed in the outside surface, and a volume adjustment button 162 that has a shaft part 162A with a smaller diameter than the inside diameter of the guide sleeve 161 and is inserted inside the guide sleeve 161 so that it can move in the axial direction in and out. A guide recess 162C that covers the cylindrical outside surface of the guide sleeve 161 is formed in the head part 162B of the volume adjustment button 162, and this guide recess 162C opens and closes the hole 161C when the volume adjustment button 162 moves in and out. A structure that opens and closes the hole 161C is thus rendered using only two parts, the guide sleeve 161 and the volume adjustment button 162, and the hole 161C can be easily opened and closed by means of a simple structure.

VARIATIONS OF THE INVENTION

The invention is not limited to the embodiments described above and can be improved and varied in many ways without departing from the scope of the accompanying claims.

Figure 28:
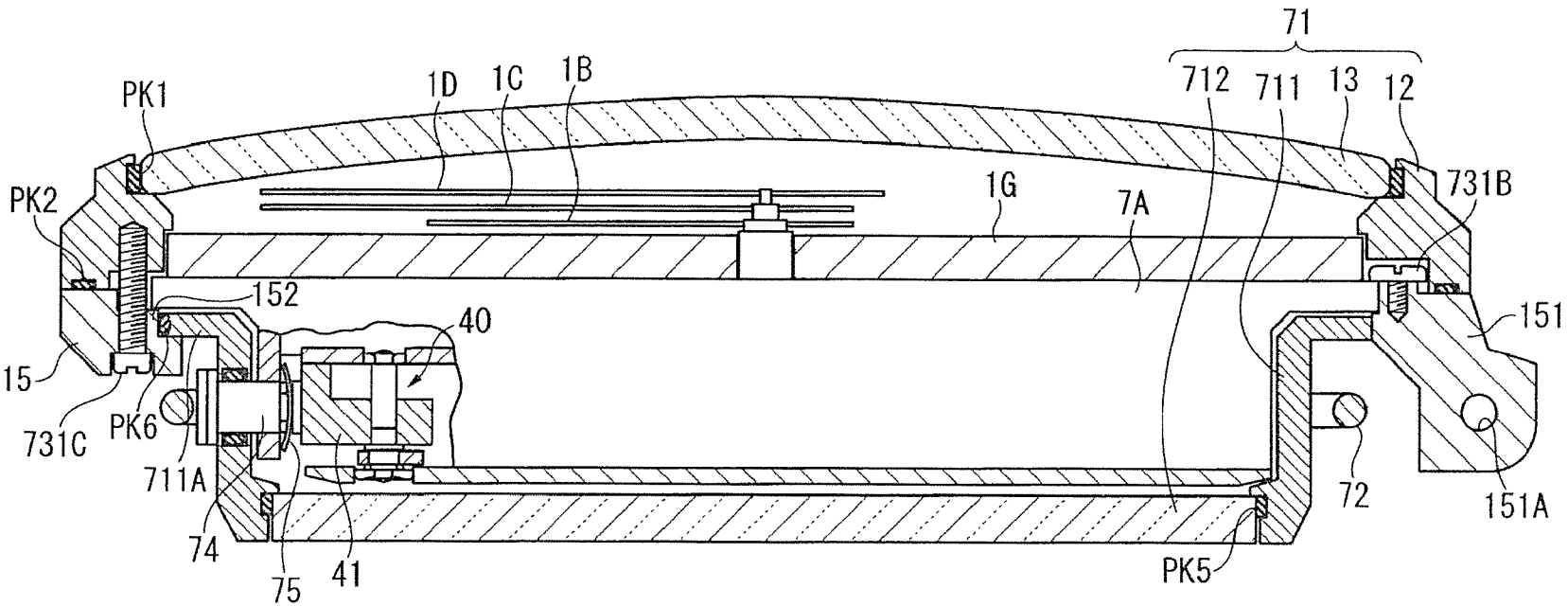
FIG. 28 is a vertical section view of a timepiece according to a variation of the invention.

FIG. 28 is a vertical section view of a timepiece according to a variation of the invention. The timepiece according to this aspect of the invention has a movement 7A, an inside case member 711, a back crystal 712, a bezel 12, a crystal 13, a gong 72, and a fastening member 15 that holds the inside case member 711 and bezel 12 together. The inside case member 711, the back crystal 712, the bezel 12, and the crystal 13 render an inside case 71 that houses the movement 7A in an airtight state. This aspect of the invention does not have an external case that houses the gong 72 between the external case and inside case, and the gong 72 is therefore exposed to the outside air.

The fastening member 15 is shaped in a ring conforming to the back of the bezel 12, and has a band attachment unit 151 in which spring pin insertion holes 151A for attaching a band not shown are formed, and a shoulder 152 that protrudes to the inside of the fastening member 15 for supporting the flange 711A of the inside case member 711 placed thereon.

While openings 311 are formed in the outside case in the embodiments described above so that air vibrations can be produced by vibration of the sound source, this aspect of the invention does not an outside case. This aspect of the invention achieves the same effects described above.

The openings rendered in the outside case are not limited to the configurations described above, and can be rendered as shown in FIG. 29 to FIG. 32. Note that FIG. 29 to FIG. 32 show the lugs 141 (band attachment unit) disposed to the 6:00 o'clock and 12:00 o'clock positions of the timepiece, and the crown 1F disposed to the 3:00 o'clock position.

Figure 29:
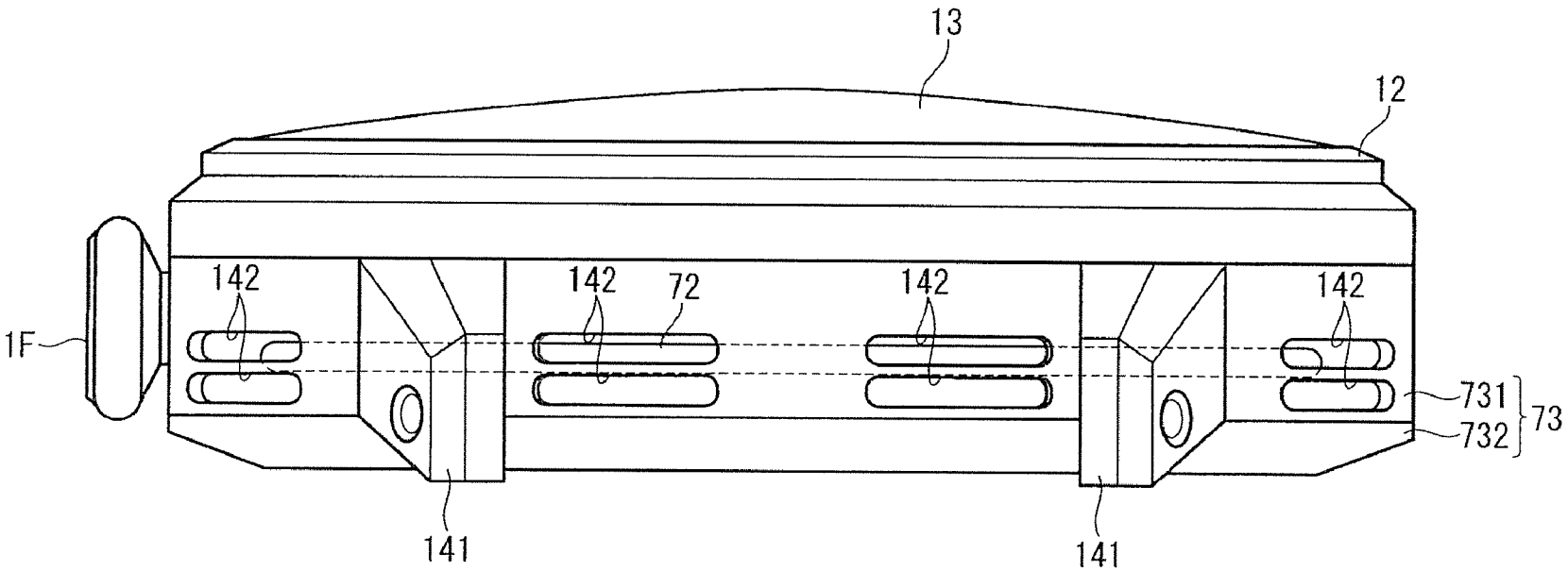
FIG. 29 is a side view showing the slits in a timepiece according to a variation of the invention.
Figure 30:
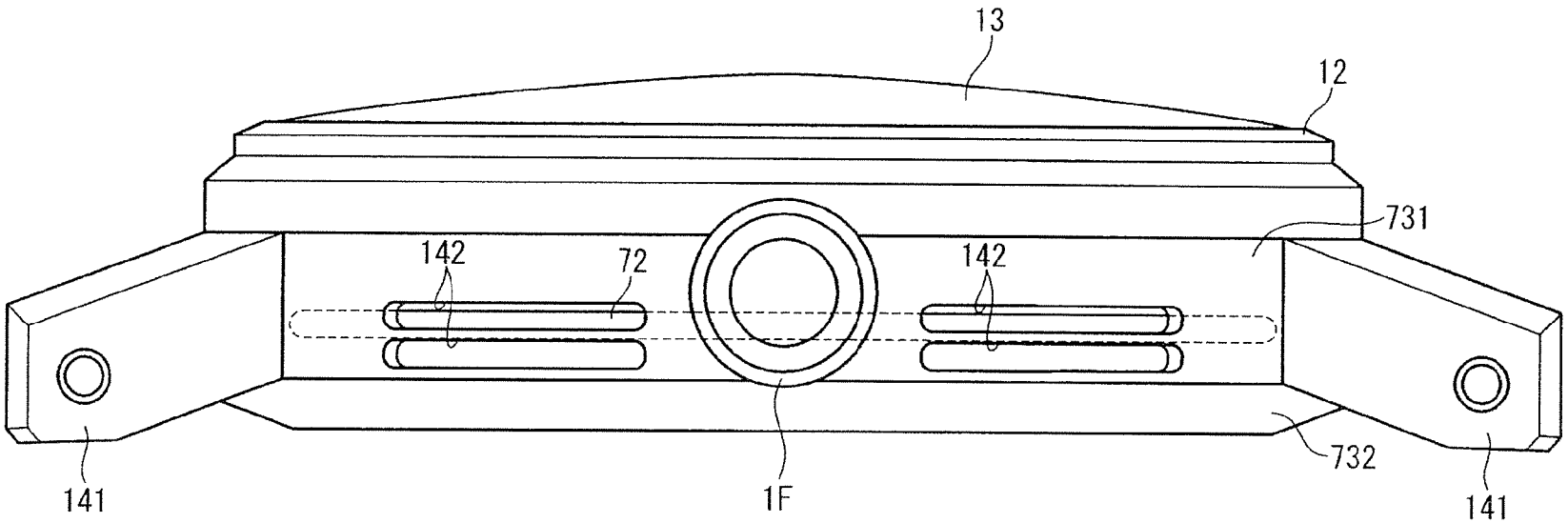
FIG. 30 is a side view showing the slits in a timepiece according to a variation of the invention.

The example shown in FIG. 29 and FIG. 30 has a plurality of slit-like openings 142 formed in the external case member 731 of the outside case 73. The openings 142 are formed at positions corresponding to and near the gong 72.

Figure 31:
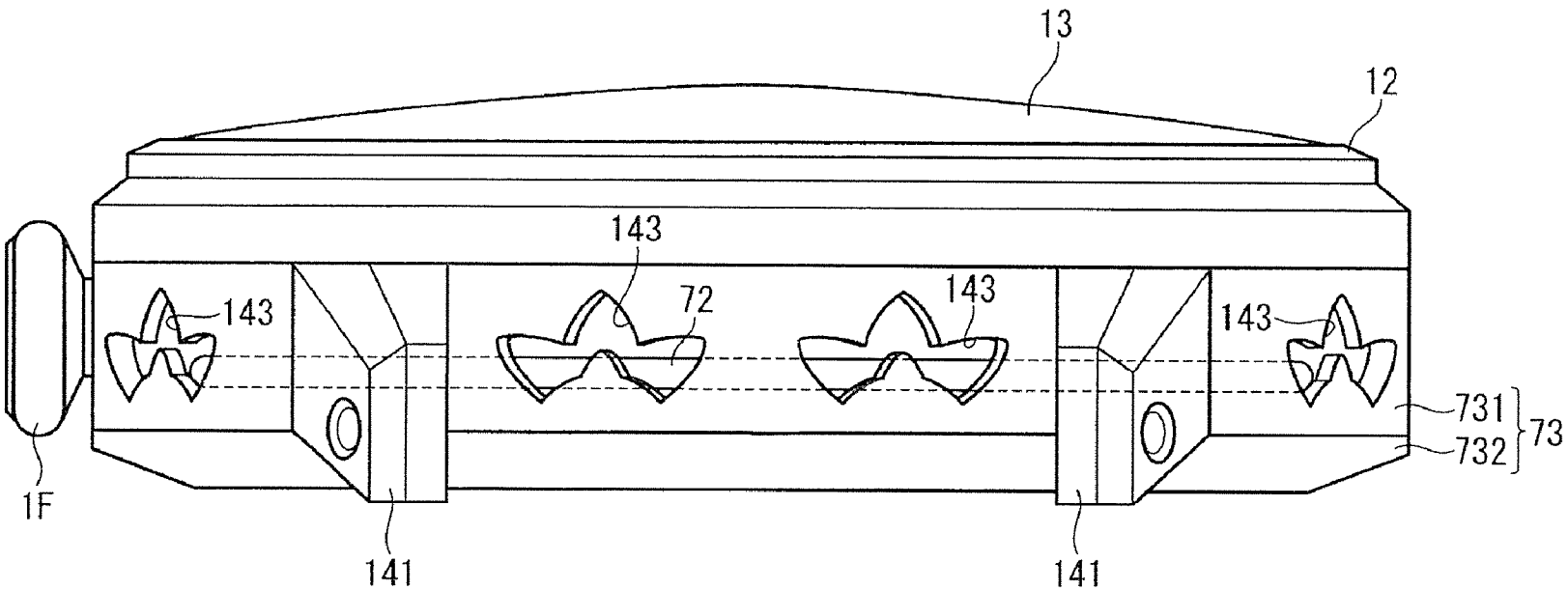
FIG. 31 is a side view showing the decorative holes in a timepiece according to a variation of the invention.
Figure 32:
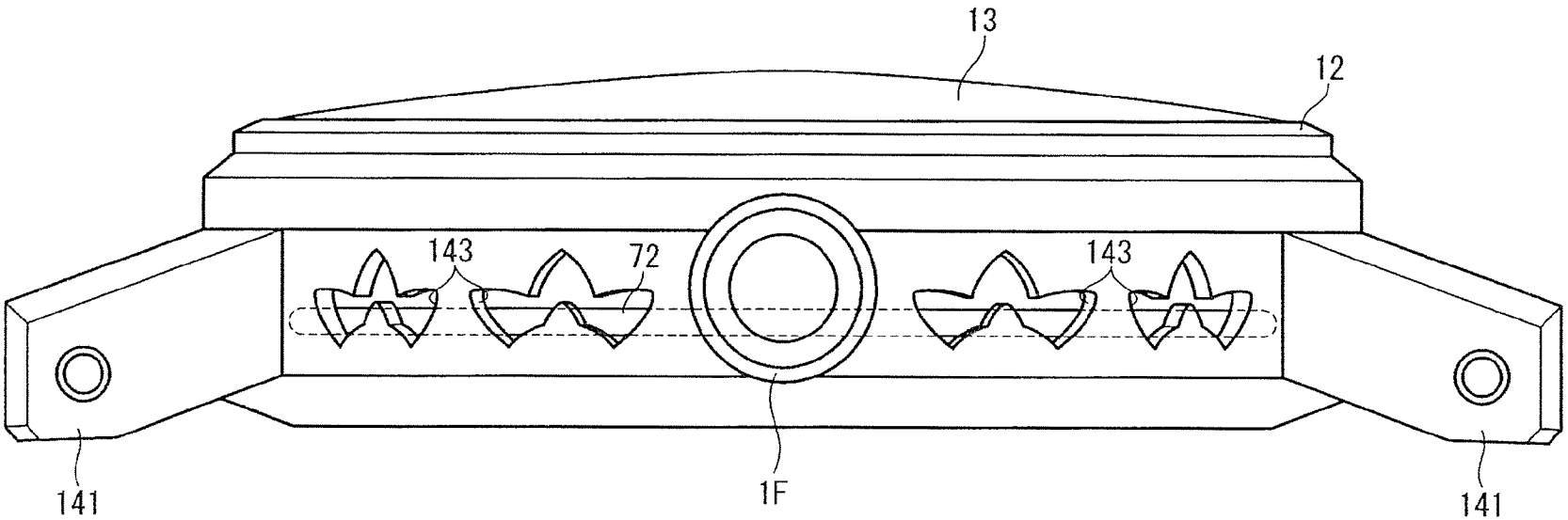
FIG. 32 is a side view showing the decorative holes in a timepiece according to a variation of the invention.

The example shown in FIG. 31 and FIG. 32 has a plurality of openings 143 with decoratively designed shapes formed in the external case member 731 of the outside case 73. The openings 143 are formed at positions corresponding to and near the gong 72.

Because the inside of the inside case is airtight as described above, it is not necessary to render the inside of the outside case in which the sound source is located water resistant. As a result, as shown in FIG. 29 to FIG. 32 and the embodiments described above, the openings can be formed in the middle of the side of the external case member 731 near where the gong 72 is located. The size of the formed openings (the size of one opening and the total size of all openings) can therefore be increased. This enables the sound produced by the sound source struck by the hammer to travel outside the outside case with sufficient volume.

Furthermore, because the openings can be formed at conspicuous locations on the outside case, the openings can be used to improve the aesthetic design.

The openings can more particularly be located where desired, and the openings can be formed where they will be hidden by the watch band when the timepiece is worn. The location where the openings are formed is also not limited to the middle of the side of the outside case, and the openings can be rendered where the outside case and the back cover meet or in the back cover.

The timepieces in FIG. 29 to FIG. 32 are shown with a gong 72, but a bell 20 can be used as the sound source instead. As described above, when a gong 72 is used as the sound source, a configuration having an echo chamber 84 can better produce a pleasing sound because of the volume and shape of the gong 72. On the other hand, when a bell 20, which occupies a relatively large space, is used, an echo chamber 84 with a large internal volume is needed in order to achieve the resonance effect of the echo chamber 84, and the echo chamber 84 is therefore unsuitable for a wristwatch with a bell 20. However, by rendering openings as described above, a configuration that desirably transmits the produced sound outside of timepiece can be achieved even if a bell 20 or other sound source with a relatively large volume is used.

A volume adjusting unit 160 that can be operated by the user to open and close the hole 161C is disposed to the outside case 83 in the seventh embodiment of the invention, but the invention is not so limited. For example, the packing PK11 between the outside case 83 and the back cover ring 813 can be removed to render a space of approximately 1-2 $mm^2$ between the outside case 83 and the back cover ring 813.

The volume adjusting unit 160 is described as having a guide sleeve 161 and a volume adjustment button 162, but the invention is not so limited. For example, a configuration that has a space connecting the echo chamber 84 with the outside of the timepiece 9A formed in the outside surface of the outside case 83, and a shutter that opens and closes this space by sliding along the outside surface of the outside case 83, is also possible.

A stopper 140 fixed inside the movement 7A is disposed to the hammer pin unit 130 described above to limit movement of the hammer pin 132, but the stopper 140 could be fastened to the inside case member 811.

The movement (timekeeping mechanism) that drives the hands of the timepiece 1 can be for a mechanical timepiece, an analog quartz timepiece, or an electronically controlled mechanical timepiece. However, because a mechanical timepiece produces the ticking sound of a governor composed of a balance, hair spring, pallet fork, and escape wheel, and an analog quartz timepiece produces the sounds of magnetostriction and gear chatter, and the invention is therefore desirably suited to an electronically controlled mechanical timepiece that is more resistant to producing such noise.

A barrel wheel for driving the sonnerie mechanism and repeater mechanism is provided separately from the barrel wheel that drives the hands in the embodiments described above, but excess torque from the barrel wheel for driving the hands can be distributed to the sonnerie and repeater mechanisms. More particularly, a single barrel wheel can be used to drive both the hands and the sonnerie or repeater mechanism.

The embodiments described above use the barrel wheel, which is a mechanical energy storage means, as the drive power source for the sonnerie and repeater mechanisms, and drive the hammer by means of a striking control means, but the hammer drive device can be configured in any way that enables striking the hammer. The governor device that adjusts the rotational speed of the barrel wheel can also be omitted.

The embodiments described above use the barrel wheel, which is a mechanical energy storage means, as the drive power source for the hammer drive device, but the invention is not so limited. A battery, for example, can be used as the power source, or a motor can be used as the hammer drive device to drive the hammer.

The hammer pin units and hammer pins described above as the striking force transmission member can be used in any of the embodiments and variations described above.

The striking force transmission member can be any member disposed to move bidirectionally between the hammer and sound source and transfer the striking force of the hammer to the sound source, and is therefore not limited to a pin configuration, but using a pin simplifies the striking force transmission member.

A gong is disposed between the inside case member and outside case member in the second embodiment above, but the gong could alternatively be disposed between the bottom of the inside case and the back cover.

The bell 20 in the first embodiment is a copper alloy, but the bell is not limited to any particular material and can be made from stainless steel, for example.

The sound source is disposed outside the case in the foregoing embodiments, but the invention is not so limited and the sound source can be disposed inside the case. Such configurations can achieve the same effects of the invention described above by disposing the striking force transmission member between the hammer and sound source so that the striking force of the hammer is transmitted through the striking force transmission member to the sound source.

Sleeves 151, 102, 122, 131 are described as the holding units above, but the invention is not so limited. For example, a hole that directly holds and allows the hammer pin 52, 74, 101, 121, 132 to slide can be formed in the inside case member 11, and this hole can function as the holding unit.

The invention is also not limited to a timepiece that has the sonnerie mechanism or repeater mechanism described above, and can be used in any timepiece or device that has a mechanism for producing sound by a mechanical striking action such as an alarm, a timer, or a carillon.

The best modes and methods of achieving the present invention are described above, but the invention is not limited to these embodiments. More specifically, the invention is particularly shown in the figures and described herein with reference to specific embodiments, but it will be obvious to one with ordinary skill in the related art that the shape, material, number, and other detailed aspects of these arrangements can be varied in many ways without departing from the technical concept or the scope of the object of this invention.

Therefore, description of specific shapes, materials and other aspects of the foregoing embodiments are used by way of example only to facilitate understanding the present invention and in no way limit the scope of this invention, and descriptions using names of parts removing part or all of the limitations relating to the form, material, or other aspects of these embodiments are also included in the scope of this invention.

The invention being thus described, it will be obvious that it may be varied in many ways. Such variations are not to be regarded as a departure from the spirit and scope of the invention, and all such modifications as would be obvious to one skilled in the art are included within the scope of the following claims.

What is claimed is:

1. A timepiece comprising:

a movement having a hammer and a hammer drive device that drives the hammer;

a case that houses the movement;

a sound source that produces sound by vibrating when struck; and a striking force transmission member that moves bidirectionally between the hammer and the sound source, and transmits the striking force of the hammer to the sound source, the striking force transmission member including a pin that moves bidirectionally between the hammer and the sound source, a closing member that closes a space between the pin and a holding unit that supports the pin, and an urging member that urges the pin towards the hammer, the closing member being an annular or tubular elastic member, the inside edge part of the elastic member when the elastic member is annular, or one axial end part of the elastic member when the elastic member is tubular, being fixed to an outside surface part of the pin, the outside edge part of the elastic member when the elastic member is annular, and the other axial end part of the elastic member when the elastic member is tubular, being fixed to the holding unit.

2. The timepiece described in claim 1, wherein:

the striking force transmission member has a first pin and a second pin that are connected lengthwise as the pin; and the inside edge part of the elastic member when the elastic member is annular, or one axial end part of the elastic member when the elastic member is tubular, is held between the first pin and the second pin.

3. The timepiece described in claim 1, wherein the striking force transmission member includes a pin that moves bidirectionally between the hammer and the sound source, and a closing member that closes a space between the pin and a holding unit that supports the pin, the closing member is an annular or tubular elastic member, and the pin is urged toward the hammer by the elastic closing member.

4. The timepiece described in claim 1, further comprising an outside case disposed outside the case covering at least a part of the sound source, and an opening enabling the free passage of air in and out is formed in the outside case.

5. The timepiece described in claim 1, wherein the case has a cylindrical case member disposed around the movement, and a crystal and cover unit respectively disposed on the opposite axial ends of the case member, and the sound source is bowl shaped with a bottom part opposing the cover unit of the case and a side wall part opposing the case member of the case.

6. The timepiece described in claim 1, wherein at least a part of the case is a magnetic body.

7. The timepeice according to claim 1, wherein the outside edge part of the elastic member is annular, or the other axial end part of the elastic member when the elastic member is tubular, is fixed to the holding unit.

8. The timepiece described in claim 1, wherein the one axial end of the elastic member is fixed to the outside surface part of the pin, and the other axial end part of the elastic member is fixed to the holding unit.

9. The timepiece described in claim 1, further comprising an outside case disposed outside the case covering at least a part of the sound source, and an echo chamber that is disposed between the case and the outside case and causes sound produced by the sound source to echo.

10. The timepiece described in claim 9, further comprising a gap connecting the outside of the outside case with the inside of the echo chamber.

11. The timepiece described in claim 10, further comprising a gap opening and closing means for adjusting area of the gap.

12. The timepiece described in claim 11, wherein the echo chamber is formed by the case and the outside case, and has a communication hole connected to the outside is formed in the outside case, a gap forming member that is substantially cylindrical is fit to the communication hole, and has a hole formed in the outside cylindrical wall connecting the outside of the outside case with the inside of the cylinder, the gap is formed by the hole in the gap forming member and the cylindrical wall part of the gap forming member, and the gap opening and closing means has a closing surface that can close the hole in the gap forming member, can advance and retract freely in the axial direction of the gap forming member, and can open and close the gap by moving the closing surface to a closed position where the hole is closed or an open position where the hole is open.

13. The timepiece described in claim 1, wherein the case has a cylindrical case member disposed around the movement, and a crystal and cover unit respectively disposed on the opposite axial ends of the case member, and the sound source is a bar shaped along the circumference of the case member.

14. The timepiece described in claim 13, further comprising a plurality of sound sources, and a plurality of striking force transmission members corresponding to the plurality of sound sources.

15. The timepiece described in claim 1, wherein the sound source is attached to the case.

16. The timepiece described in claim 15, wherein the case has a cylindrical case member disposed around the movement, and a crystal and cover unit respectively disposed on the opposite axial ends of the case member, the sound source is bowl shaped with a bottom part opposing the cover unit of the case and a side wall part opposing the case member of the case, a part of the bottom part of the sound source is attached by a fastening member to the cover unit of the case, and the fastening member has a fastening member body that is fixed to the bottom part and the cover unit, and an elastic member that has a portion disposed with a gap to the bottom part on the opposite side of the bottom part as the cover unit side, and a support portion that supports the bottom part.

17. A portable device comprising:

a movement having a hammer and a hammer drive device that drives the hammer;

a case that houses the movement;

a sound source that produces sound by vibrating when struck; and a striking force transmission member that is disposed to the case and moves bidirectionally between the hammer and the sound source, and transmits the striking force of the hammer to the sound source, the striking force transmission member including a pin that moves bidirectionally between the hammer and the sound source, a closing member that closes a space between the pin and a holding unit that supports the pin, and an urging member that urges the pin towards the hammer, the closing member being an annular or tubular elastic member, the inside edge part of the elastic member when the elastic member is annular, or one axial end part of the elastic member when the elastic member is tubular, being fixed to an outside surface part of the pin, the outside edge part of the elastic member when the elastic member is annular, and the other axial end part of the elastic member when the elastic member is tubular, being fixed to the holding unit.

* * * * *